US008795054B2

(12) United States Patent
Bozeman

(10) Patent No.: US 8,795,054 B2
(45) **Date of Patent: *Aug. 5, 2014**

(54) LOTTERY GAME WITH INTERACTIVE GAME INDICIA SELECTION

(75) Inventor: Alan Kyle Bozeman, Alpharetta, GA (US)

(73) Assignee: Scientific Games International, Inc., Newark, DE (US)

( * ) Notice: Subject to any disclaimer, the term of this patent is extended or adjusted under 35 U.S.C. 154(b) by 310 days.

This patent is subject to a terminal disclaimer.

(21) Appl. No.: 12/956,592

(22) Filed: Nov. 30, 2010

(65) Prior Publication Data

US 2011/0070938 A1 Mar. 24, 2011

Related U.S. Application Data

(63) Continuation of application No. 11/484,924, filed on Jul. 12, 2006, now Pat. No. 7,846,016.

(60) Provisional application No. 60/698,194, filed on Jul. 11, 2005.

(51) Int. Cl.
*A63F 9/00* (2006.01)

(52) U.S. Cl.
USPC ..... 463/17

(58) Field of Classification Search
USPC ..... 463/17
See application file for complete search history.

(56) References Cited

U.S. PATENT DOCUMENTS

| | | | |
|---|---|---|---|
| 4,206,920 | A | 6/1980 | Weatherford et al. |
| 4,375,666 | A | 3/1983 | Buck et al. |
| 4,466,614 | A | 8/1984 | Bachman et al. |
| 4,494,197 | A | 1/1985 | Troy et al. |
| 4,665,502 | A | 5/1987 | Kreisner |
| 4,689,742 | A | 8/1987 | Troy et al. |
| 4,817,951 | A | 4/1989 | Crouch et al. |
| 4,836,546 | A | 6/1989 | DiRe et al. |
| 4,856,787 | A | 8/1989 | Itkis |
| 4,943,090 | A | 7/1990 | Fienberg |
| 4,964,642 | A | 10/1990 | Kamille |
| 5,092,598 | A | 3/1992 | Kamille |

(Continued)

FOREIGN PATENT DOCUMENTS

| | | |
|---|---|---|
| EP | 0458623 | 11/1991 |
| GB | 222712 | 3/1990 |

(Continued)

OTHER PUBLICATIONS

PCT Search Report, Jan. 15, 2008.

*Primary Examiner* — Seng H Lim
(74) *Attorney, Agent, or Firm* — Dority & Manning, P.A.

(57) ABSTRACT

A method and system for conducting an interactive lottery game between players and a lottery gaming organization are provided. Player game indicia are displayed to the player on a graphical user interface along with separately displayed game indicia assigned to the gaming organization for play of the game. The player selects one of the game indicia via the user interface, with the player's selection designated on the user interface without being revealed to the gaming organization. The gaming organization subsequently randomly selects one of the game indicia, which is displayed to the player on the user interface. The system determines whether the player-selected game indicia match predetermined criteria as a function of the randomly selected game indicia. The steps are repeated until no game indicia remain or no further matches are possible.

16 Claims, 82 Drawing Sheets graphical user interface

(56) References Cited

U.S. PATENT DOCUMENTS

| | | | | |
|---|---|---|---|---|
| 5,112,050 | A | 5/1992 | Koza et al. | |
| 5,232,221 | A | 8/1993 | Sludikoff et al. | |
| 5,259,616 | A | 11/1993 | Bergmann | |
| 5,273,281 | A | 12/1993 | Lovell | |
| 5,332,219 | A | 7/1994 | Marnell, II et al. | |
| 5,342,047 | A | 8/1994 | Heidel et al. | |
| 5,407,199 | A | 4/1995 | Gumina | |
| 5,411,271 | A | 5/1995 | Mirando | |
| 5,451,052 | A | 9/1995 | Behm et al. | |
| 5,651,735 | A | 7/1997 | Baba | |
| 5,772,509 | A | 6/1998 | Weiss | |
| 5,830,067 | A | 11/1998 | Graves et al. | |
| 5,833,537 | A | 11/1998 | Barrie | |
| 6,086,477 | A | 7/2000 | Walker et al. | |
| 6,146,272 | A | 11/2000 | Walker et al. | |
| 6,168,521 | B1 | 1/2001 | Luciano et al. | |
| 6,206,373 | B1 | 3/2001 | Garrod | |
| 6,220,596 | B1 | 4/2001 | Horan | |
| 6,220,961 | B1 | 4/2001 | Keane et al. | |
| 6,227,969 | B1 | 5/2001 | Yoseloff | |
| 6,309,300 | B1 | 10/2001 | Glavich | |
| 6,312,334 | B1 | 11/2001 | Yoseloff | |
| 6,331,143 | B1 | 12/2001 | Yoseloff | |
| 6,346,043 | B1 * | 2/2002 | Colin et al. | 463/17 |
| 6,398,644 | B1 | 6/2002 | Perrie et al. | |
| 6,676,126 | B1 | 1/2004 | Walker et al. | |
| 6,824,465 | B2 * | 11/2004 | Luciano, Jr. | 463/18 |
| 7,134,959 | B2 | 11/2006 | Penrice | |
| 7,470,186 | B2 * | 12/2008 | Cannon | 463/18 |
| 7,500,914 | B2 | 3/2009 | Rodgers et al. | |
| 7,553,230 | B2 | 6/2009 | Cannon | |
| 7,628,690 | B2 * | 12/2009 | Englman et al. | 463/17 |
| 8,113,939 | B2 * | 2/2012 | Cannon | 463/18 |
| 2001/0034262 | A1 | 10/2001 | Banyai | |
| 2001/0036853 | A1 | 11/2001 | Thomas | |
| 2003/0114211 | A1 | 6/2003 | White | |
| 2003/0232638 | A1 | 12/2003 | Luciano, Jr. | |
| 2004/0023715 | A1 | 2/2004 | Luciano et al. | |
| 2004/0053660 | A1 | 3/2004 | Webb et al. | |
| 2005/0181855 | A1 * | 8/2005 | Englman et al. | 463/16 |
| 2006/0009283 | A1 * | 1/2006 | Englman et al. | 463/29 |
| 2006/0128457 | A1 | 6/2006 | Cannon | |
| 2006/0154717 | A1 | 7/2006 | Jackson | |
| 2007/0117611 | A1 | 5/2007 | Dodge | |
| 2007/0281774 | A1 * | 12/2007 | Khal | 463/19 |
| 2008/0026813 | A1 | 1/2008 | Cannon | |
| 2010/0137052 | A1 * | 6/2010 | Bennett | 463/16 |

FOREIGN PATENT DOCUMENTS

| | | |
|---|---|---|
| GB | 2295775 | 6/1996 |
| WO | WO 0193966 | 12/2001 |
| WO | WO 02056266 | 7/2002 |
| WO | WO 2004/095383 | 11/2004 |

* cited by examiner graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface

| Matches | 1/Prob | Prize |
|---|---|---|
| 2 | 5.4 | $7 |
| 3 | 16.3 | $10 |
| 4 | 65.2 | $20 |
| 5 | 327.3 | $50 |
| 6 | 1,920.0 | $100 |
| 7 | 15,120.0 | $500 |
| 8 | 80,640.0 | $5,000 |
| 10 | 3,628,800.0 | $1,000,000 |

figure 35 graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface graphical user interface

| Matches | 1/Prob | Prize |
|---|---|---|
| 5 | 7.4 | $5 |
| 6 | 26.3 | $10 |
| 7 | 48.5 | $100 |
| 9 | 1,260.0 | $500 |

figure 69 per round prizes

| Matches | Prize |
|---|---|
| 9 | $100 |
| 7 | $10 |
| 6 | $5 |

figure 70 cumulative prizes

| Matches | Prize |
|---|---|
| 21 | $5 |
| 22 | $7 |
| 23 | $10 |
| 24 | $15 |
| 25 | $20 |
| 26 | $25 |
| 27 | $30 |
| 28 | $40 |
| 29 | $50 |
| 30 | $75 |
| 31 | $100 |
| 32 | $500 |
| 33 | $2,000 |
| 34 | $10,000 |
| 35 | $100,000 |
| ≥ 36 | $1,000,000 |

figure 71 bonus round

| Matches | Multiplier |
|---|---|
| 10 | 10,000 |
| 8 | 500 |
| 7 | 50 |
| 6 | 10 |
| 5 | 5 |
| 4 | 3 |
| 3 | 2 |

figure 72

$$G(t) = 1.90476E\text{-}02 + 9.68254E\text{-}02\, t + 2.09524E\text{-}01\, t^2 + 2.69841E\text{-}01\, t^3 + 2.09524E\text{-}01\, t^4 + 1.35714E\text{-}01\, t^5 + 3.80952E\text{-}02\, t^6 + 2.06349E\text{-}02\, t^7 + 7.93651E\text{-}04\, t^9$$

figure 73

$$(1.90476E\text{-}02 + 9.68254E\text{-}02\, t + 2.09524E\text{-}01\, t^2 + 2.69841E\text{-}01\, t^3 + 2.09524E\text{-}01\, t^4 + 1.35714E\text{-}01\, t^5 + 3.80952E\text{-}02\, t^6 + 2.06349E\text{-}02\, t^7 + 7.93651E\text{-}04\, t^9)^5 =$$

$$2.50728E\text{-}09 + 6.37268E\text{-}08\, t + 7.85790E\text{-}07\, t^2 + 6.27501E\text{-}06\, t^3 + 3.65341E\text{-}05\, t^4 +$$

$$1.65475E\text{-}04\, t^5 + 6.07439E\text{-}04\, t^6 + 1.85893E\text{-}03\, t^7 + 4.84130E\text{-}03\, t^8 + 1.09000E\text{-}02\, t^9 +$$

$$2.14797E\text{-}02\, t^{10} + 3.74194E\text{-}02\, t^{11} + 5.81010E\text{-}02\, t^{12} + 8.09536E\text{-}02\, t^{13} + 1.01796E\text{-}01\, t^{14} +$$

$$1.16081E\text{-}01\, t^{15} + 1.20532E\text{-}01\, t^{16} + 1.14360E\text{-}01\, t^{17} + 9.94412E\text{-}02\, t^{18} + 7.94485E\text{-}02\, t^{19} +$$

$$5.84470E\text{-}02\, t^{20} + 3.96621E\text{-}02\, t^{21} + 2.48639E\text{-}02\, t^{22} + 1.44164E\text{-}02\, t^{23} + 7.73813E\text{-}03\, t^{24} +$$

$$3.84786E\text{-}03\, t^{25} + 1.77338E\text{-}03\, t^{26} + 7.57843E\text{-}04\, t^{27} + 3.00289E\text{-}04\, t^{28} + 1.10410E\text{-}04\, t^{29} +$$

$$3.76247E\text{-}05\, t^{30} + 1.19198E\text{-}05\, t^{31} + 3.48850E\text{-}06\, t^{32} + 9.56338E\text{-}07\, t^{33} + 2.38466E\text{-}07\, t^{34} +$$

$$5.73664E\text{-}08\, t^{35} + 1.18093E\text{-}08\, t^{36} + 2.60506E\text{-}09\, t^{37} + 4.01852E\text{-}10\, t^{38} + 9.11330E\text{-}11\, t^{39} +$$

$$8.27509E\text{-}12\, t^{40} + 2.39782E\text{-}12\, t^{41} + 7.55716E\text{-}14\, t^{42} + 4.09346E\text{-}14\, t^{43} + 3.14882E\text{-}16\, t^{45}$$

figure 74 graphical user interface graphical user interface graphical user interface graphical user interface graphical user interface graphical user interface graphical user interface graphical user interface

LOTTERY GAME WITH INTERACTIVE GAME INDICIA SELECTION

REFERENCE TO RELATED APPLICATIONS

The present application is a Continuation Application of U.S. patent application Ser. No. 11/484,924, filed Jul. 12, 2006, which claims the benefit of U.S. Provisional Patent Application No. 60/698,194, titled "Lottery Game With Interactive Game Indicia Selection," filed on Jul. 11, 2005, the entirety of which is hereby incorporated here in by this reference.

BACKGROUND OF THE INVENTION

1. Field of the Invention

The invention relates in general to on-line lottery games, and more specifically to an on-line lottery game method with interactively selected lottery and game player game indicia.

2. Description of the Related Art

Lottery games are a popular and successful means by which public lotteries have been able to generate revenues for use in the public good. The known types of lottery games include pre-printed scratch-off or "instant win" lottery games and on-line games. The known types of on-line games have traditionally comprised "lotto" type games, which require that a game player fill out a game play ticket with a series of lottery play numbers thereon, and/or designate a "quick pick" in which the numbers to play are selected for the player. The lottery play slip is scanned into a lottery terminal, typically a stand-alone terminal, whereupon a ticket is authorized by the lottery system and printed at-the lottery terminal. These known types of on-line games are conducted on a weekly or twice weekly basis by individual states or by multi-state lottery organizations, for example, the Power Ball and Mega Millions lottery games played in the United States. Similar national and regional games exist in a great many foreign nations as well.

In the effort to promote the popularity of lottery games and thus improve lottery sales and revenues, the lottery authorities have been looking for ways to expand the reach of on-line lottery games beyond the known types of on-line games. Accordingly, the need exists for new on-line lottery game methods adapted for quick and easy game play for encouraging greater player participation as well as the ability to play when, where, and as desired by the game player rather than waiting for a scheduled draw. Moreover, there is also a need for an on-line lottery game that uses symbols or game indicia in addition to or in lieu of text for offering game play to any game player, regardless the native tongue or language(s) spoken by any such game player.

SUMMARY OF THE INVENTION

A novel wagering game method is disclosed. In a preferred embodiment of the inventive game method in which a game player and a gaming organization are each assigned game indicia. The method includes the steps of identifying or correlating a first game indicia selected by the game player with a first game indicia selected by the gaming organization thereafter, whereupon the player and the gaming organization each then select the remaining game indicia they choose to play. Additionally, the gaming organization's selections are disclosed to the game player during each of its turns, i.e., its indicia selection step. The game player is credited with a match for each of his or her selected indicium that matches the indicium selected by the gaming organization in that turn. The method includes the step of awarding prizes to the game player based on the number of matches between the gaming organization's indicia selections and the game player's indicia selections in the order drawn.

Accordingly, the game method comprises a series of turns in which the player selects an indicium followed by the gaming organization selecting an indicium. The selections are done without replacement. As discussed, the gaming organization s selections are disclosed to the player as they occur. Each turn is recorded as a success or a failure depending on whether or not the player's selection "matches" that of the gaming organizations in some predefined way. The game continues until no more matches are possible, or until the player has exhausted all of their indicia. Prizes are based on the number of matches.

In one embodiment, there is disclosed a wagering game method in which a game player and a gaming organization are each assigned game indicia from a series of game indicia. The method includes receiving sequentially a first plurality of indicia from the game player, generating sequentially a second plurality of indicia for the gaming organization, displaying sequentially the second plurality of indicia to the game player in the order the second plurality of indicia is generated, identifying sequentially a number of matches between the first plurality of indicia and the second plurality of indicia selected during a same turn, and awarding a prize based on the number of matches, wherein an indicia in the second plurality of indicia being generated after an indicia in the first plurality of indicia is received from the game player.

In another embodiment, there is disclosed a system for playing a wagering game method in which a game player and a lottery authority are each assigned game indicia from a series of game indicia. The system includes an input device for receiving player indicia from a player, a game indicia generator for generating lottery indicia according to a predefined possibility, a display device for displaying game indicia to the player, and a controller for determining a number of matches between the player indicia and the lottery indicia. The controller is also capable of awarding a prize to the player according to the number of matches between the player indicia and the lottery indicia, and the player indicia and the lottery indicia being received and generated alternatively.

Other features and advantages of the present invention will become apparent upon reading the specification, when taken in conjunction with the accompanying drawings, to which the invention is directed.

BRIEF DESCRIPTION OF THE DRAWINGS

FIG. 35 is an illustration of a first embodiment of a payout table of the game method FIGS. 36-68 schematically illustrate the manner in which a second embodiment of a game method of this invention may be played.

FIG. 69 is an illustration of a second embodiment of a payout table of the game method.

FIG. 70 is an illustration of a prize table for a third embodiment of the game method of the invention.

FIG. 71 is an illustration of a prize table for cumulative matches of the third embodiment of the game method.

FIG. 72 illustrates the prize table for the bonus round of the third embodiment of the game method.

FIG. 73 is a probability generating function based on the number of matches for a single iteration of the game method FIG. 74 is the product of probability generating functions, which itself comprises a probability generating function for the sum of the matches for different iterations of the game method FIGS.

FIG. 80 is an illustration of a summary video display at the conclusion of game play.

FIGS. 81 and 81A are illustrations of a bonus round of play.

FIG. 82 is an illustration of a summary game totals video display screen at the conclusion of all game play.

DETAILED DESCRIPTION OF THE INVENTION

In the known types of on-line wagering or lottery games offered by gaming organizations, one well known type of wagering game is that a player's entry and the gaming organization's draw each comprise a permutation of indicia. The player is credited with a match if for a given position in the permutation, the player's and the gaming organization's indicia agree. For example, if the player's selection is 1-2-3 and the gaming organizations selection is 1-4-3, this would comprise two matches as the numbers in the 1st and 3'd positions are the same. Prizes are based on the number of matches. In such games, the player's complete entry is submitted prior to the gaming organization conducting the draw for the game.

In the present invention, a game player, for example a lottery game player or a wagering game player at a casino or other similar gaming establishment, is positioned at a graphical user interface, for example that of a computer or a computerized and/or networked gaming machine having a two-way communications link to the gaming organization's computing system. Examples of this graphical user interface may include playing the game through the internet or at a player-activated terminal within a gaming establishment or other authorized gaming facility. The player pays for entry into the game, such as by a credit/debit card, debiting an account, Pay Pal®, or through a payment device, for example submitting cash through a coin/bill collector after which the player and the gaming organization are each assigned game indicia.

The game comprises a series of turns in which the player selects an indicium followed by the gaming organization selecting an indicium. The selections are done without replacement. The gaming organization's selections are disclosed to the player as they occur. Each turn is recorded as a success or a failure depending on whether or not the player's selection "matches" that of the gaming organization's in some predefined way. The game continues until no more matches are possible (or, less efficiently, until the player has exhausted all of his indicia). Prizes are based on the number of matches.

Example 1

Figure 1:
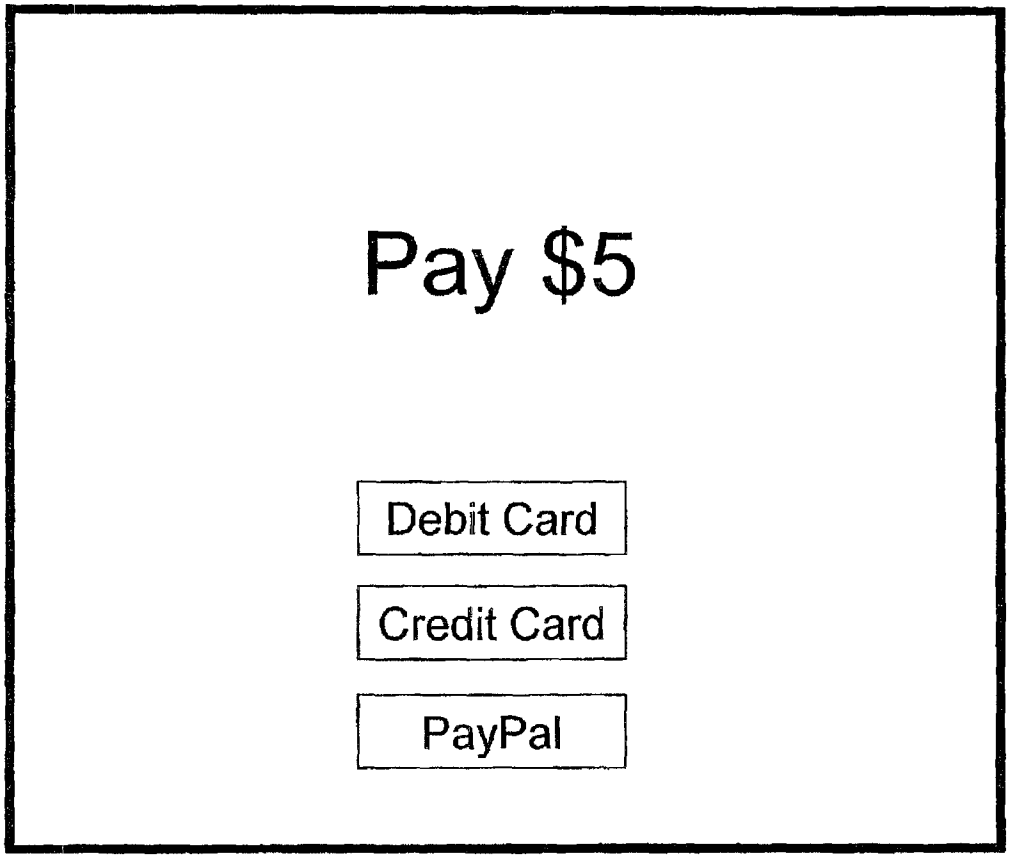
FIGS. 1-34 schematically illustrate the manner in which a first embodiment of the game method of this invention may be played.
Figure 2:
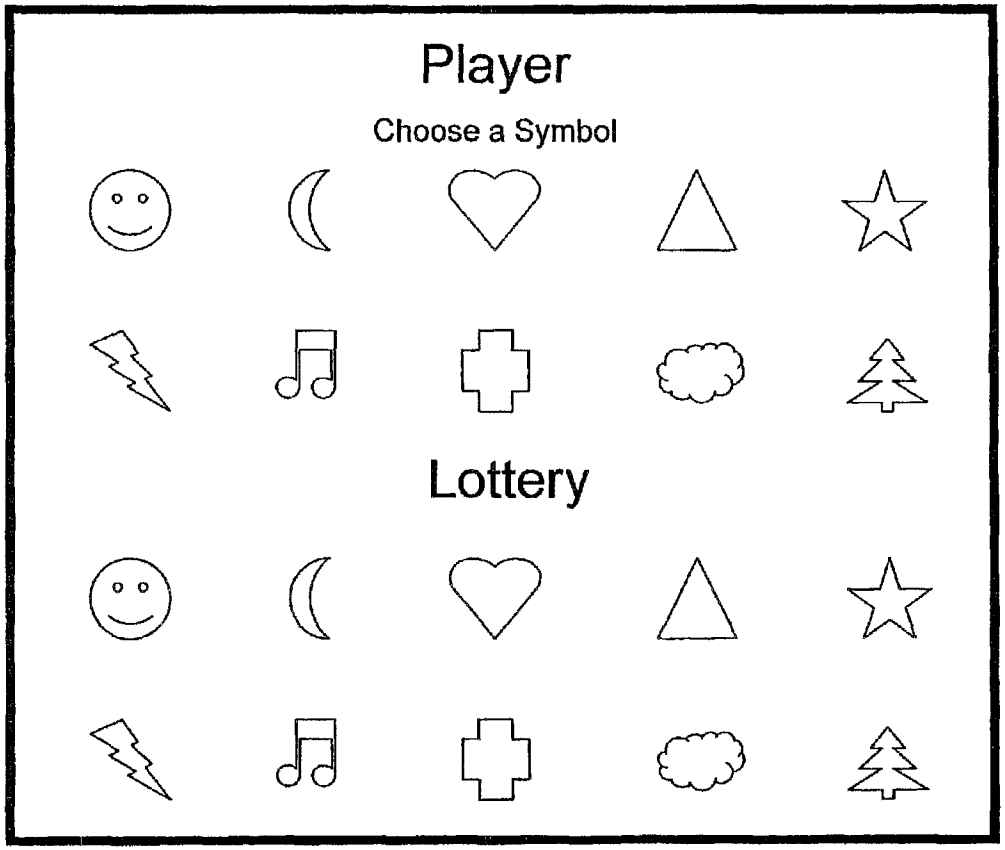
Figure 3:
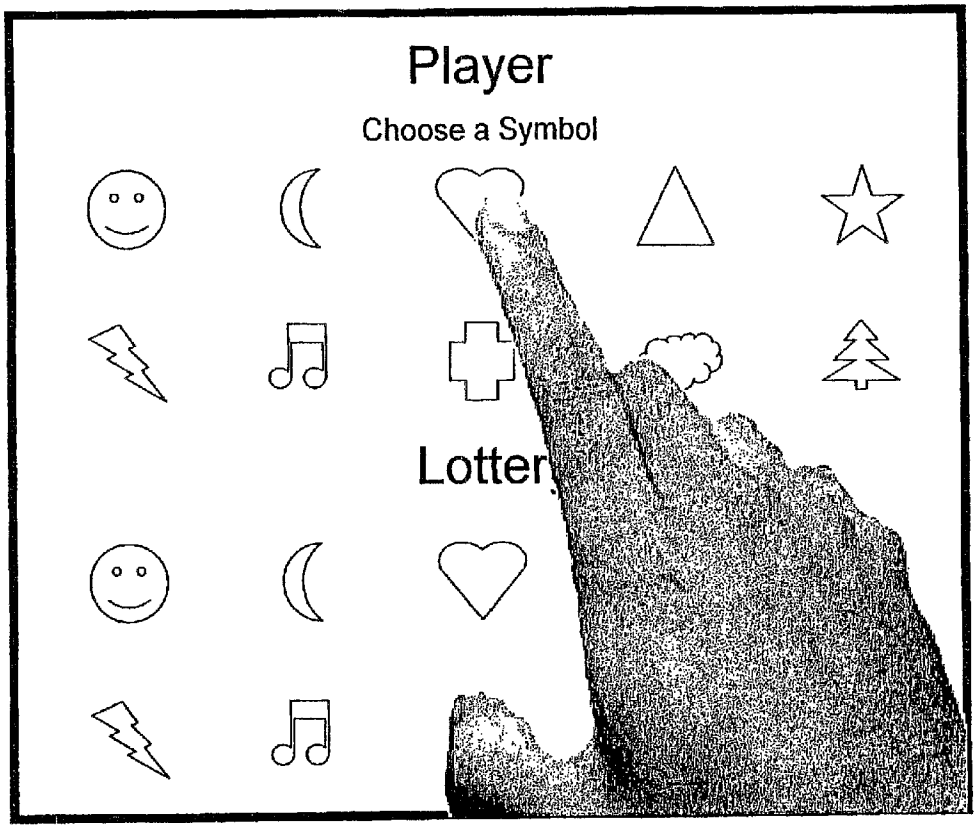
Figure 4:
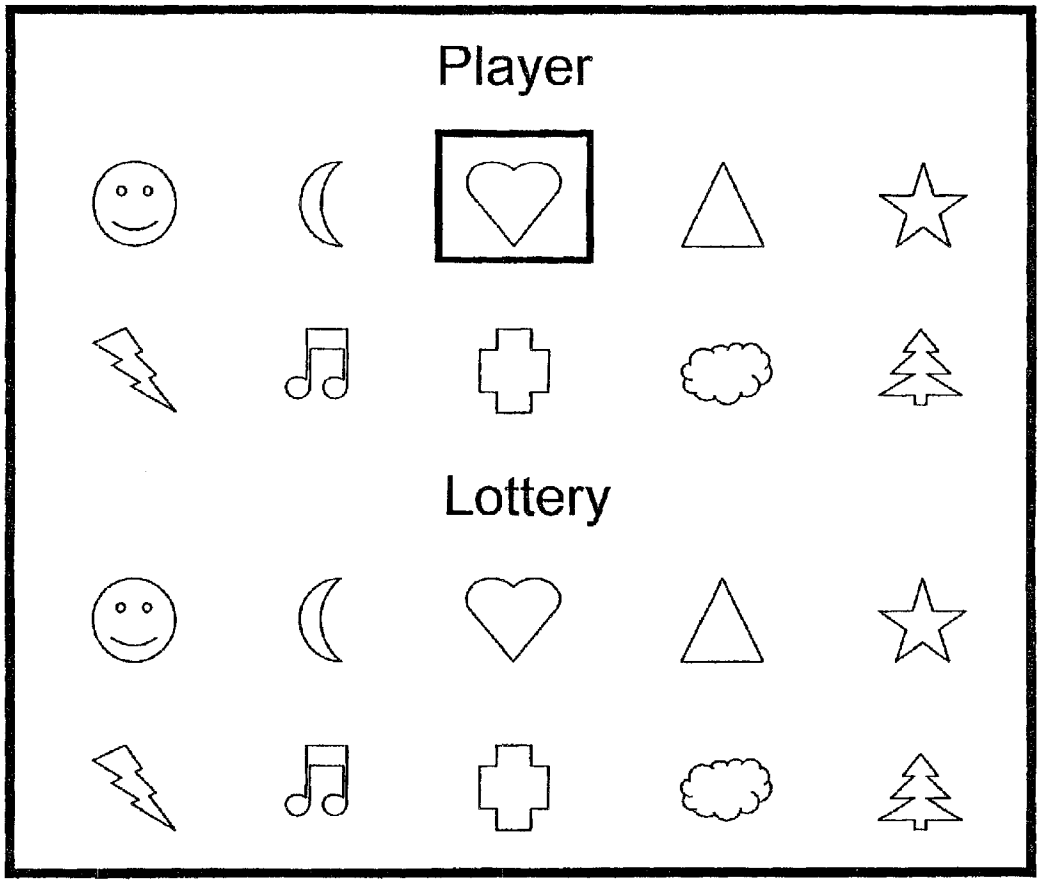

Referring now to the drawings, in which like reference characters indicate like parts throughout the several views, in a first embodiment of the invention a game player is positioned in front of a touch-sensitive graphical user interface. Alternatively, and if so desired, the game player could use a mouse to play the game, instead of or in addition to providing the player with a touch screen. As shown in FIG. 1, the player is prompted to pay $5 in order to play the game. Once payment for the game has been arranged, the game begins. As shown in FIG. 2, the player is assigned ten symbols labeled "Player." In this example the symbols comprise a happy face, a crescent moon, a heart, a triangle, a star, a lightning bolt, musical notes, a plus sign, a cloud and a tree, although any style or design of game indicia may be used with the game method. The gaming organization/operator is also assigned an identical set of symbols, labeled "Lottery" in this example, although the indicia may otherwise be labeled as desired. The player is then prompted to select a symbol and selects the heart as indicated in FIG. 3. His selection is indicated as in FIG. 4, outlined by a box or shadow box.

Figure 5:
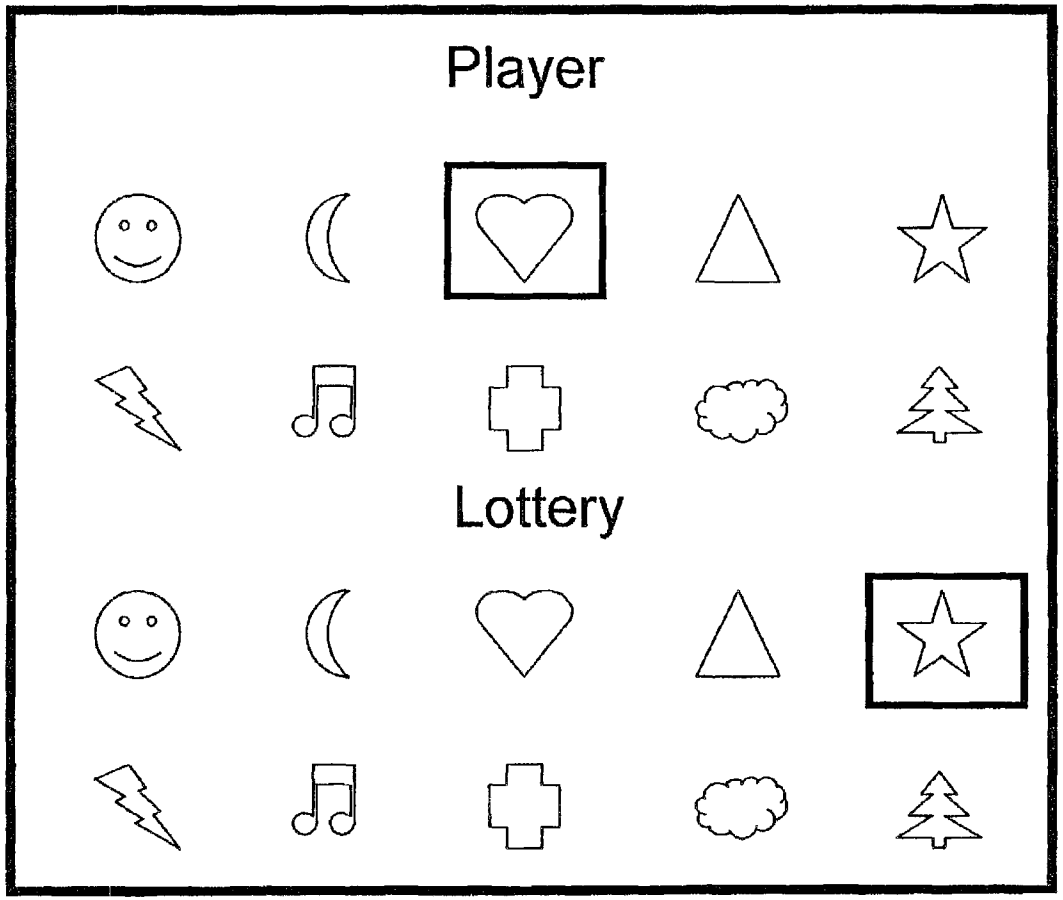
Figure 6:
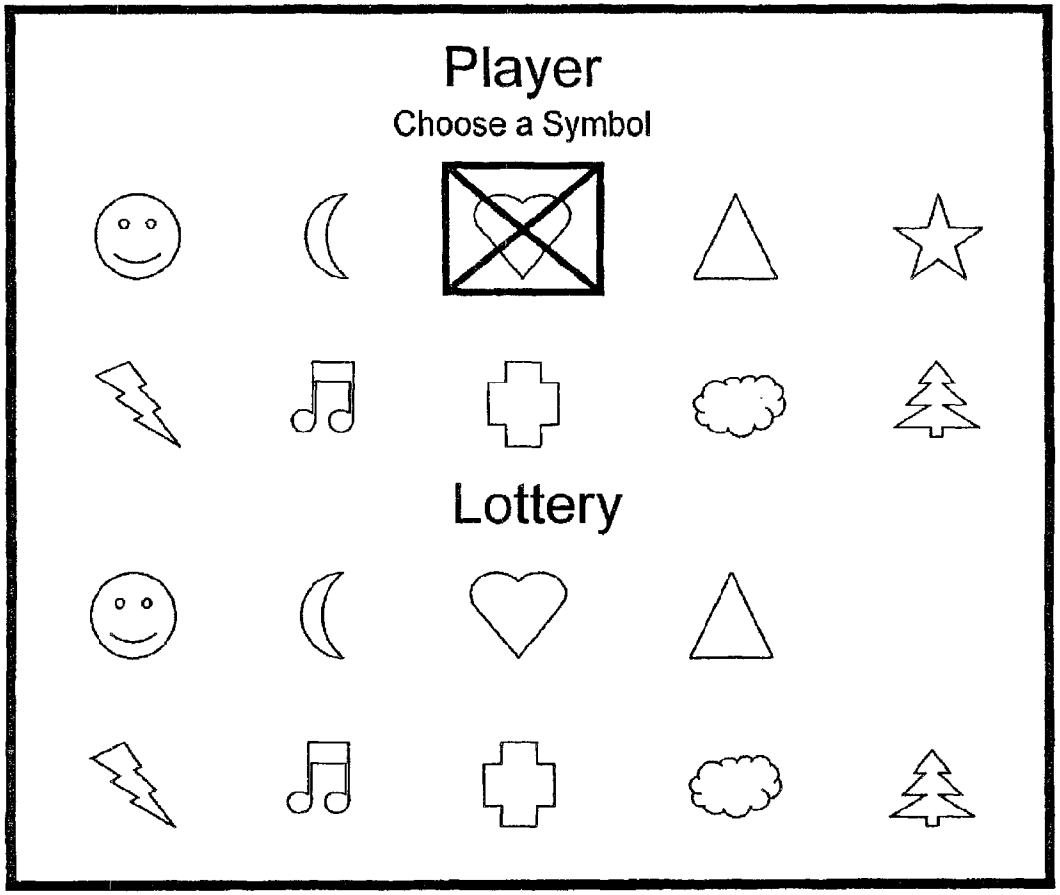
Figure 7:
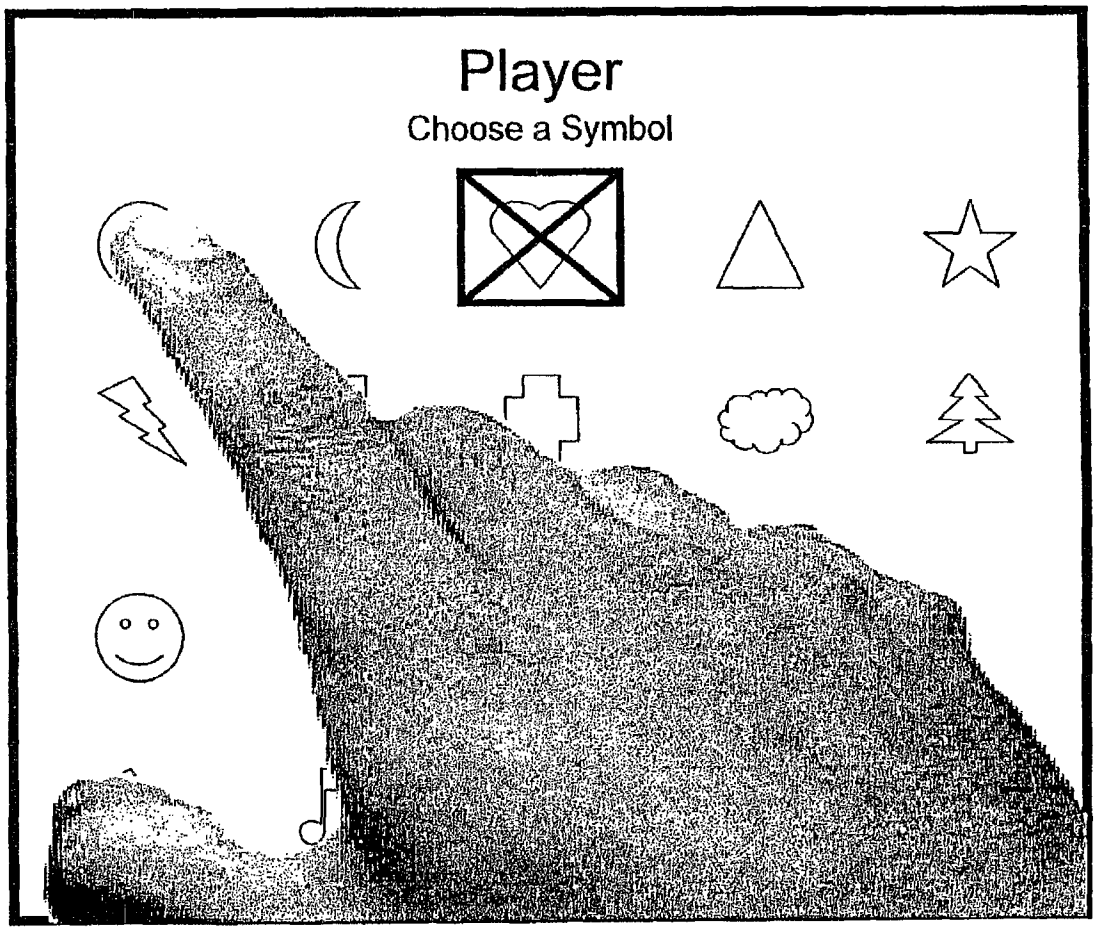
Figure 8:
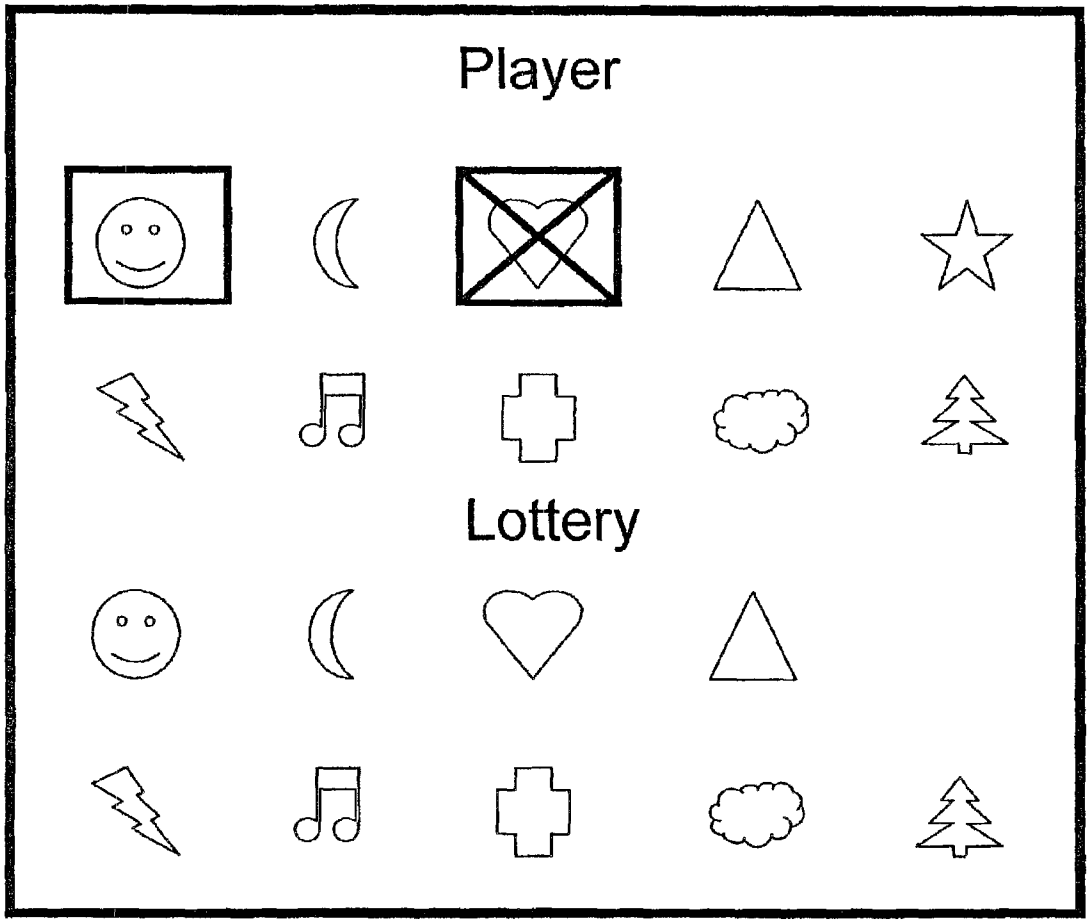
Figure 9:
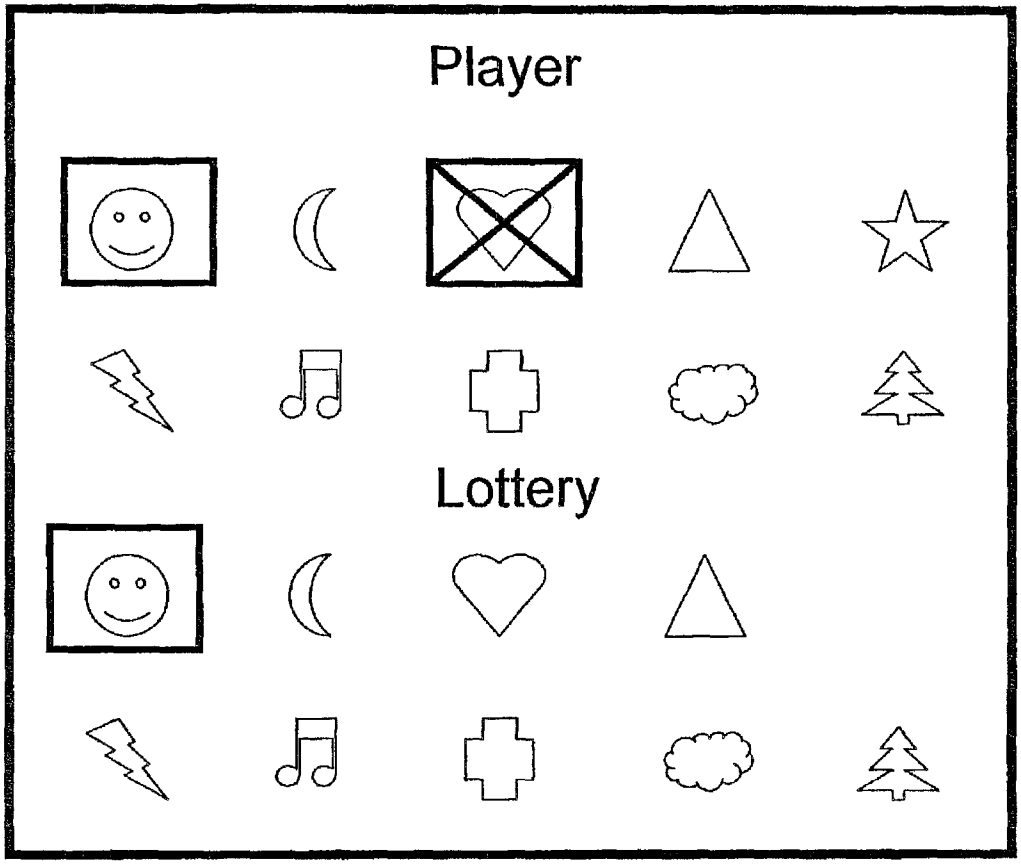
Figure 10:
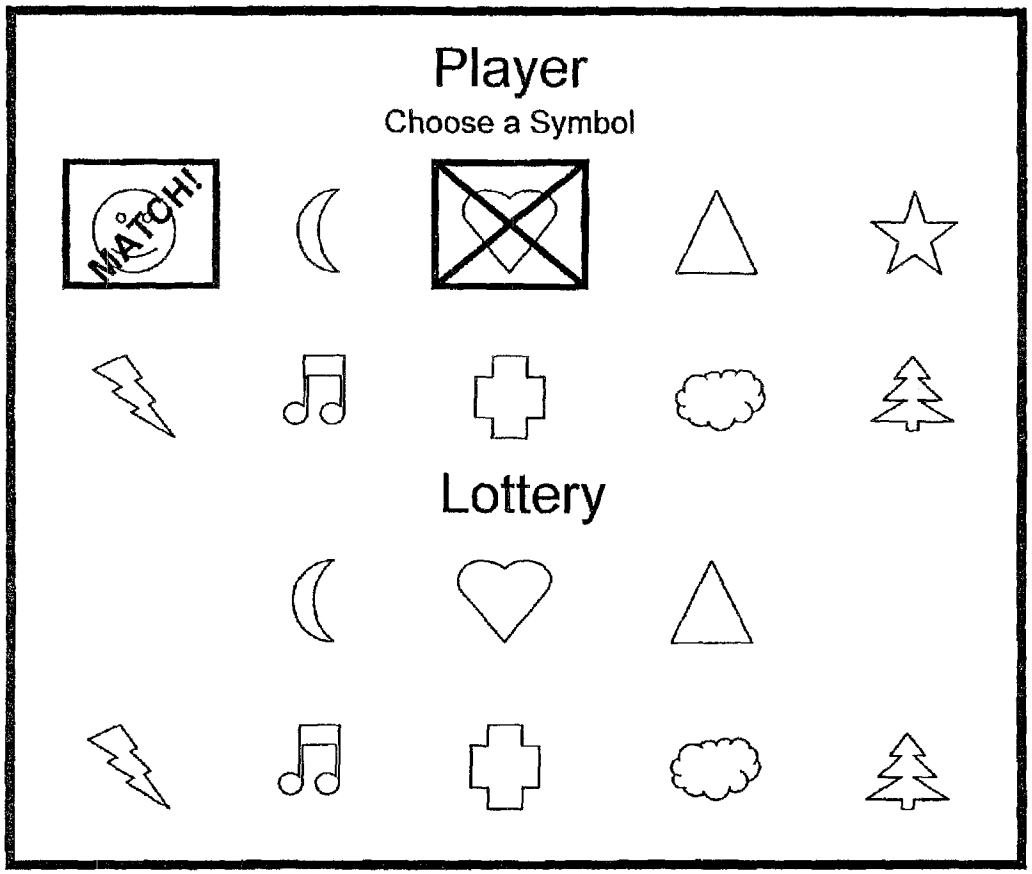
Figure 11:
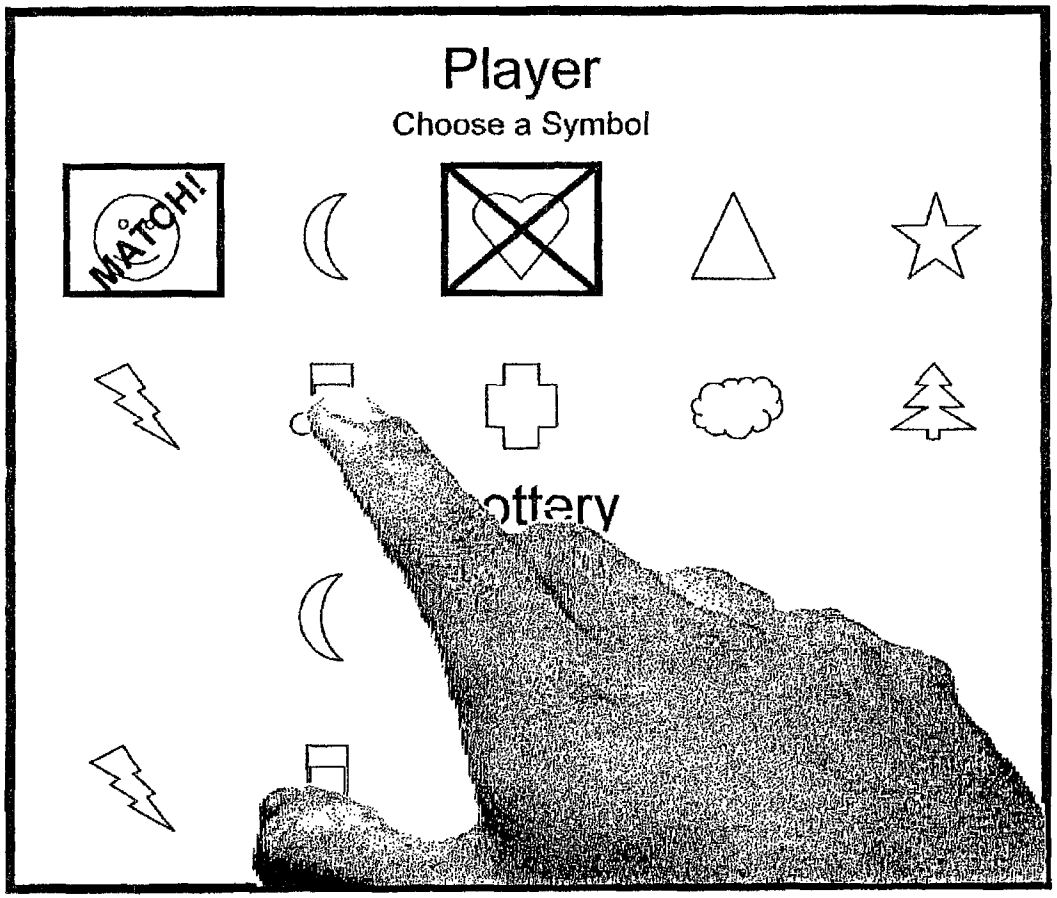
Figure 12:
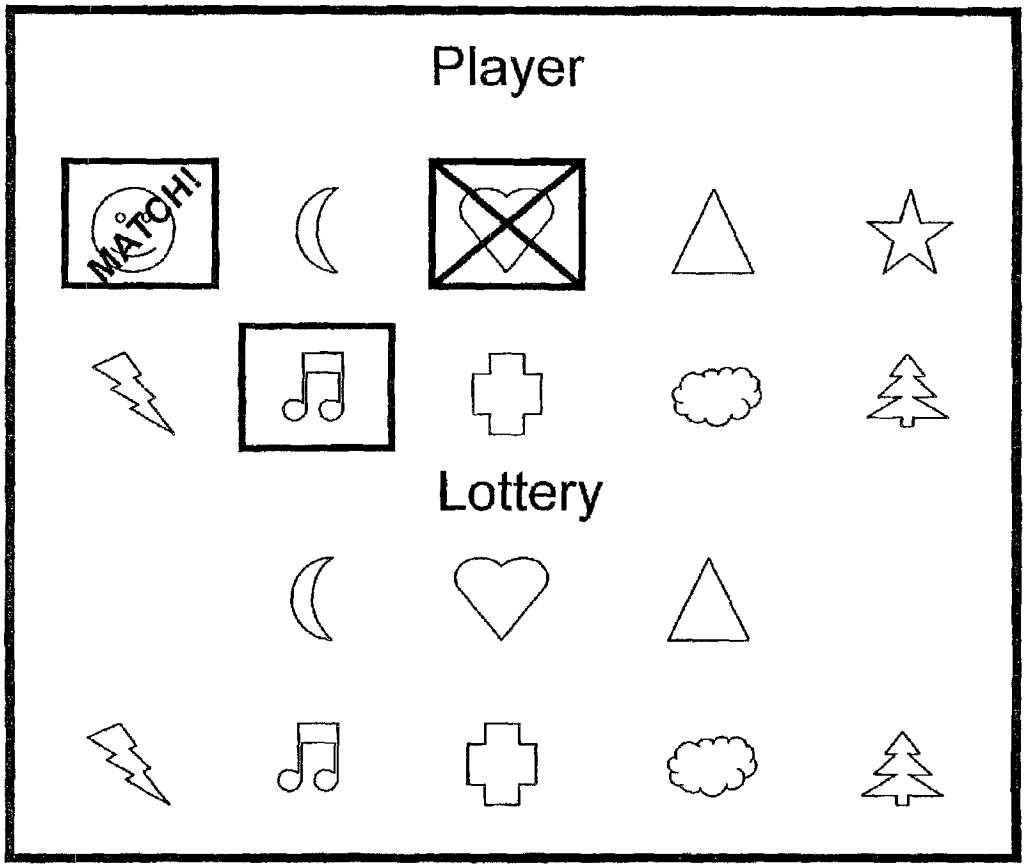
Figure 13:
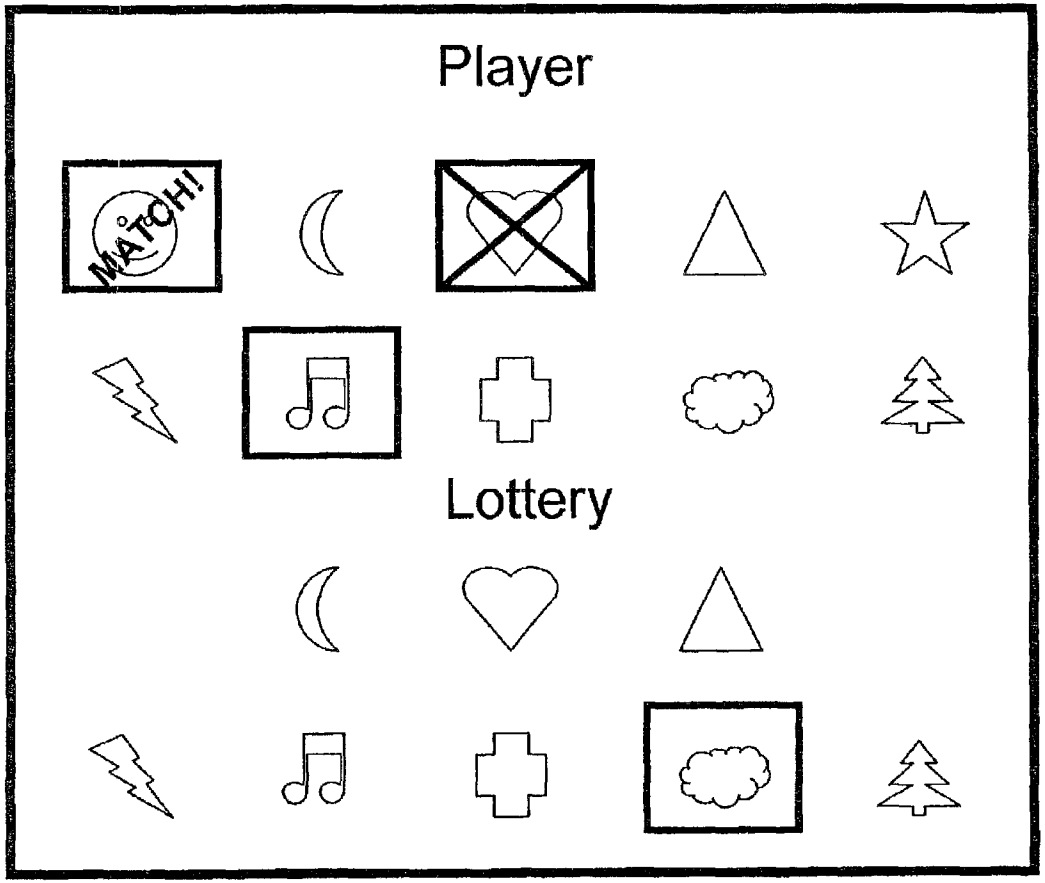

Then the gaming organization makes a selection as shown in FIG. 5. The star has been selected by the gaming organization and is also outlined by a box. The gaming organizations selection is random and not dependent of the player's selection. As the player's selection (heart) and the gaming organization's selection (star) do not match, the player's selection is recorded as a non-match (FIG. 6), and an "X" is superimposed over the heart to indicate that it did not match. Notice in FIG. 6 that the star, having been selected, has been removed from the gaming organization's indicia as the draw is without replacement. Similarly, once the player has selected an object it cannot be selected again. In this case, heart cannot be selected again. The player is prompted to select another symbol from his remaining nine symbols, as shown in FIG. 6, and in FIG. 7 the player selects the happy face. In FIG. 8, the happy face is indicated as the player's selection (outlined by a box). In FIG. 9, the gaming organization randomly selects a symbol from its remaining nine symbols. In this case, a happy face is selected (outlined by a box). As both the player and gaming organization selected a happy face, the player's selection is recorded as a match by superimposing the word "match" over the player's happy face, shown in FIG. 10. The player is then prompted to select another symbol from the remaining eight symbols (FIG. 10), and selects the musical notes (FIG. 11), whereupon in FIG. 12 the musical notes are indicated as his selection and are outlined by a box. In FIG. 13, the gaming organization randomly selects a symbol from its remaining eight symbols. The gaming organization has selected the cloud as its symbol. As the player's selection (musical notes) and the gaming organization's selection (cloud) do not match, the player's selection is recorded as a non-match by superimposing an "X" over the player's musical notes (FIG. 14).

Figure 14:
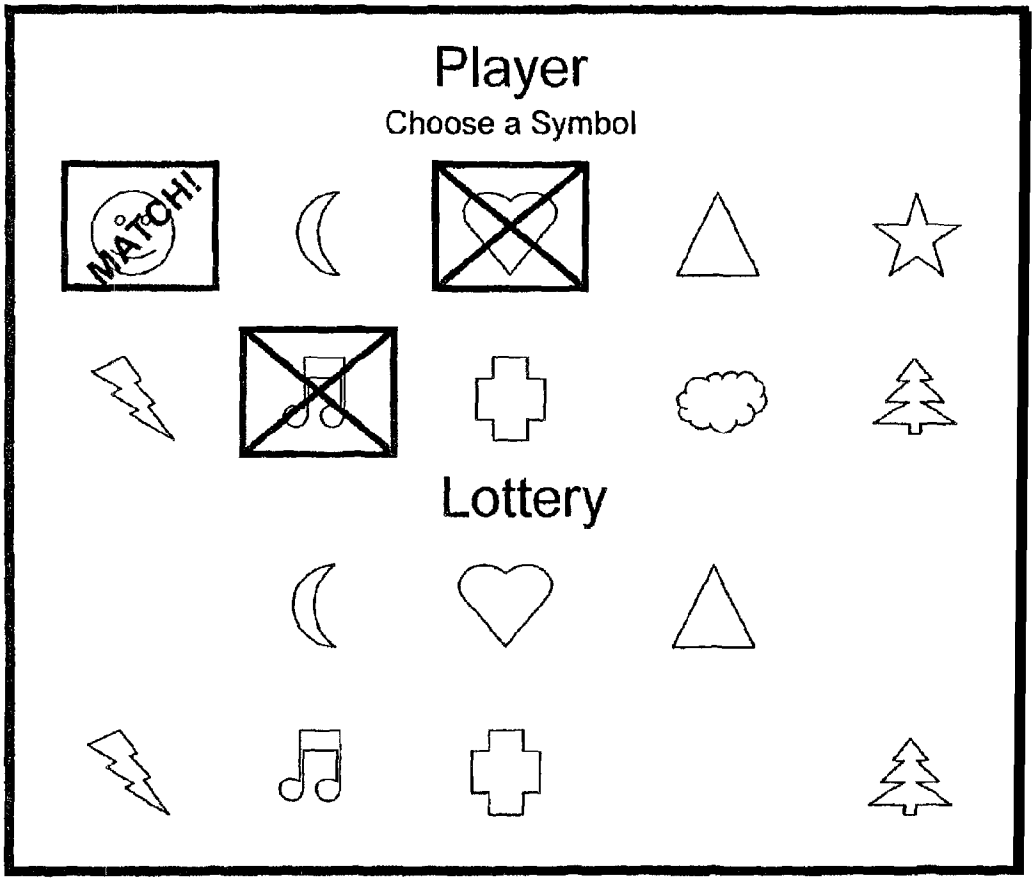
Figure 15:
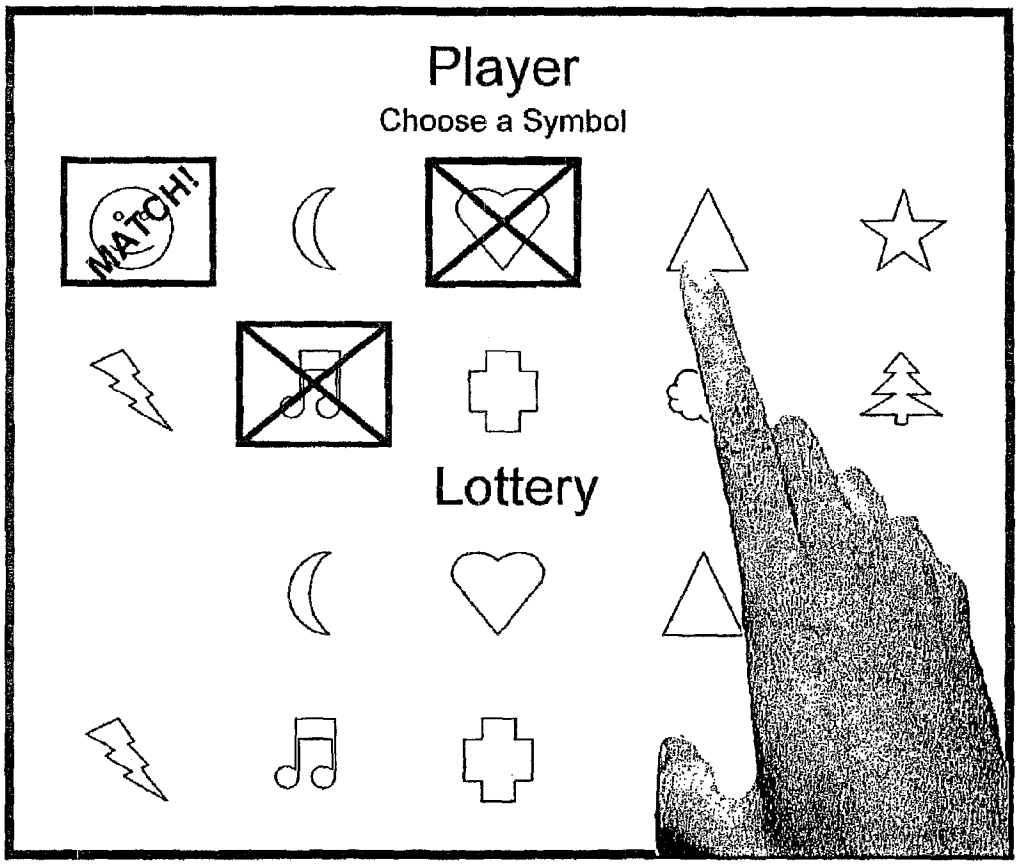
Figure 16:
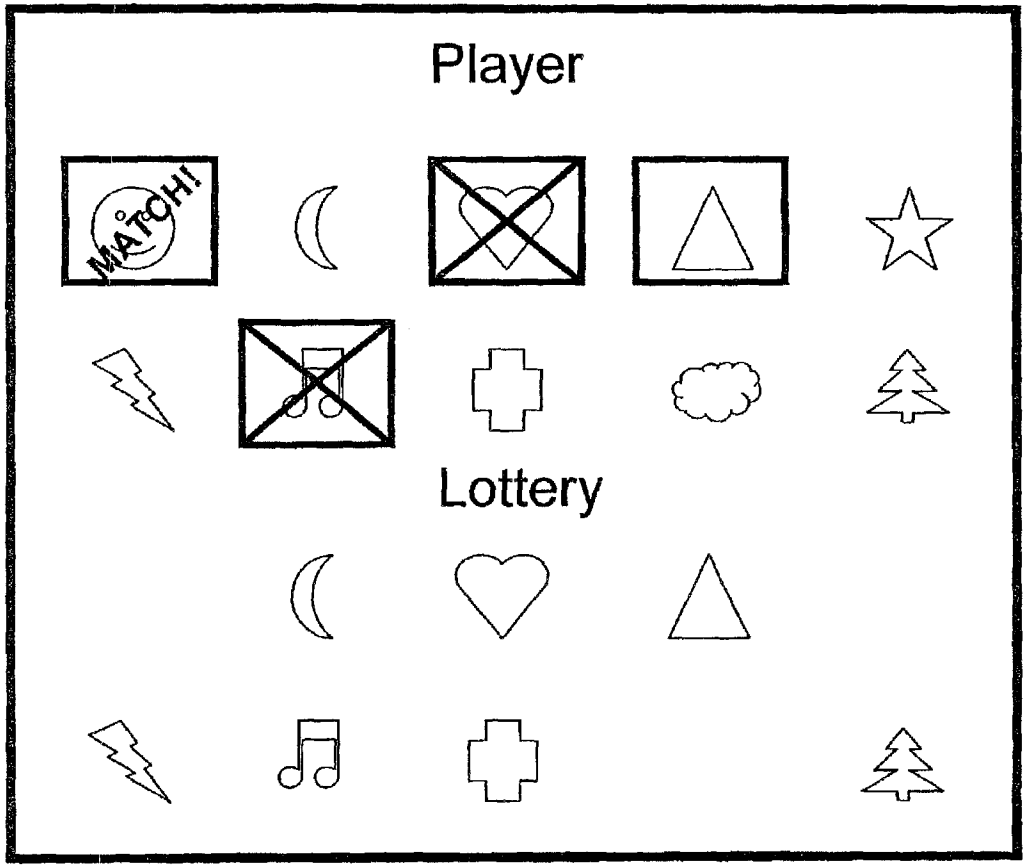
Figure 17:
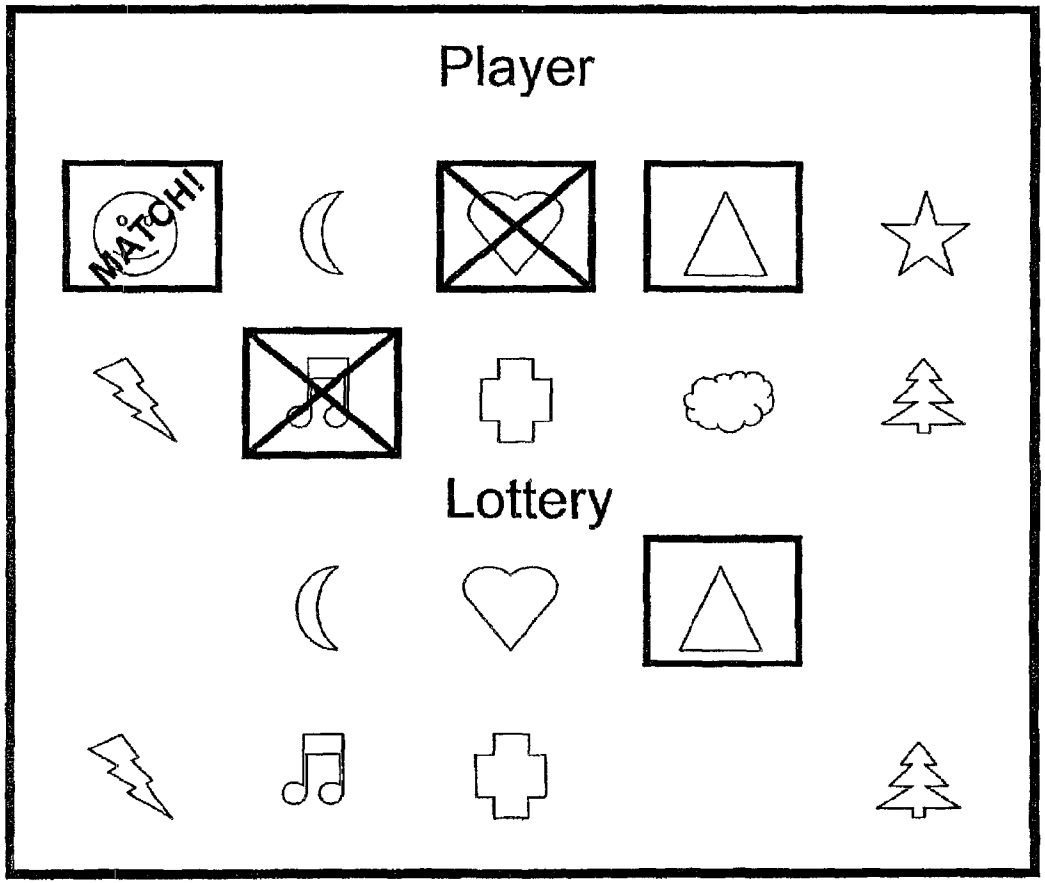
Figure 18:
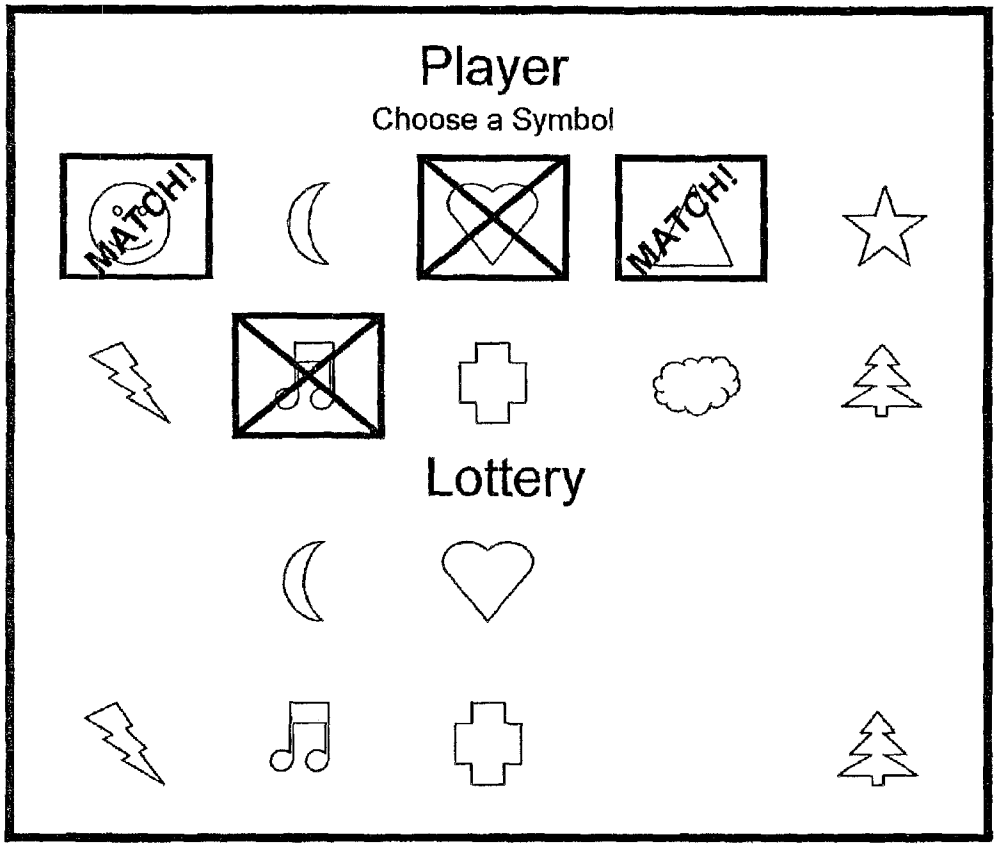

The player is prompted to select another symbol, as shown in FIG. 14. He selects the triangle (FIG. 15). In FIG. 16, the triangle is indicated as his selection (outlined by a box). In FIG. 17, the gaming organization randomly selects a symbol from its remaining seven symbols. The gaming organization has also selected the triangle. As both the player and gaming organization have selected a triangle, the player's selection is recorded as a match by superimposing the word "match" over the player's triangle, as illustrated in FIG. 18.

Figure 19:
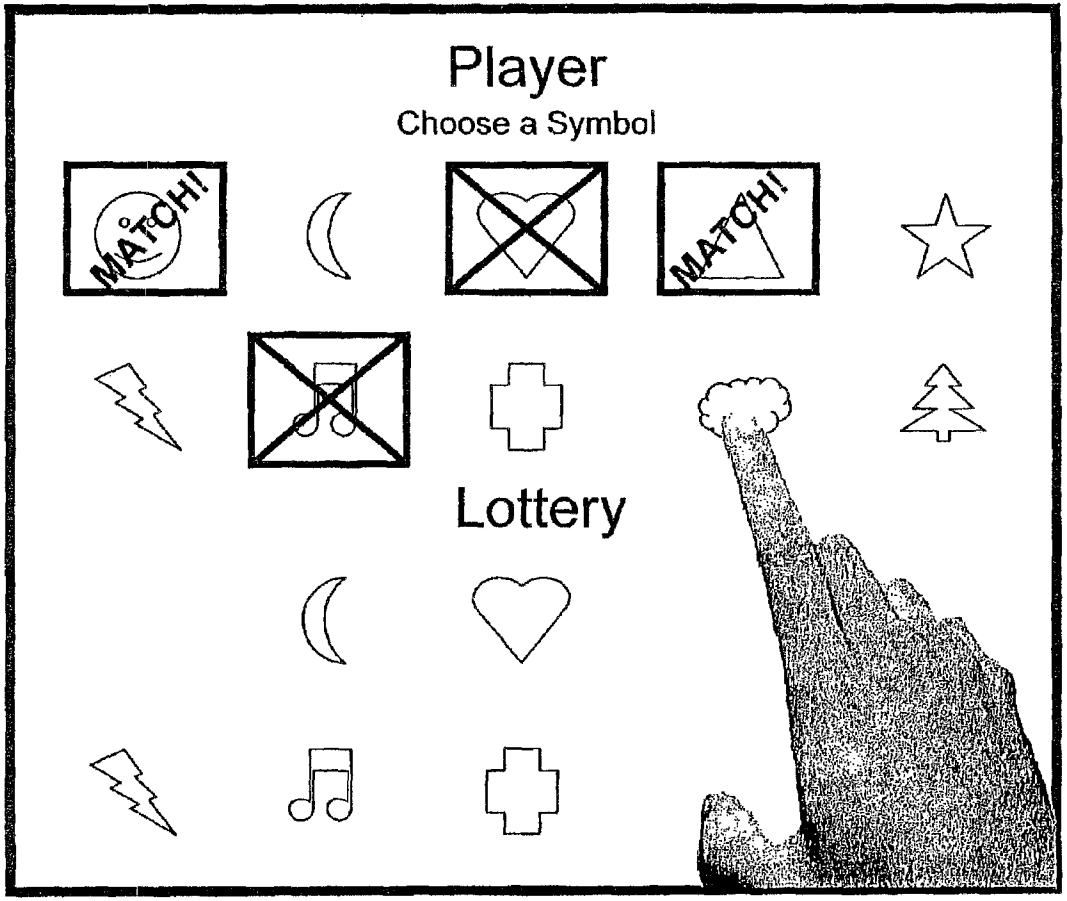
Figure 20:
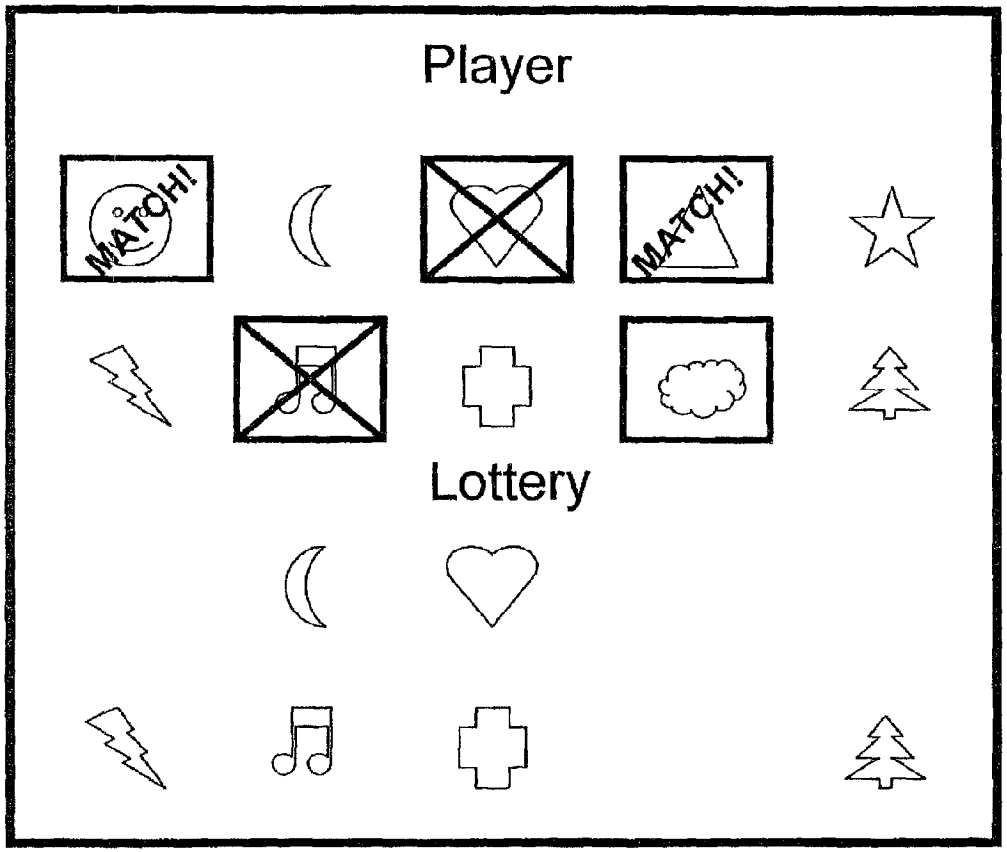
Figure 21:
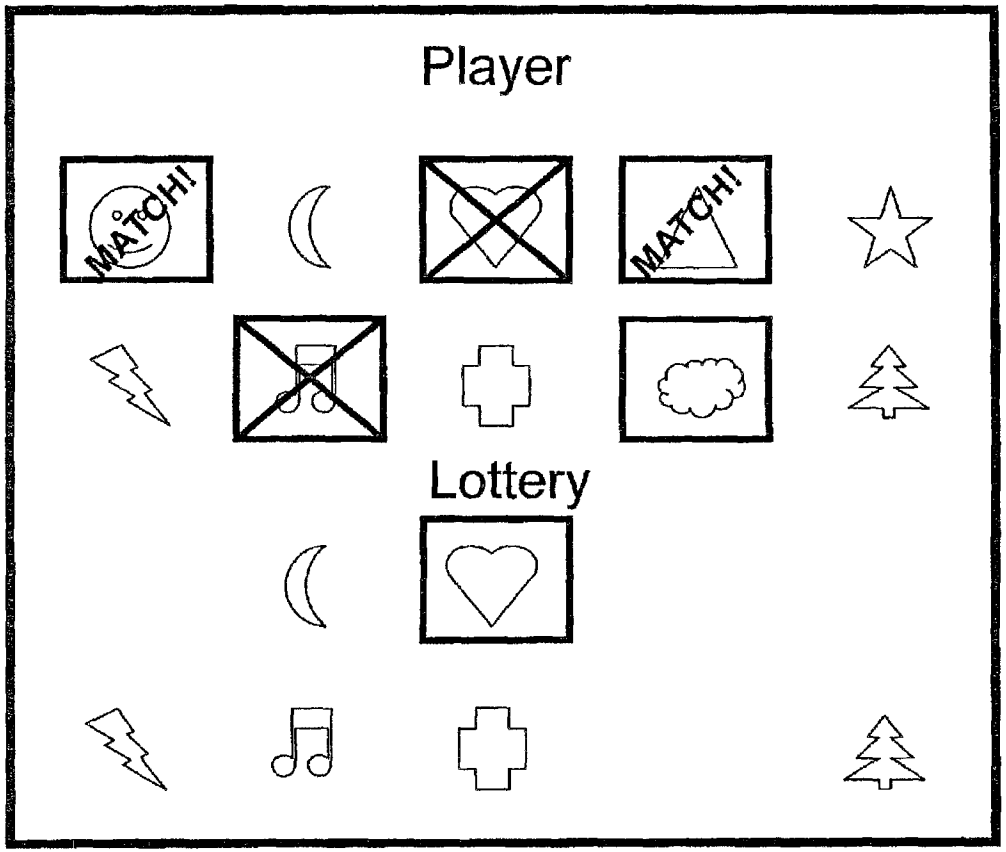

The player is prompted to select another symbol (FIG. 18), and selects a cloud (FIG. 19). Notice that the player knows in advance that the cloud cannot match the gaming organization's selection as the gaming organization selected the cloud in an earlier turn. Accordingly, in FIG. 20, the cloud is indicated as the player's selection (outlined by a box). In FIG. 21, the gaming organization randomly selects a symbol from its remaining six symbols. The gaming organization has selected the heart. As the player's selection (cloud) and the gaming organization's selection (heart) do not match, the player's selection is recorded as a non-match by superimposing an "X" over the player's cloud (FIG. 22).

Figure 22:
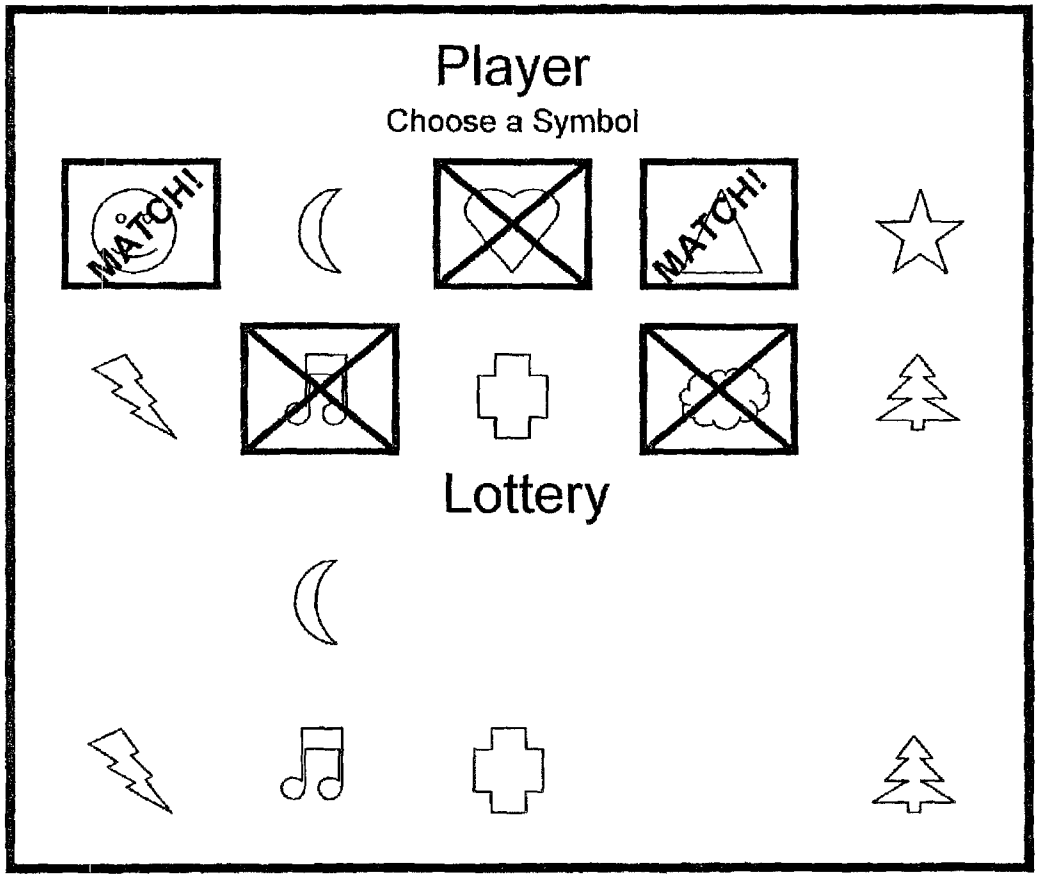
Figure 23:
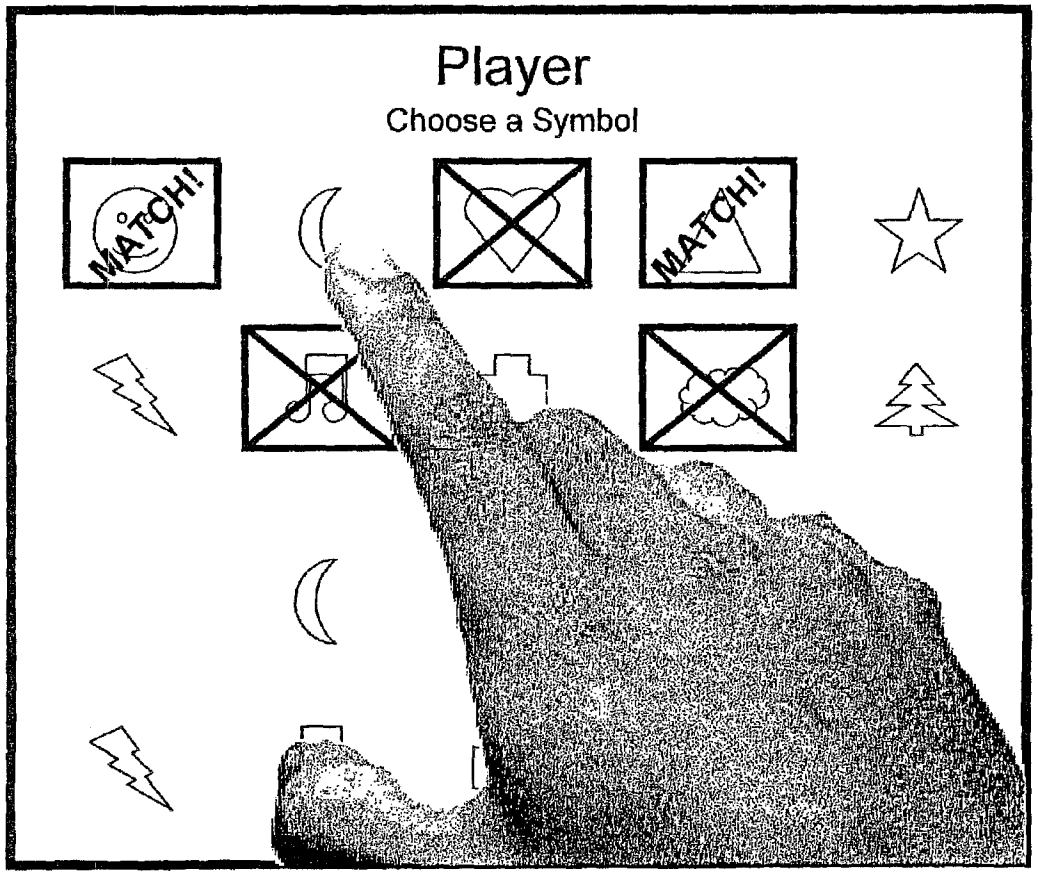
Figure 24:
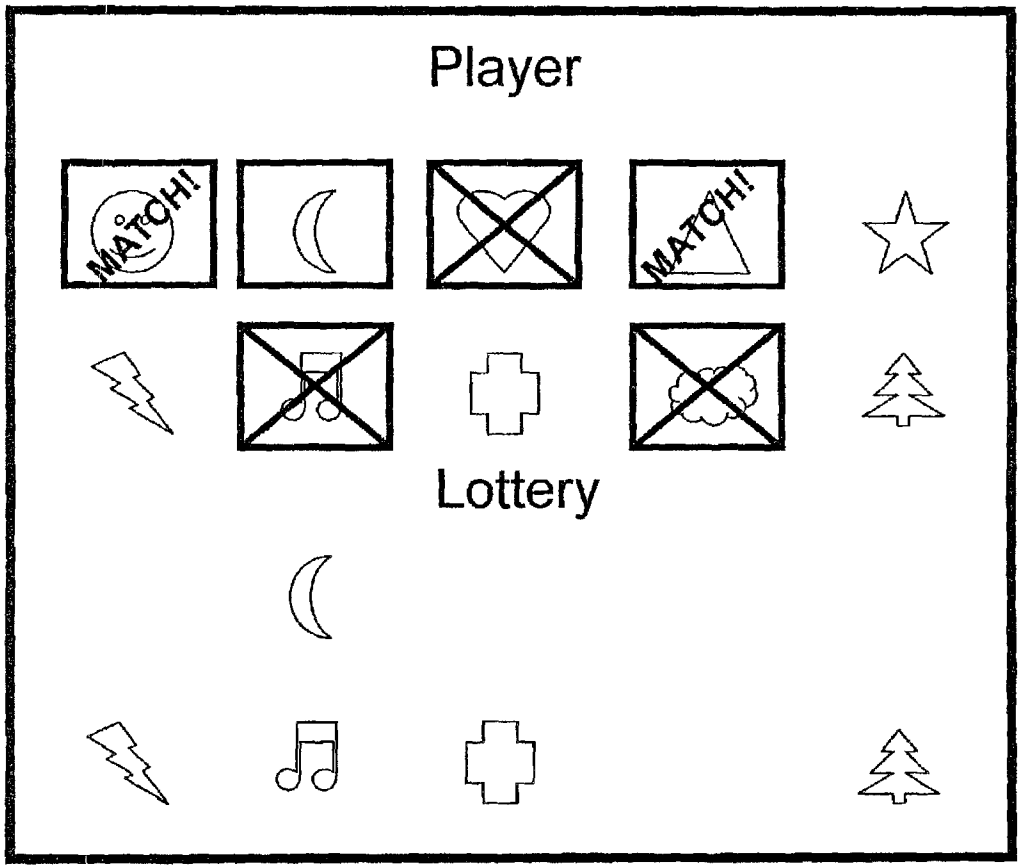
Figure 25:
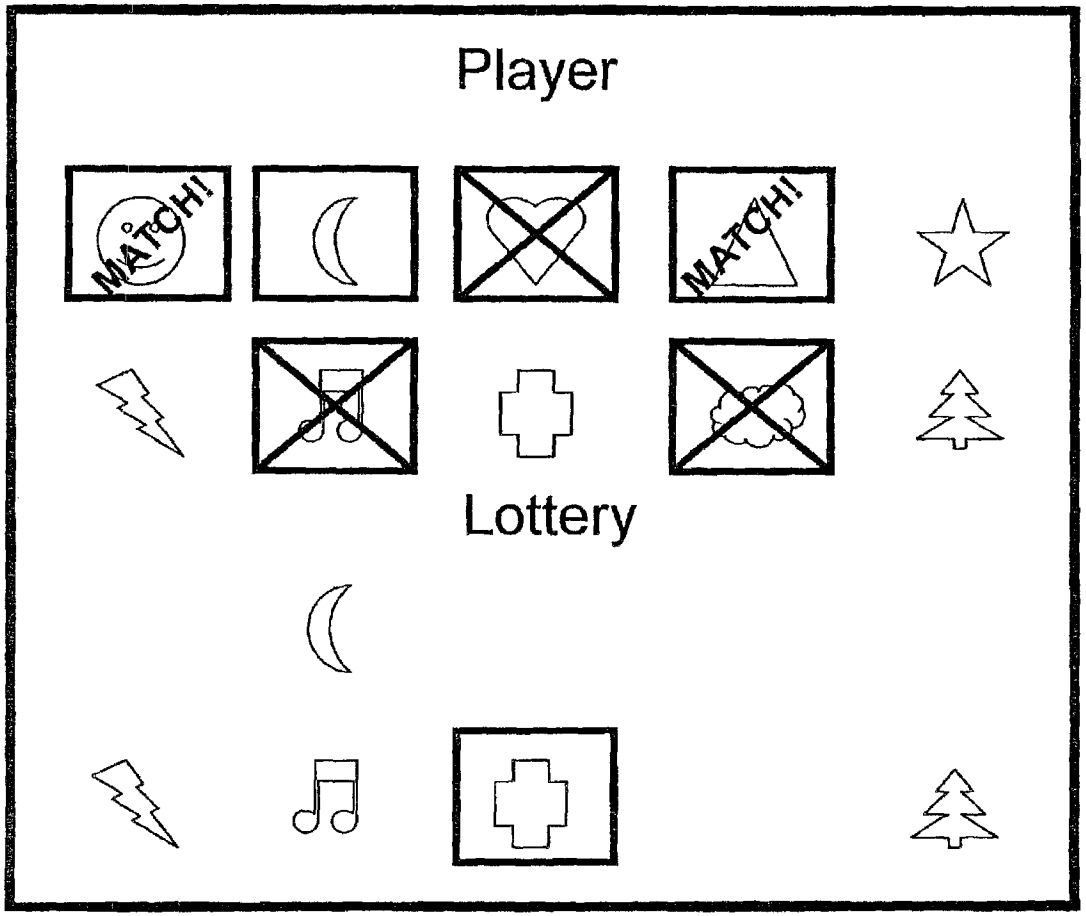

The player is prompted to select another symbol (FIG. 22). He selects the crescent moon (FIG. 23). In FIG. 24, the player's crescent moon is indicated as his selection (outlined by a box). In FIG. 25, the gaming organization randomly selects a symbol from its remaining five symbols. The gaming organization has selected the "plus" sign or symbol. As the player's selection (crescent moon) and the gaming organization's selection (plus sign) do not match, the player's selection is recorded as a non-match by superimposing an "X" over the player's crescent moon (FIG. 26).

Figure 26:
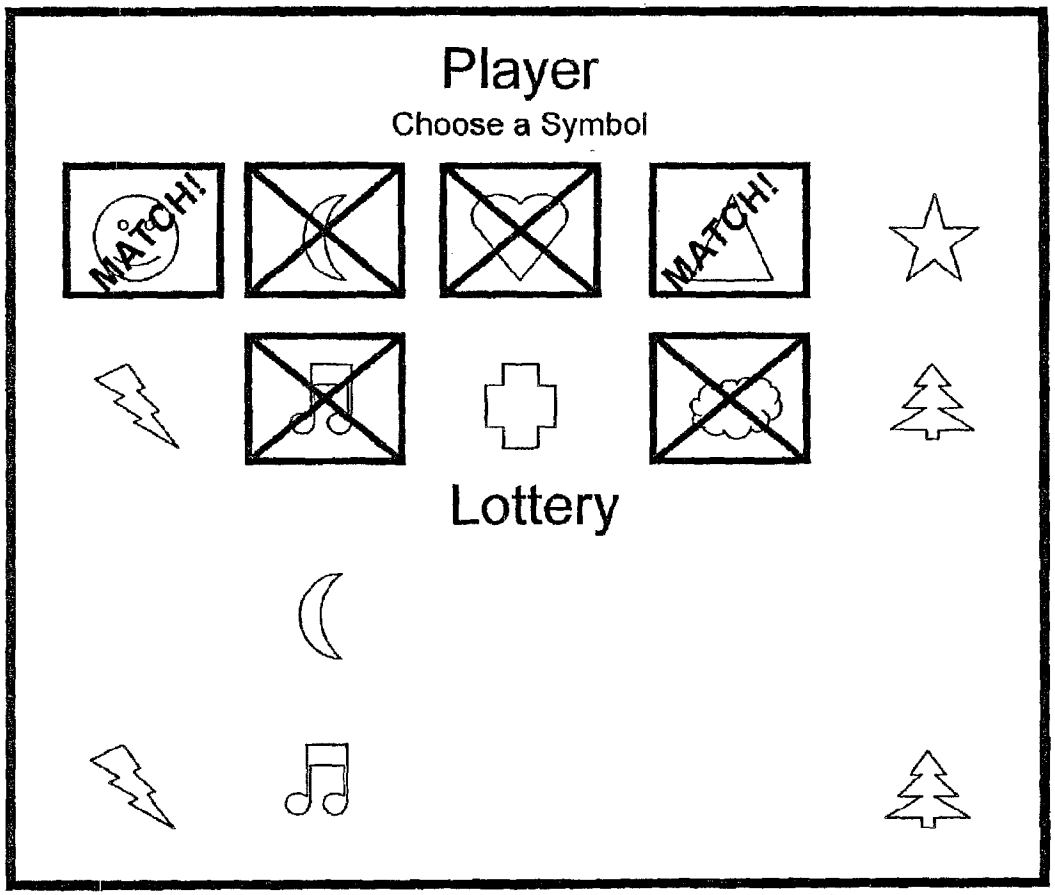
Figure 27:
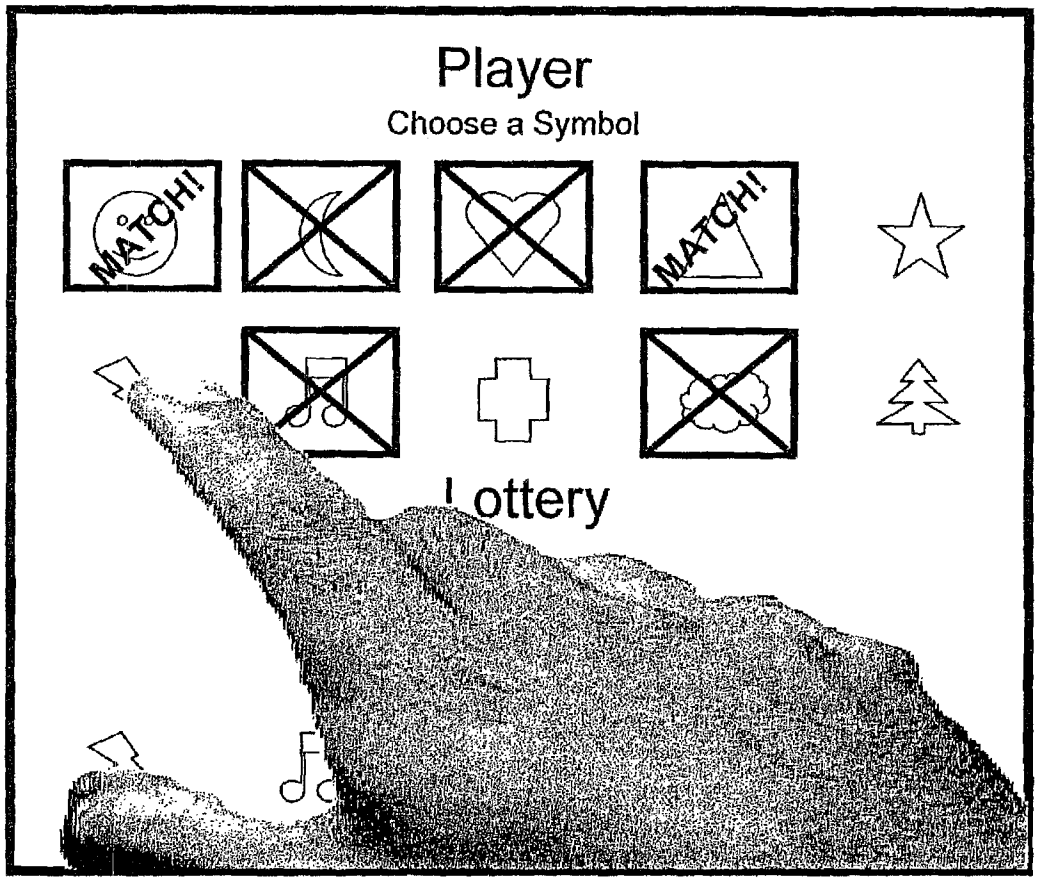
Figure 28:
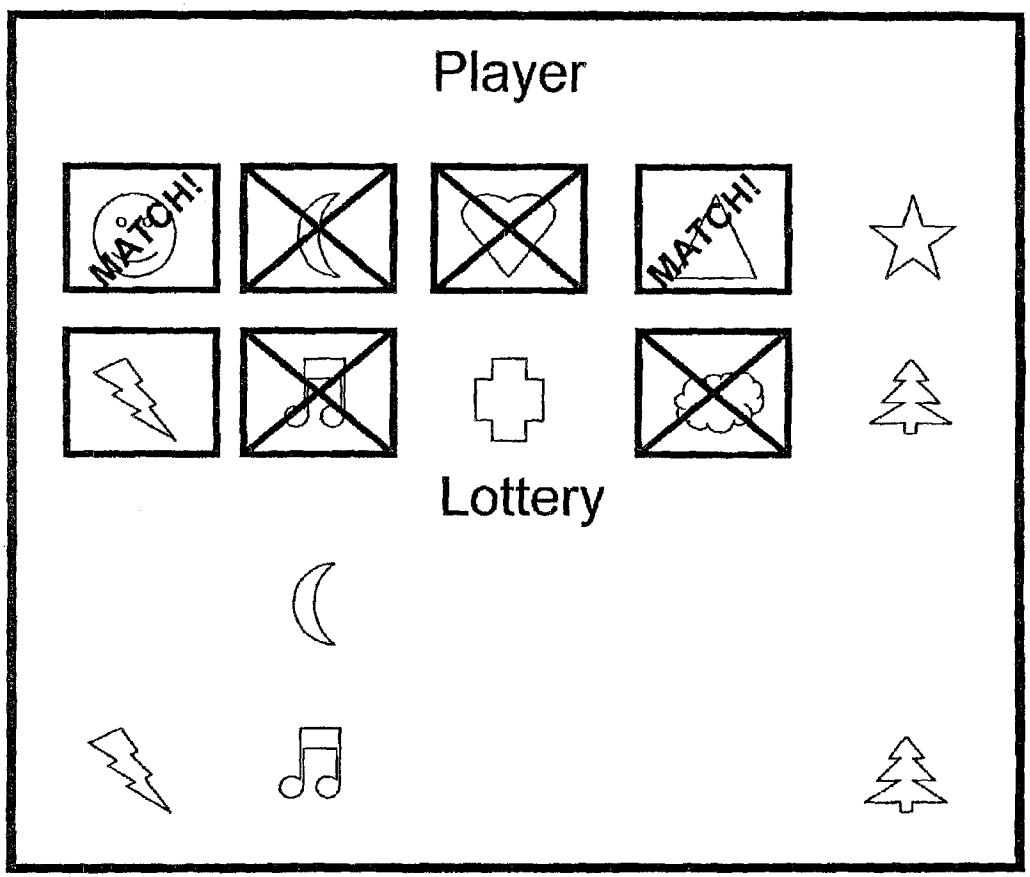
Figure 29:
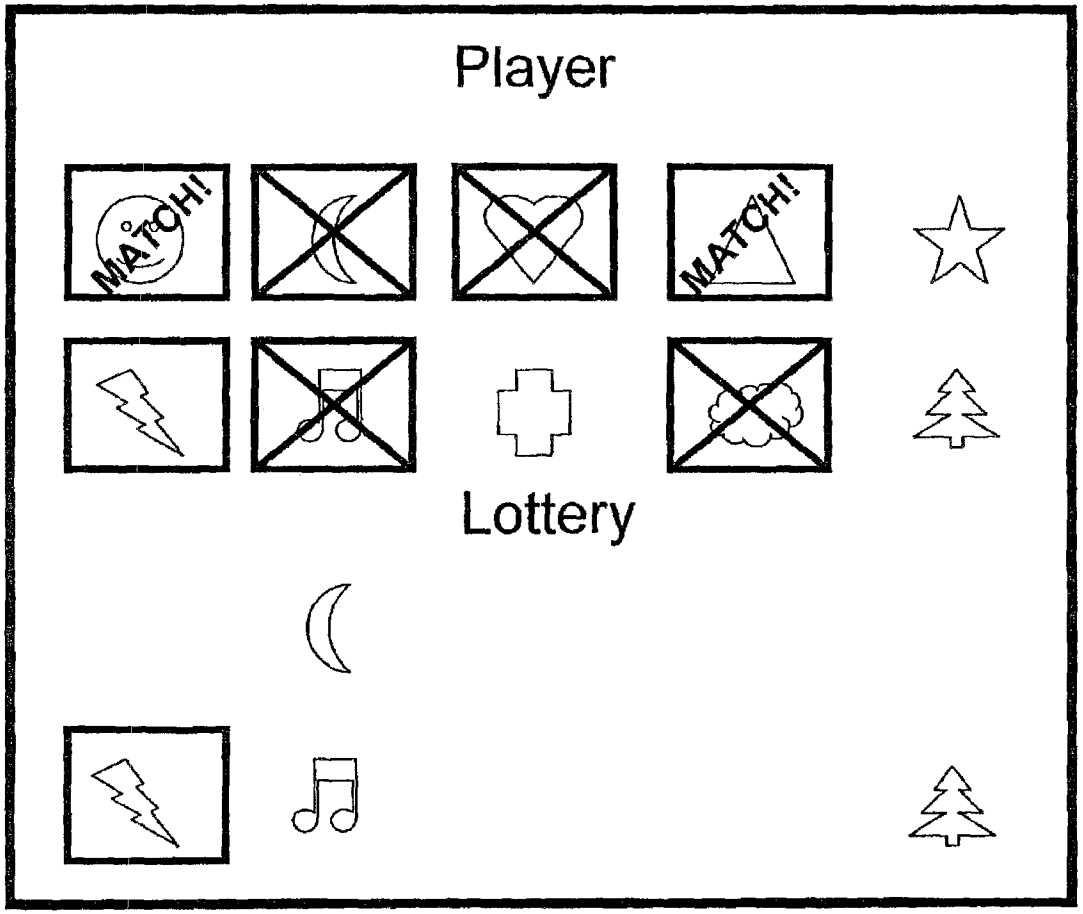

The player is prompted to select another game symbol in FIG. 26, and selects the lightning bolt (FIG. 27). The lightning bolt is indicated as his selection (outlined by a box) n FIG. 28. In FIG. 29, the gaming organization randomly selects a symbol from its remaining four symbols, and has selected the lightning bolt. As both the player and gaming organization have selected the lightning bolt, the player's selection is recorded as a match by superimposing the word "match" over the player's lightning bolt, as in FIG. 30.

Figure 30:
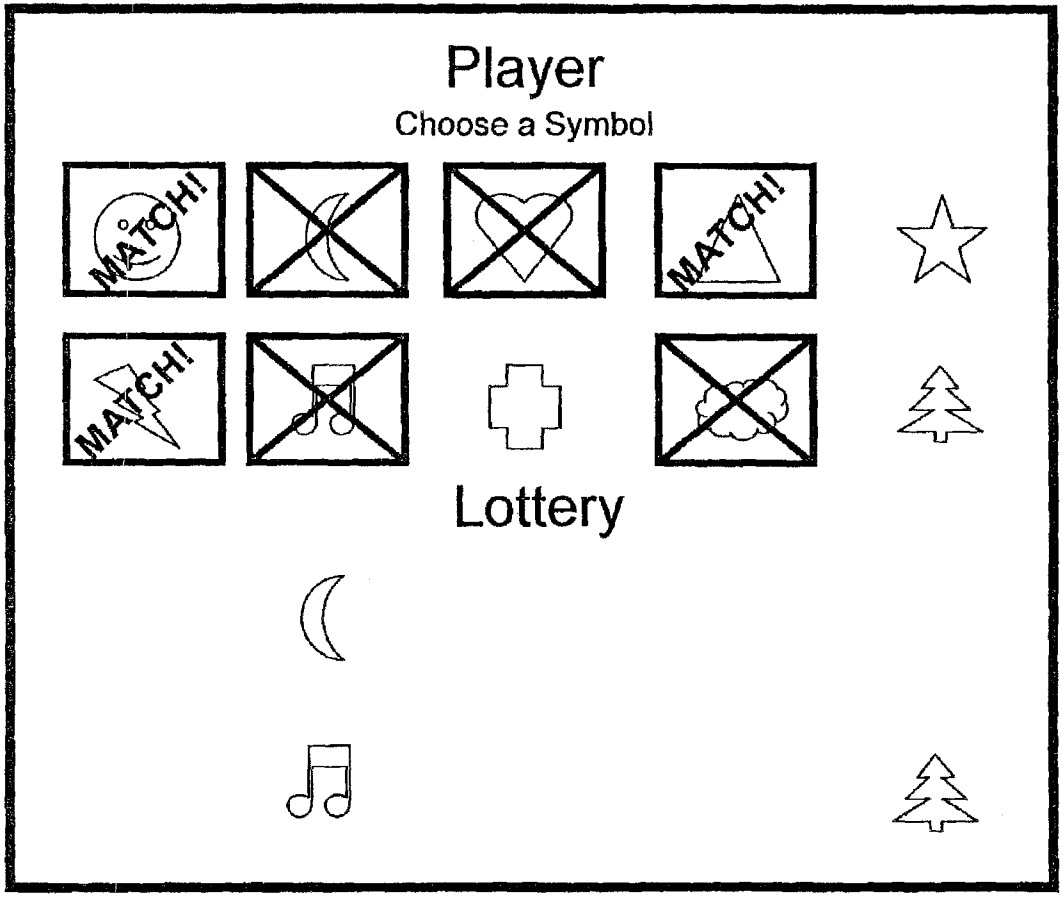
Figure 31:
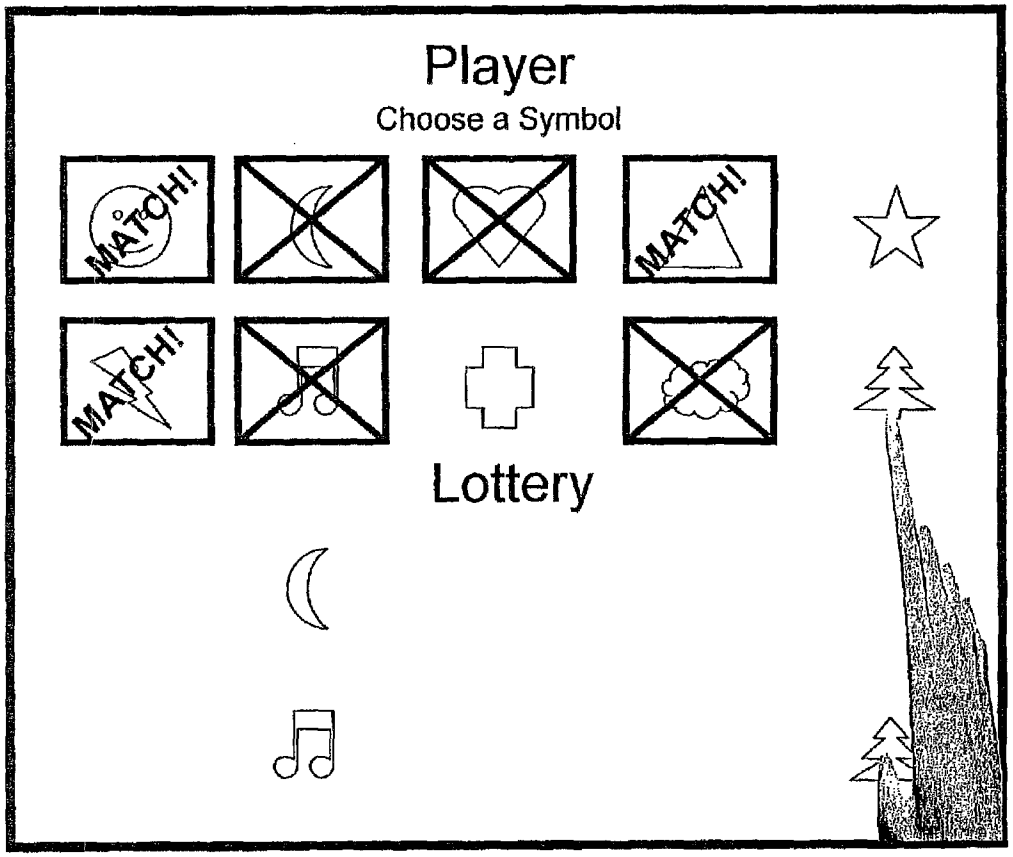
Figure 32:
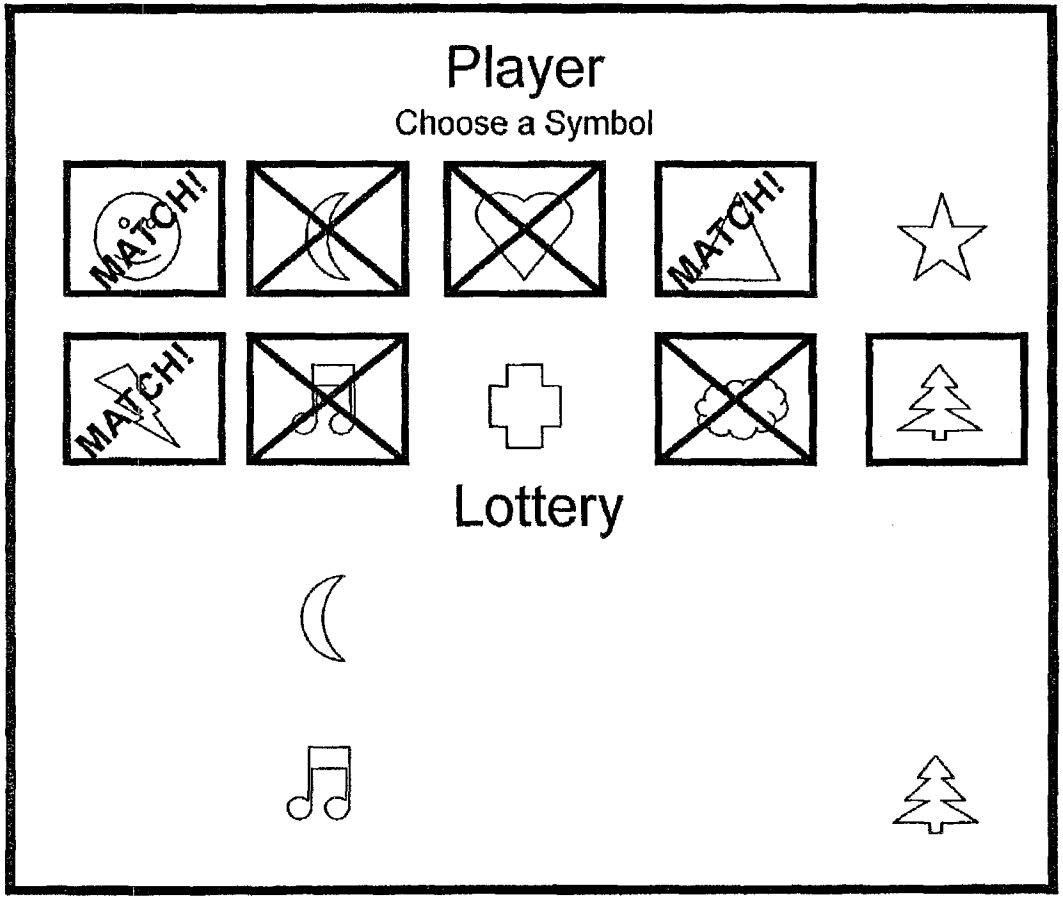
Figure 33:
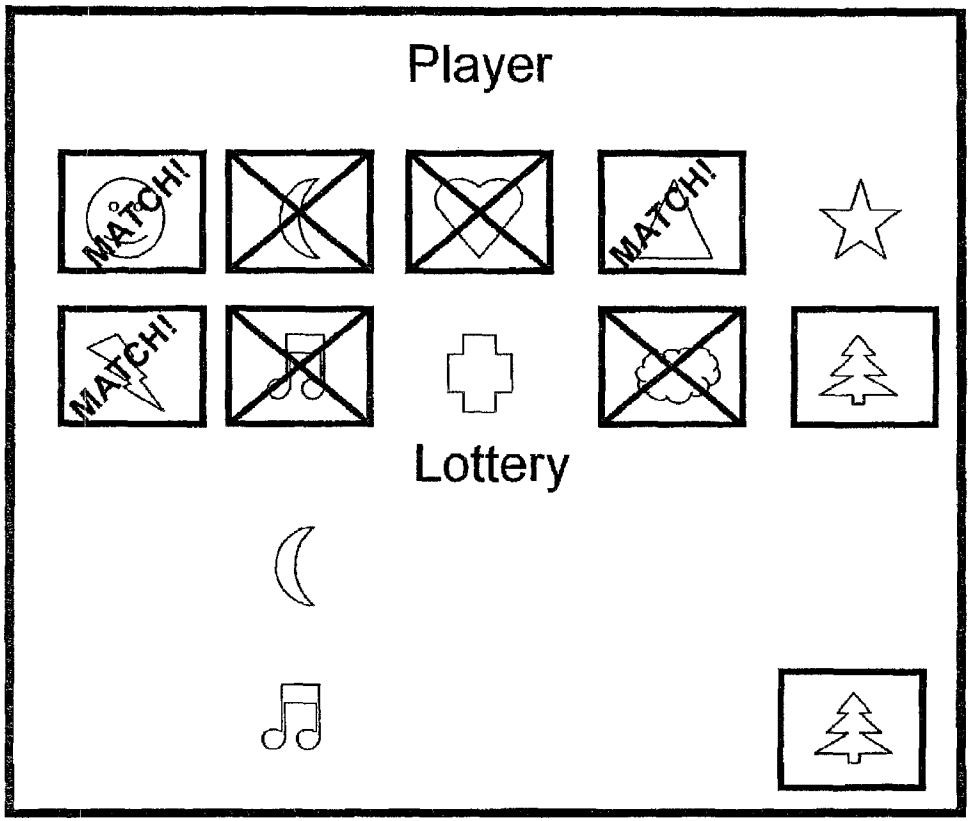

The player is prompted to select another symbol (FIG. 30). He selects the tree (FIG. 31). In FIG. 32, the tree is indicated as his selection (outlined by a box). In FIG. 33, the gaming organization randomly selects a symbol from its remaining 3 symbols. The gaming organization has also selected the tree. As both the player and gaming organization have selected the tree, the player's selection is recorded as a match by superimposing the word "match" over the player's tree, as in FIG. 34.

Figure 34:
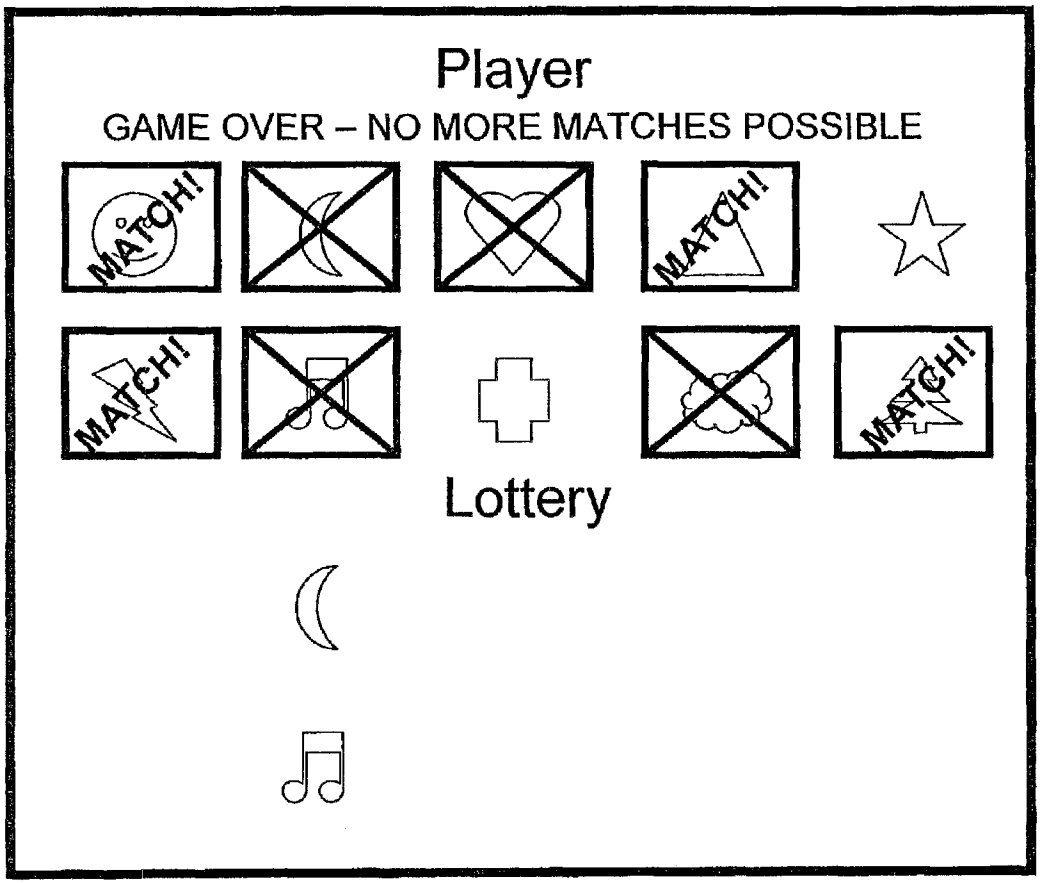

At this point, the player has remaining two symbols, a star and a plus sign, and the gaming organization has remaining two symbols, a crescent moon and musical notes. As the sets are disjoint, it is not possible for there to be any further matches were the game to continue. It makes no difference as to the outcome of the game whether or not the game is continued at this point. As indicated in FIG. 34, the player is informed that the game is over by the announcement "GAME OVER—NO MORE MATCHES POSSIBLE." It is noted that the game may terminate any time before there are two symbols left when there is no possibility for any further match.

The player wins prizes based on the number of matches. In FIG. 35 is a probability and prize table for this game is illustrated. In this example, the player has four matches and wins $20. As will be illustrated later, probabilities can be assigned to the outcomes of the game, which allows the allocation of prizes to produce a certain payout. Those skilled in the art of mathematics can confirm that based on the probabilities in FIG. 35, that this embodiment of the game method returns 55.7% on a $5 price point. Also, it can be verified that there is a 1 in 3.8 chance of winning this game.

There is a variety of ways of paying the player such as crediting an account or printing a receipt, such as if the player is at a player activated terminal. The current invention differs from other permutation-based wagering games in that the player makes his selections interactively with the gaming organization as opposed to making his selections in advance. In that way the player may be able to influence whether or not his selection matches that of the gaming organization at a particular turn. For example, forgoing a potential match at a turn improves a player's chances of matching at subsequent turns.

For example, in the above discussed game, when the player is prompted to make his 5th selection (FIG. 18), he has available six symbols. For two of his symbols, the star and the cloud, it is not possible to attain match on that turn as the gaming organization has already selected both the star and cloud in earlier turns. On the other hand, if the player selects a lightning bolt, plus sign, or tree, there is a 1 in 6 chance that a match will result on that turn. Despite this, the player selects a cloud (FIG. 19). As it turns out, this selection works to the player's advantage. Immediately after the player selects the cloud, the gaming organization selects the heart (FIG. 21). This does not result in a match. However, any selection the player had made would not have resulted in a match. The only selection that would have resulted in a match is a heart, but the player had been selected the heart in an earlier turn. Though the player did not match, he has preserved three potential matches for subsequent turns: a lightning bolt, plus sign, or tree. Had he selected one of these symbols he would be left with only two potential matches for subsequent turns, without having attained a match for that turn. In example 1, the player's (and gaming organization's) objects comprised ten distinct symbols.

Example 2

Figure 36:
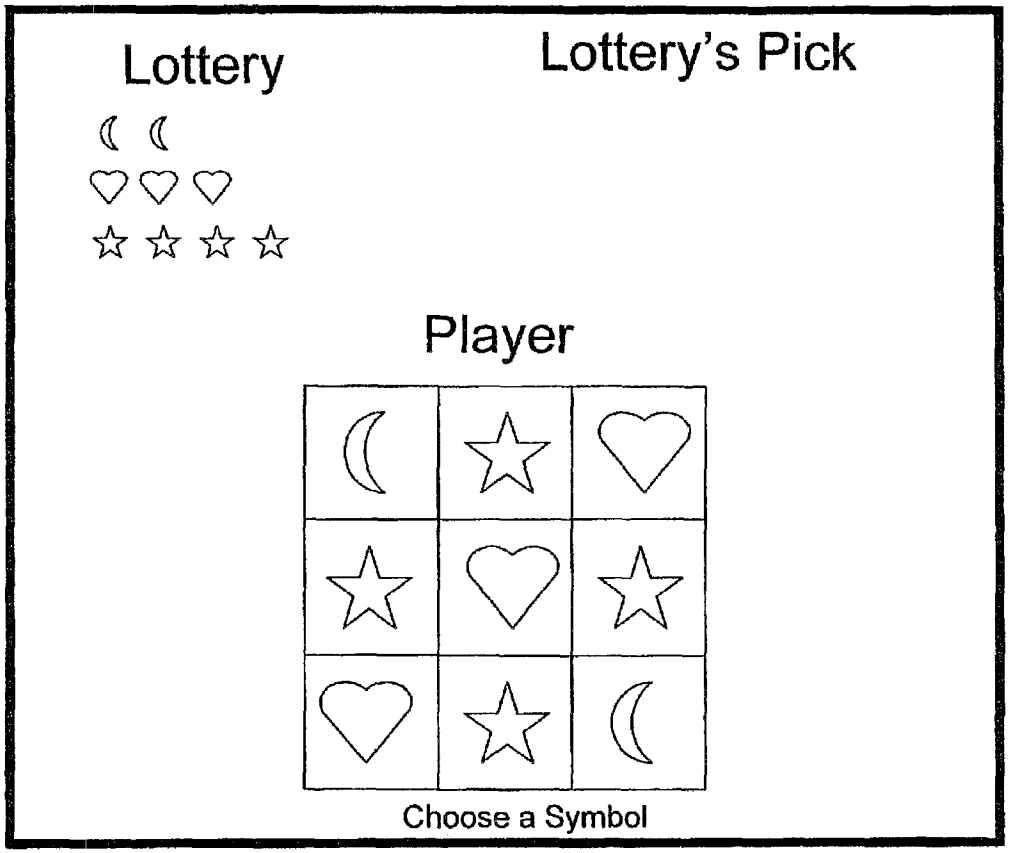
Figure 37:
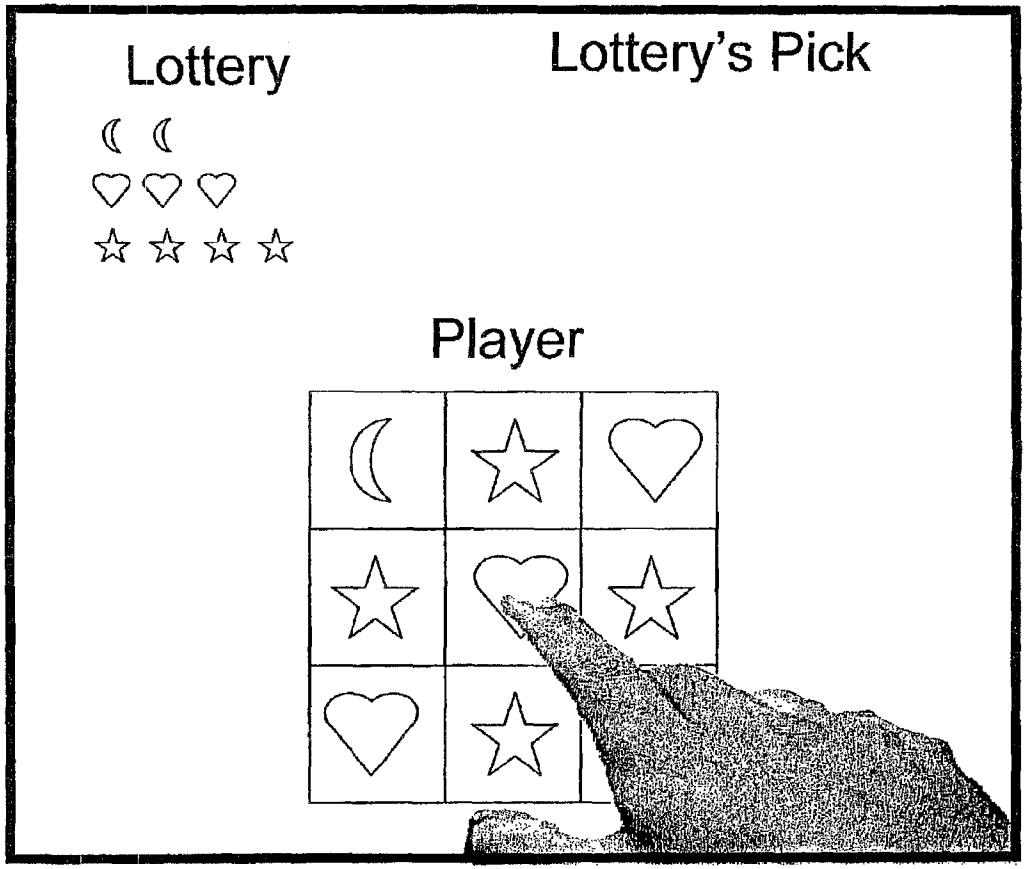
Figure 38:
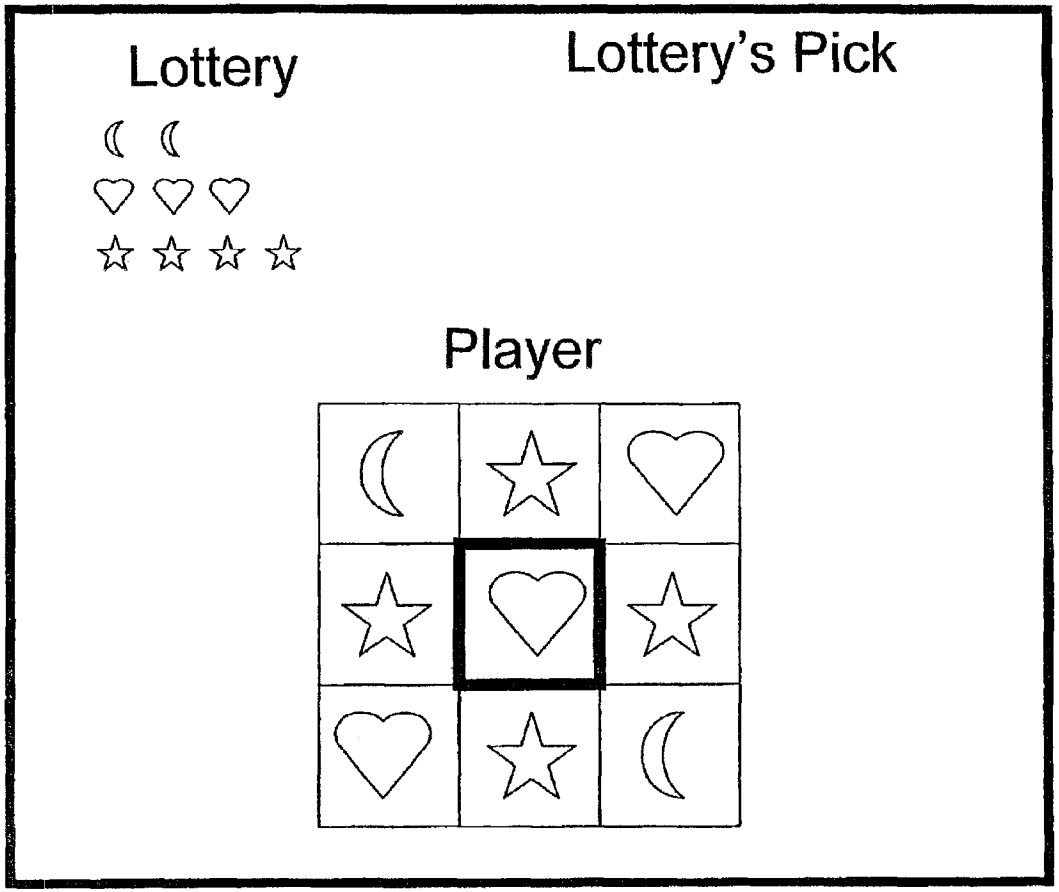
Figure 39:
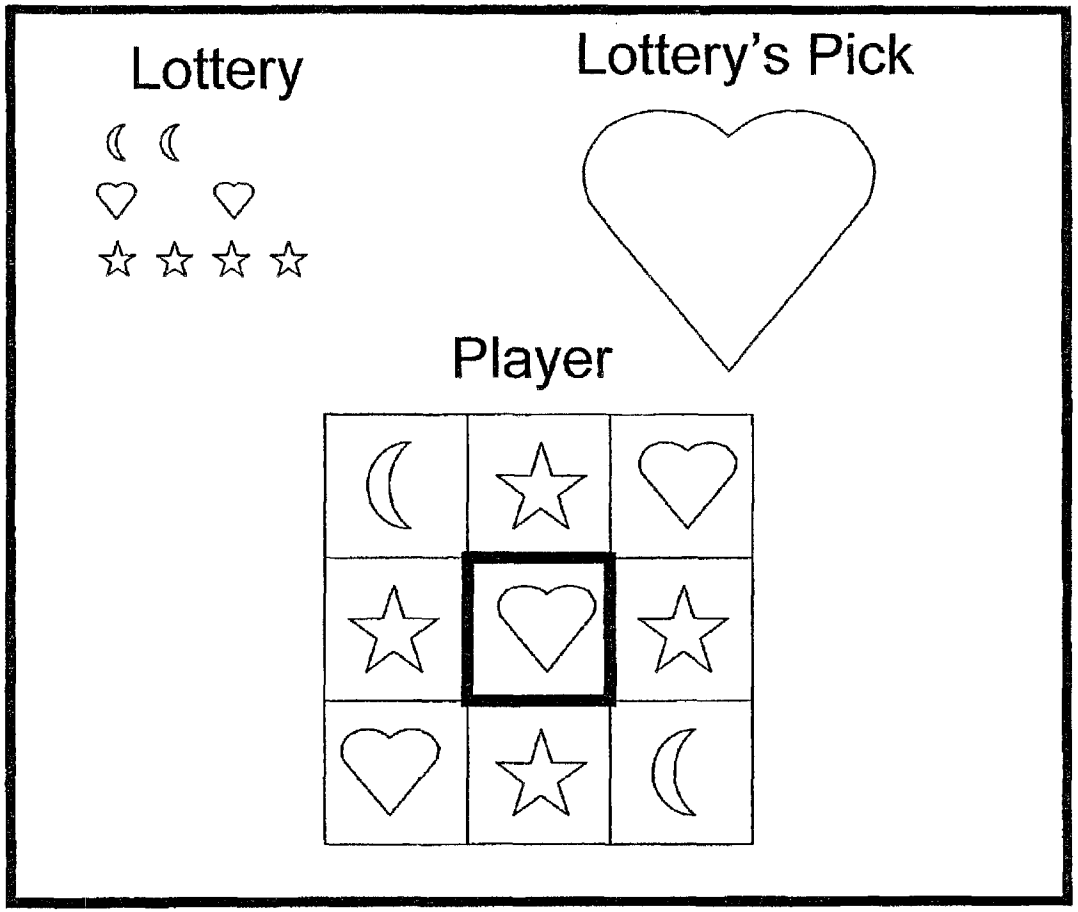

Example 2 illustrates and embodiment of the game method in which there are repeats among the player's and the gaming organization s symbols. The beginning display for the player is illustrated in FIG. 36. The player is prompted to select a symbol from his nine symbols, and in FIG. 37 the player has selected a heart, which is indicated by being outlined by a box (FIG. 38). In FIG. 39, the gaming organization randomly selects a symbol from its nine symbols, which is in this case also a heart, shown by being, enlarged it on the display. As both the player and gaming organization selected a heart, the player's selection is recorded as a match by superimposing the word "match" over the player's selection, as shown in FIG. 40.

Figure 40:
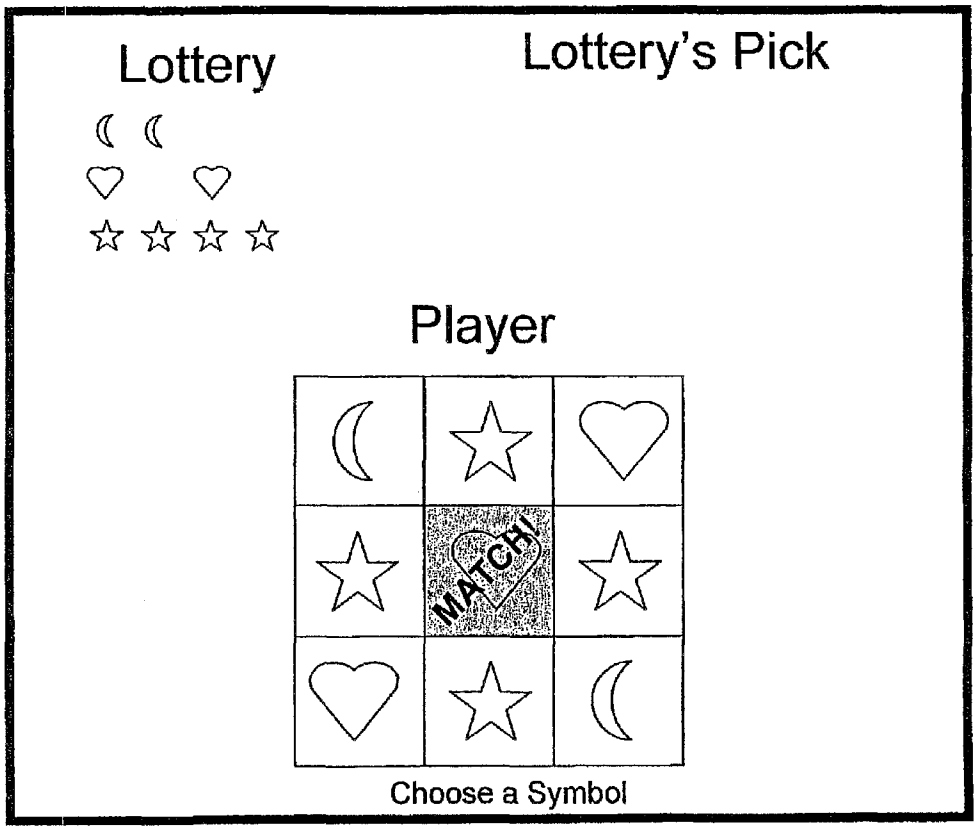
Figure 41:
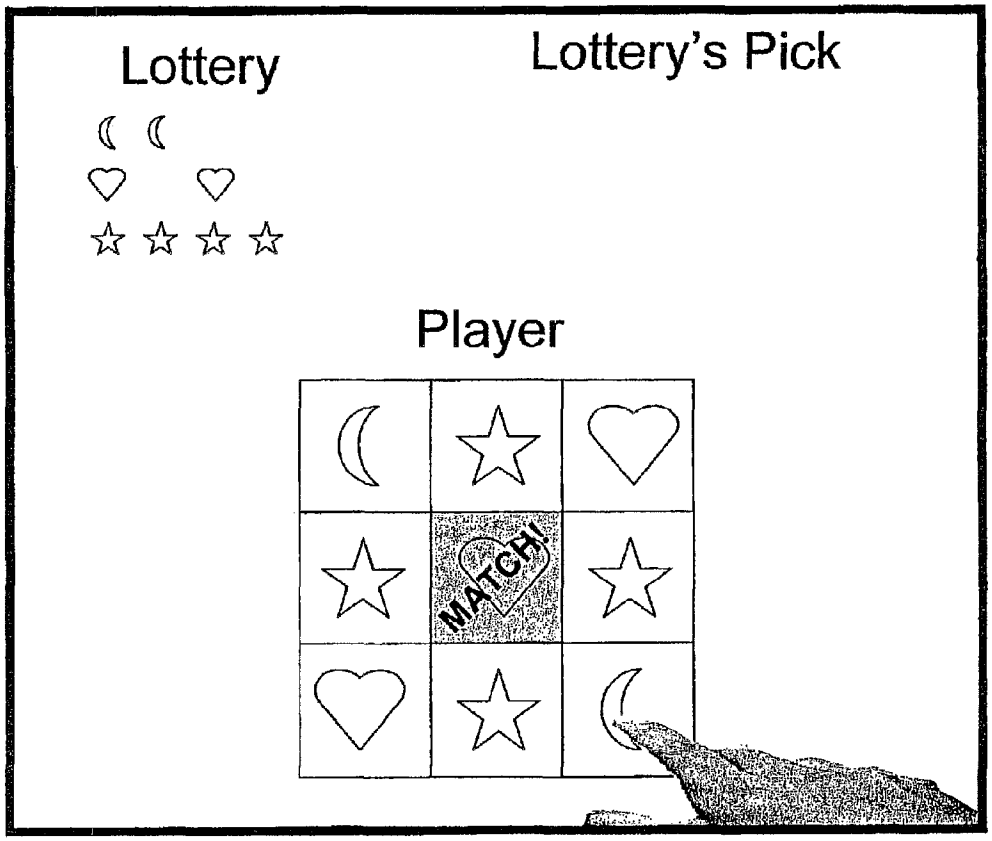
Figure 42:
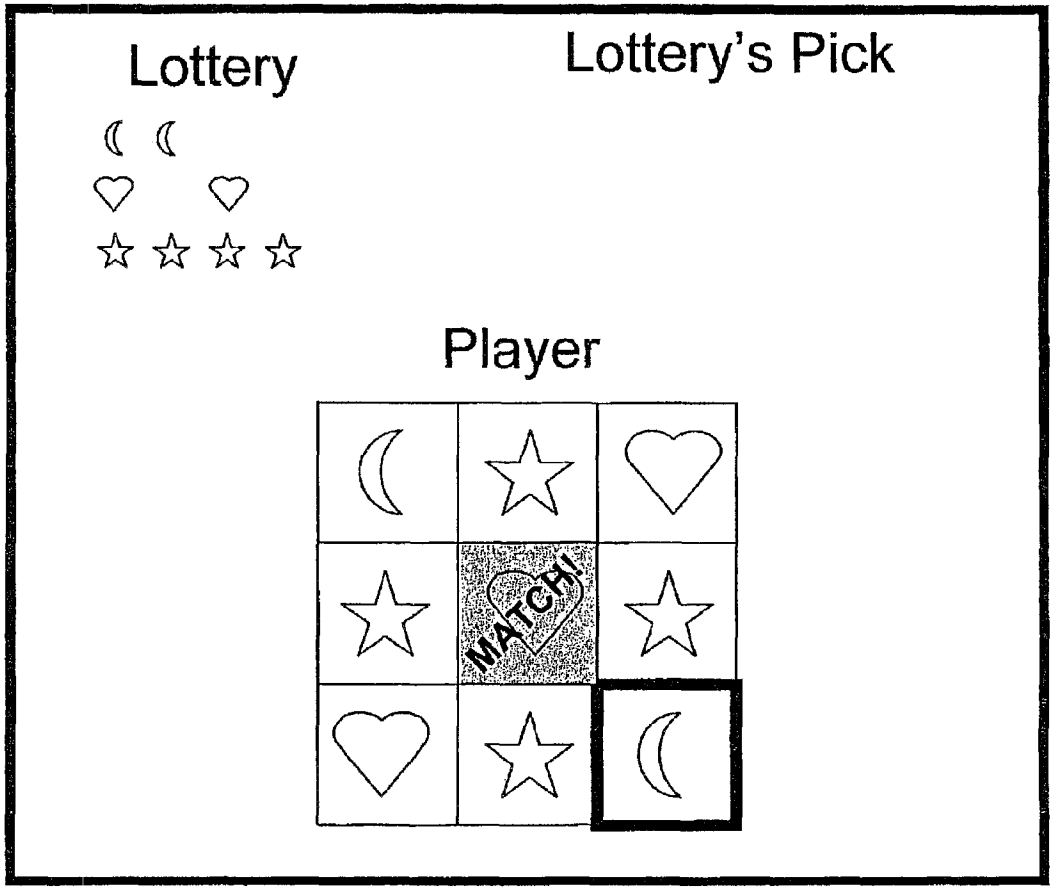
Figure 43:
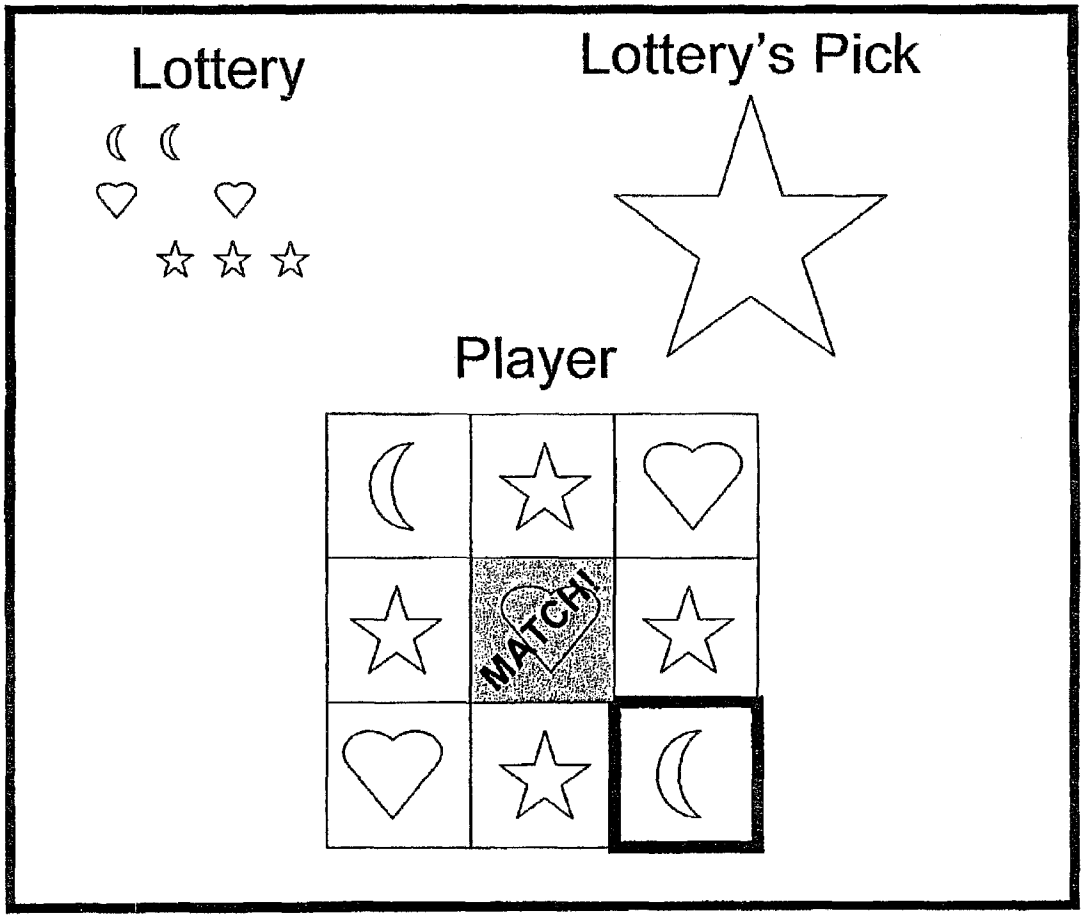

The player is next prompted to select another symbol (FIG. 40). He selects a crescent moon (FIG. 41). In FIG. 42, the crescent moon is indicated as his selection (outlined by a box). In FIG. 43, the gaming organization randomly selects a symbol from its remaining eight symbols. The gaming organization has selected a star, shown by translating and enlarging the star on the display. As the player's selection (crescent moon) and the gaming organization's selection (star) do not match, the player's selection is recorded as a non-match by superimposing an "X" over the player's selection (FIG. 44).

Figure 44:
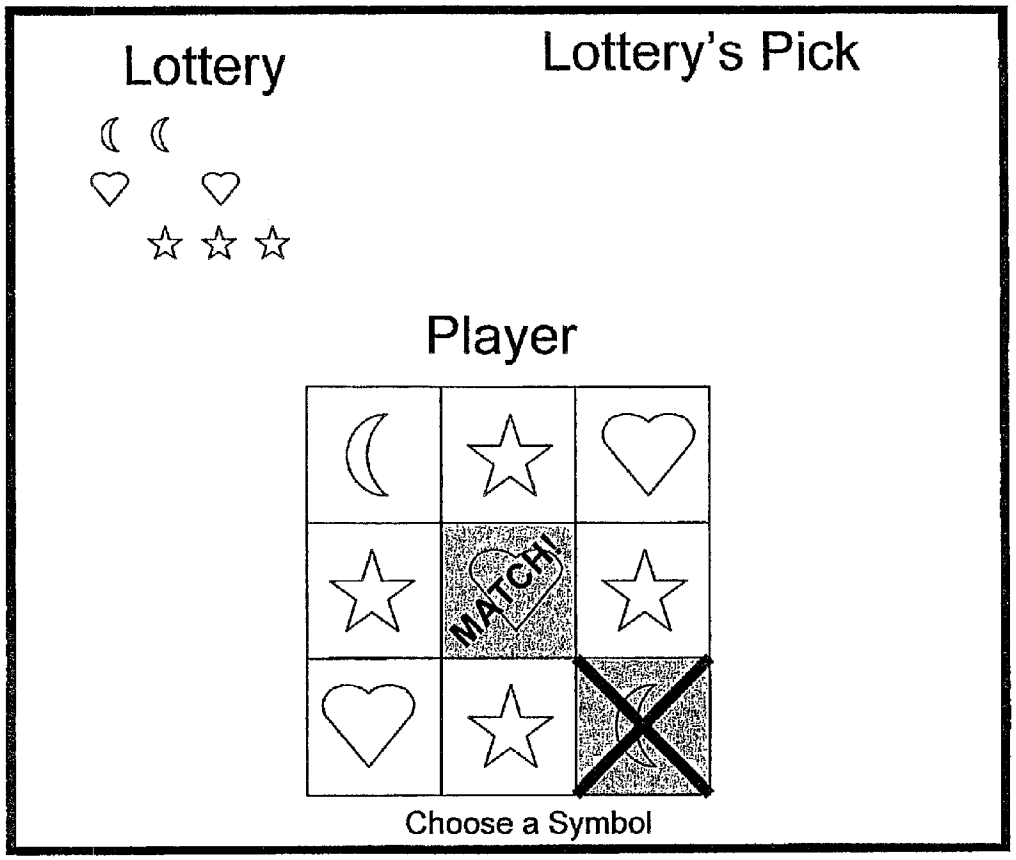
Figure 45:
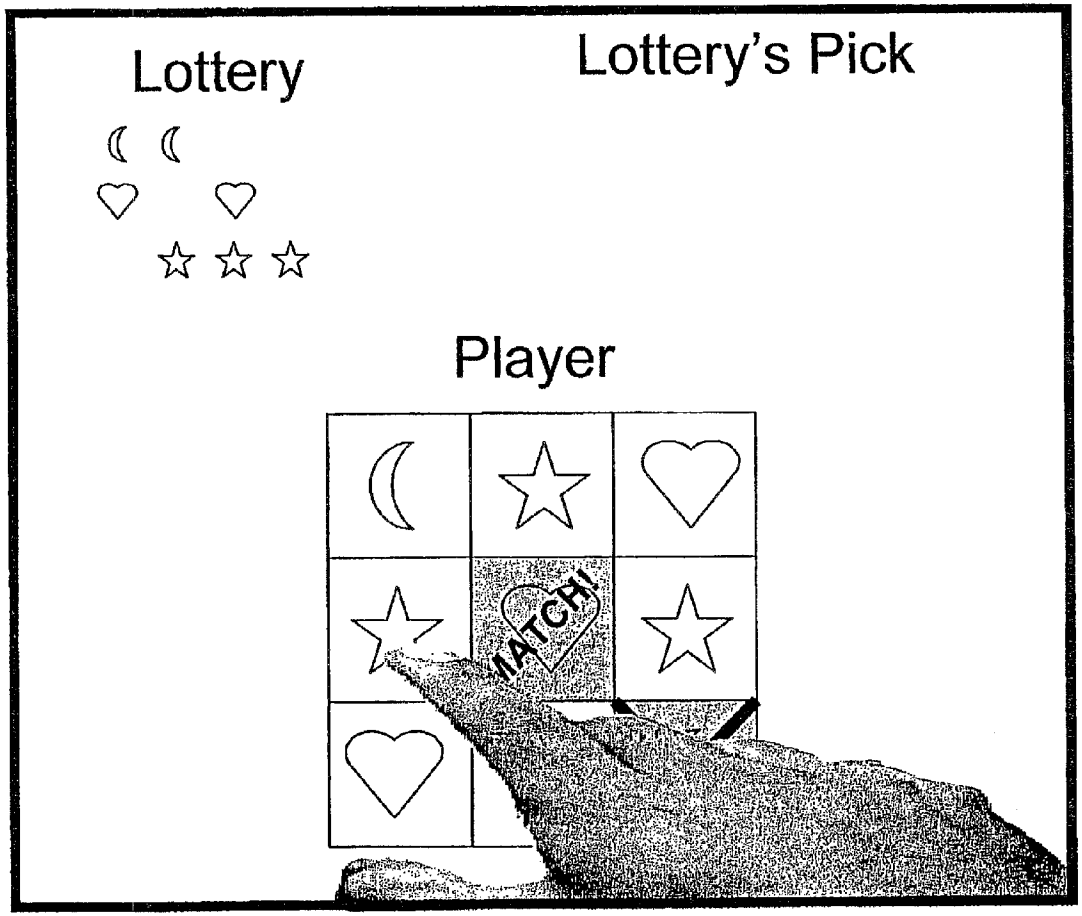
Figure 46:
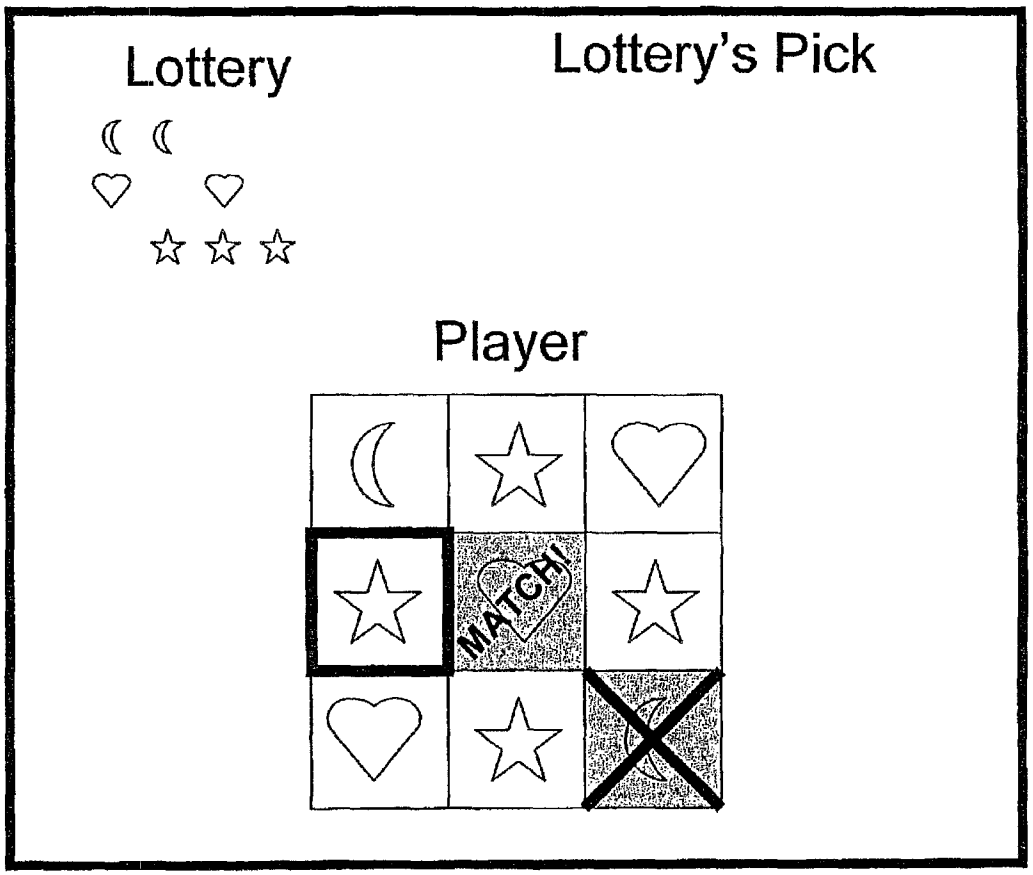
Figure 47:
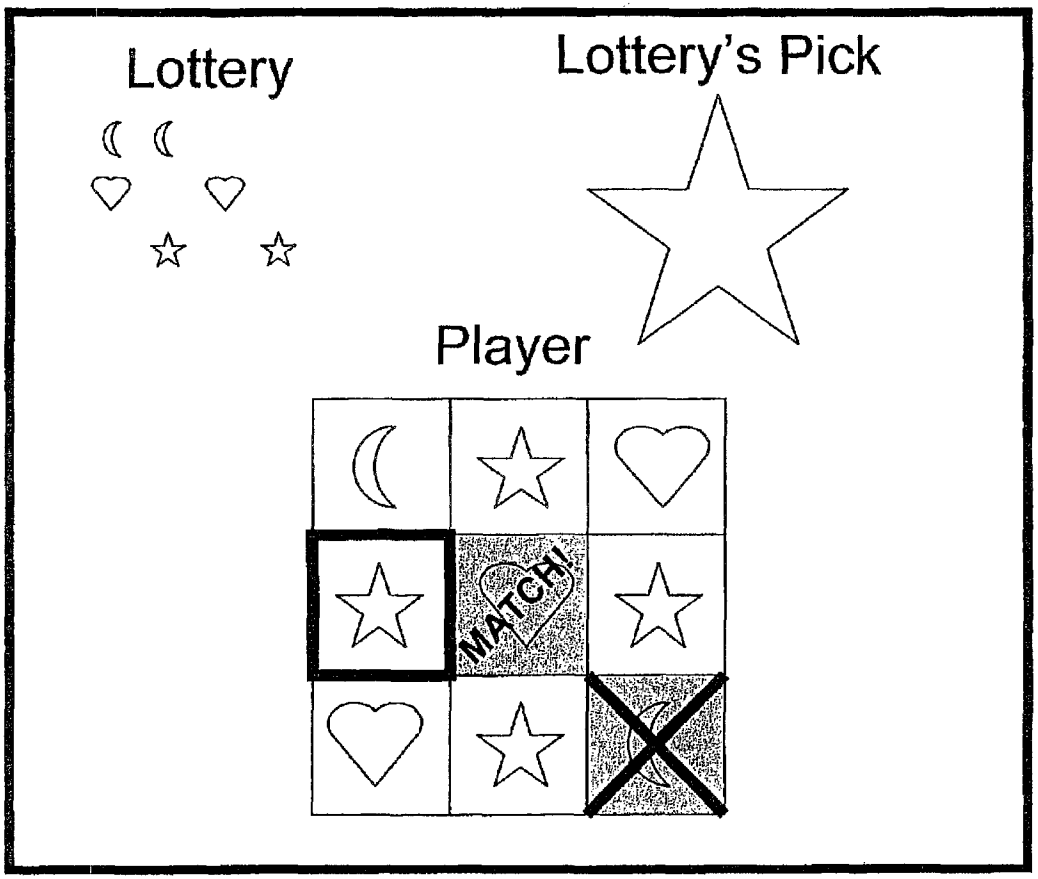

The player is prompted to then select another symbol (FIG. 44). He selects a star (FIG. 45). In FIG. 46, the star is indicated as his selection (outlined by a box). In FIG. 47, the gaming organization randomly selects a symbol from its remaining seven symbols. The gaming organization has also selected a star, indicated by translating and enlarging the star on the display. As both the player and gaming organization selected a star, the player's selection is recorded as a match by superimposing the word "match" over the selection, as illustrated in FIG. 48.

Figure 48:
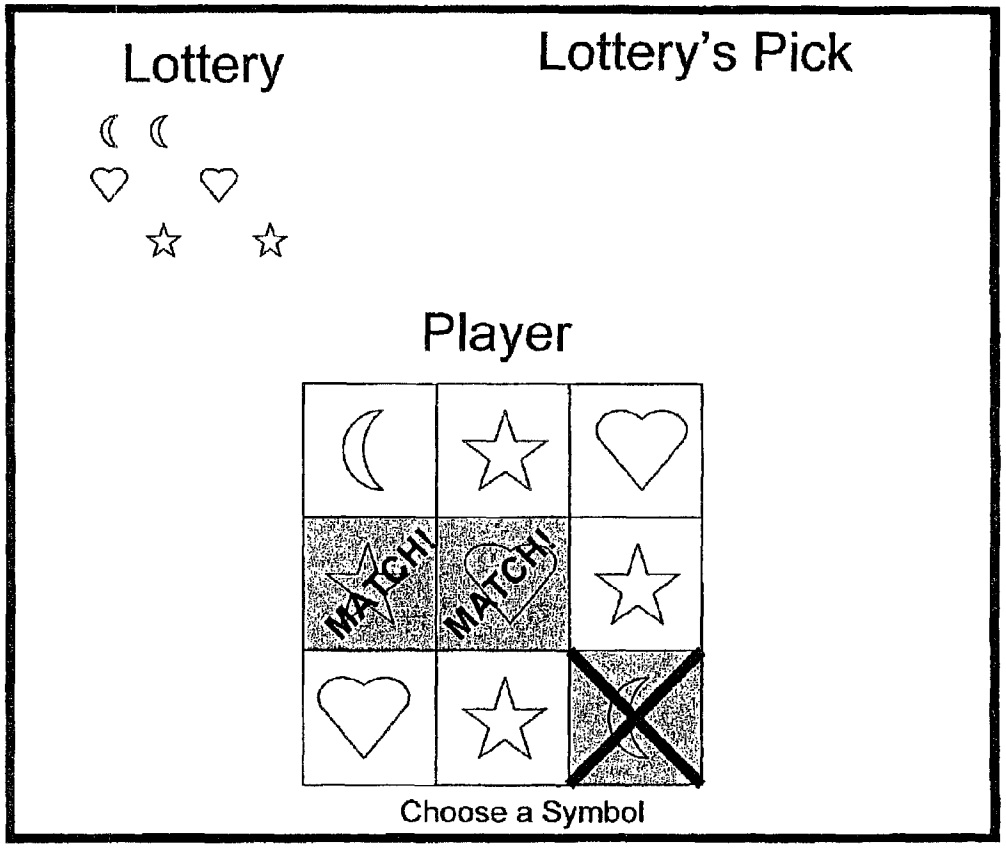
Figure 49:
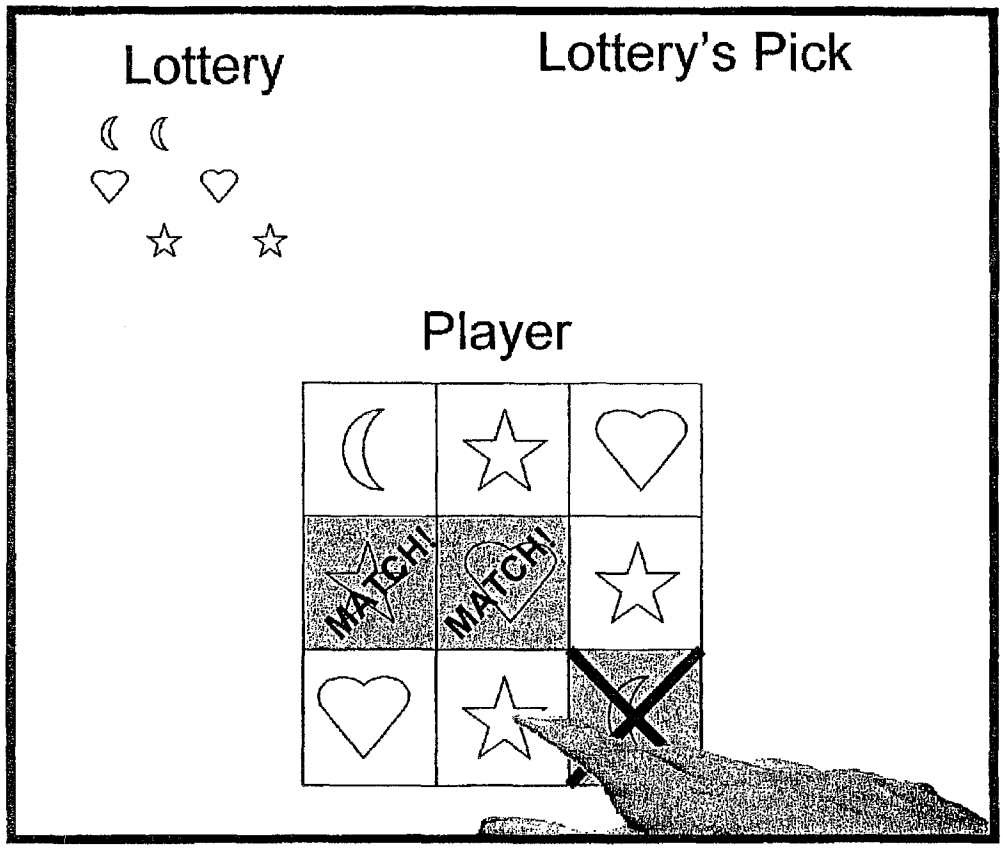
Figure 50:
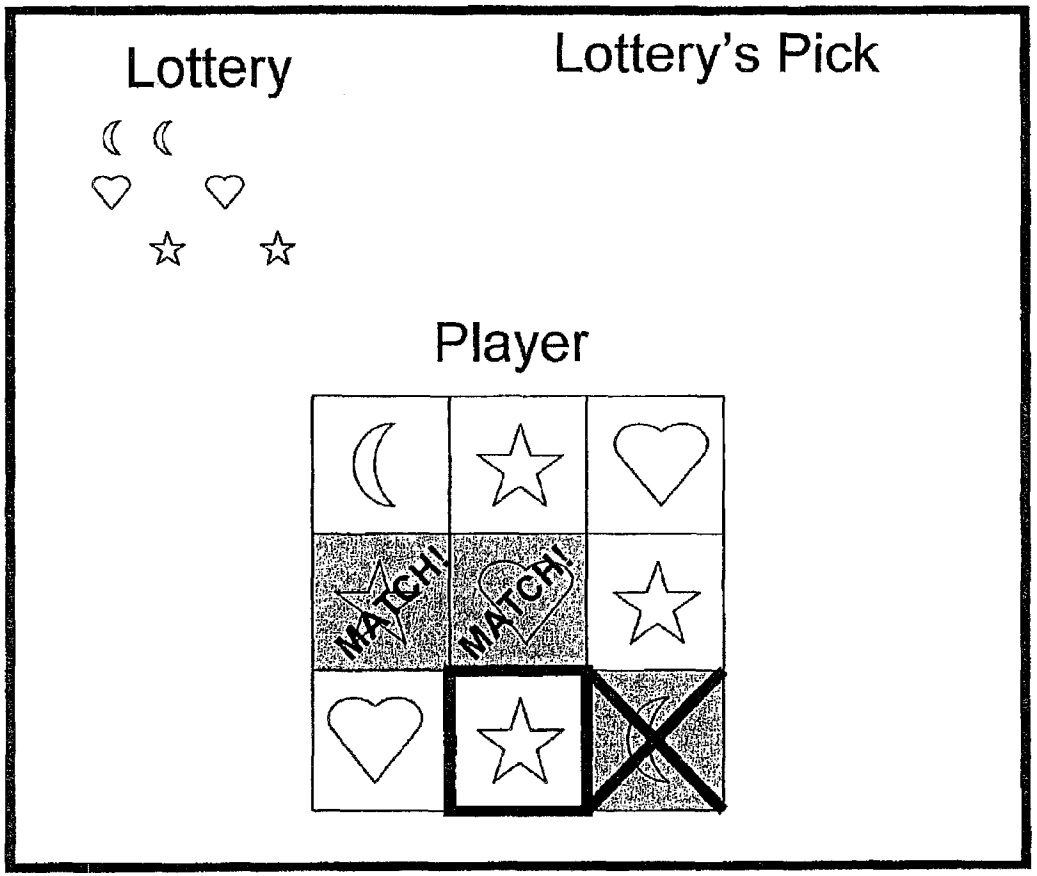
Figure 51:
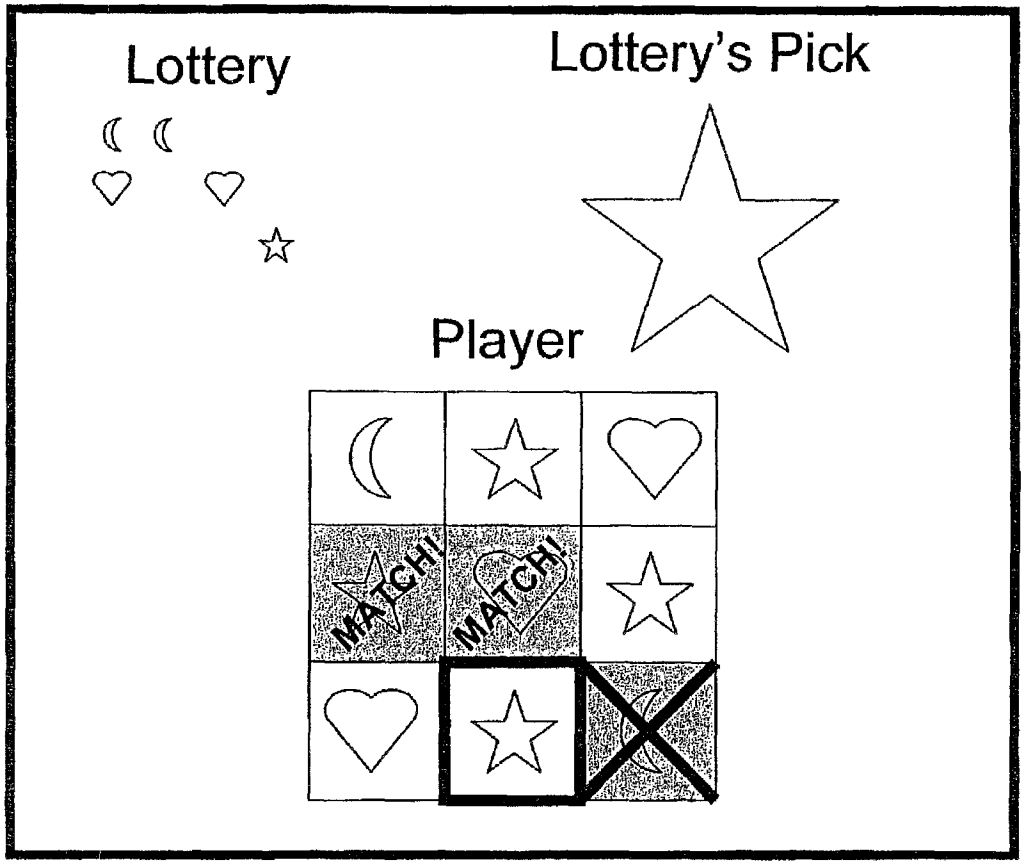

The player is prompted to select another symbol (FIG. 48). He selects a star (FIG. 49). In FIG. 50, the star is indicated as his selection, shown outlined by a box. In FIG. 51 the gaming organization randomly selects a symbol from its remaining six symbols. The gaming organization has selected a star, indicated by translating and enlarging it on the display. As both the player and gaming organization selected a star, the player's selection is recorded as a match by superimposing the word "match" over the selection, as in FIG. 52.

Figure 52:
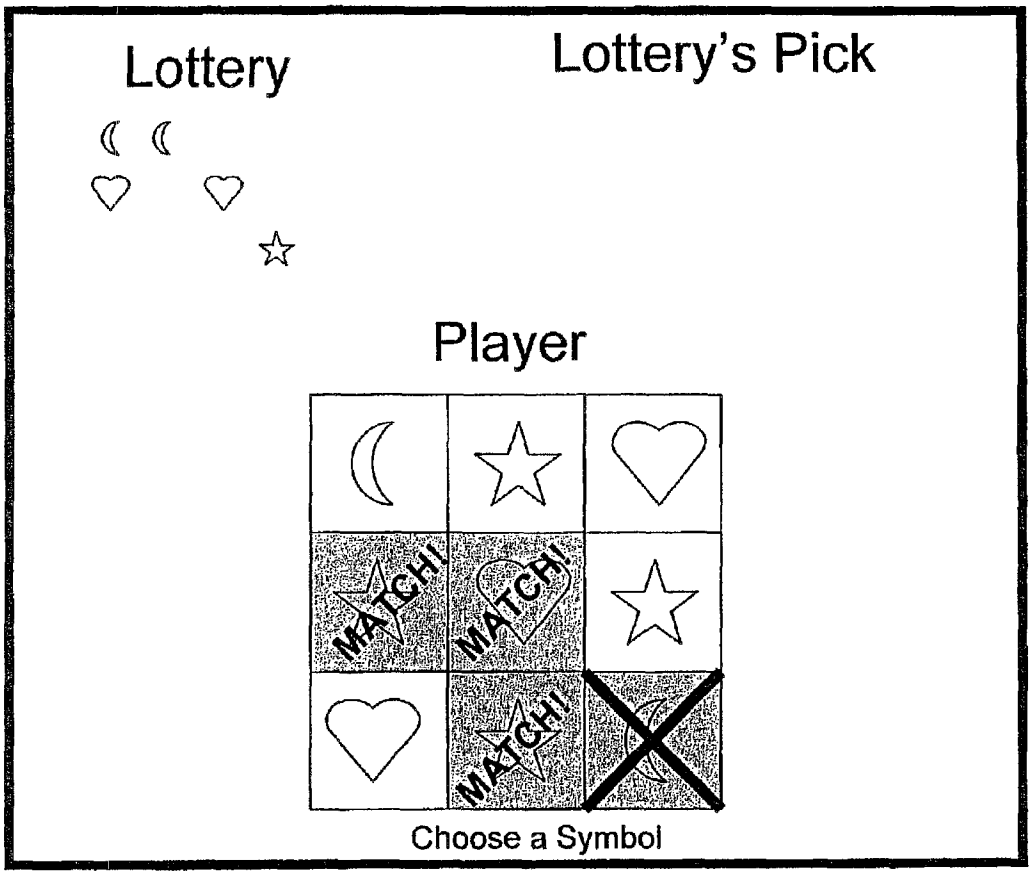
Figure 53:
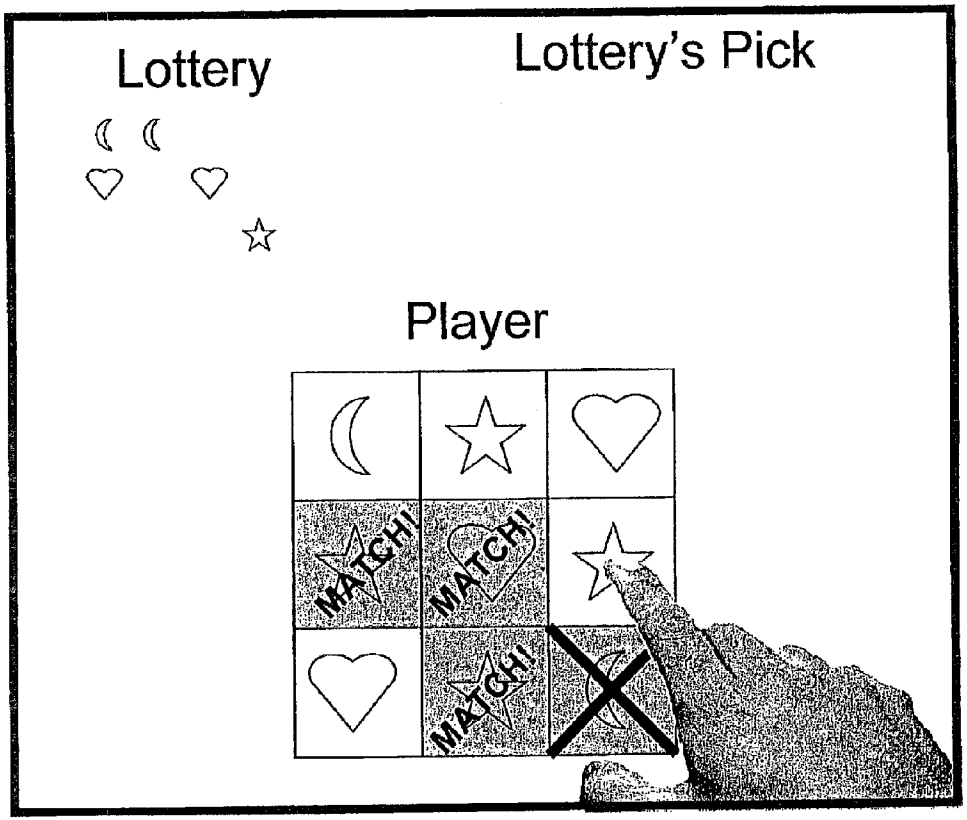
Figure 54:
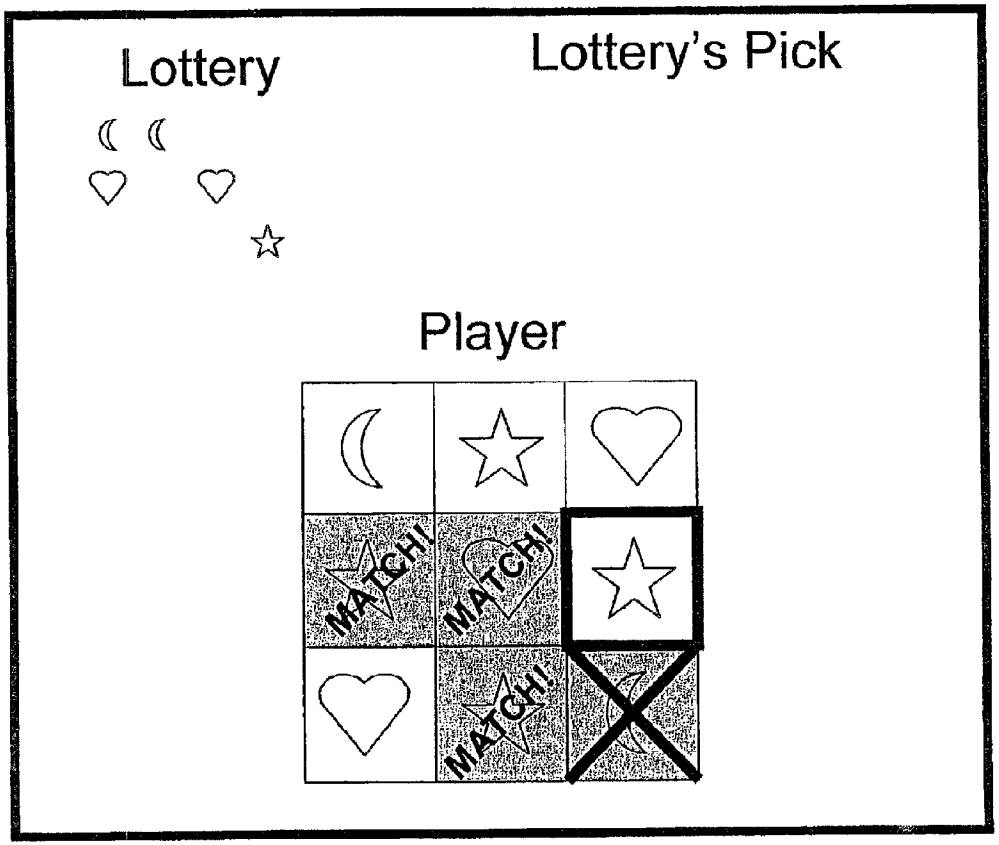
Figure 55:
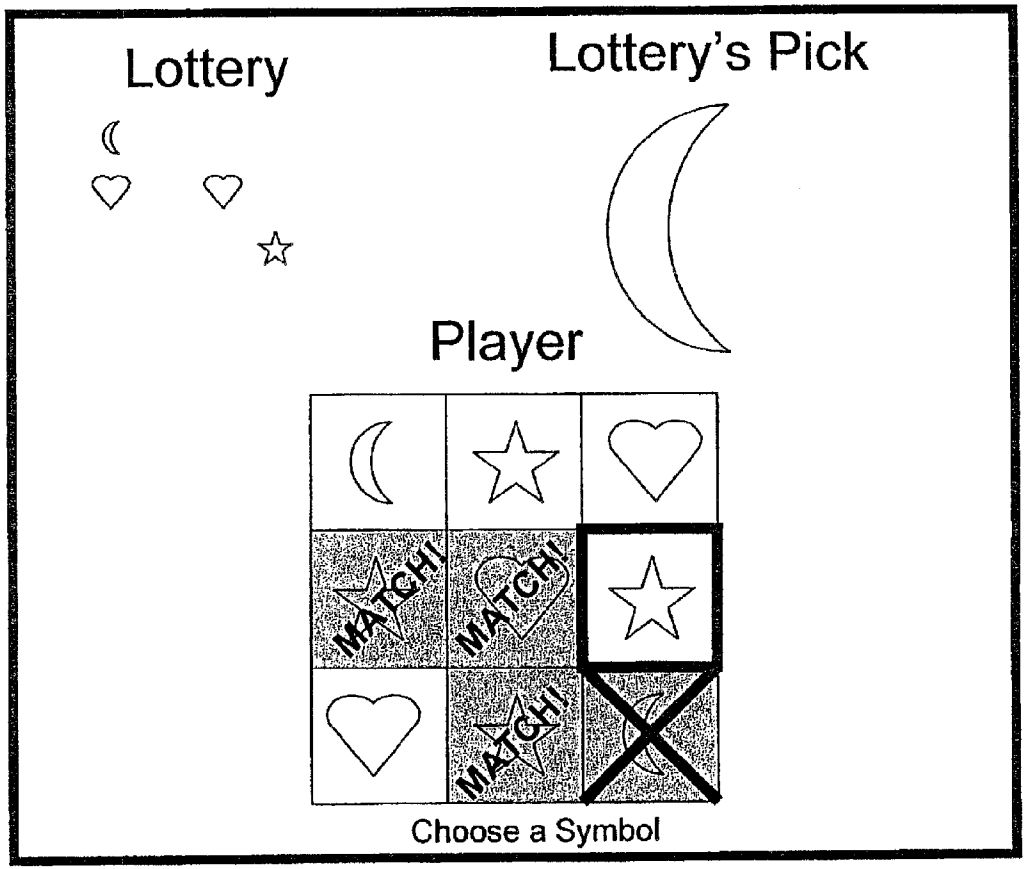

The player is prompted to select another symbol (FIG. 52). He selects a star (FIG. 53). In FIG. 54, the star is indicated as his selection, outlined by a box. In FIG. 55, the gaming organization randomly selects a symbol from its remaining five symbols. The gaming organization has selected a crescent moon, indicated on the display. As the player's selection (star) and the gaming organization's selection (crescent moon) do not match, the player's selection is recorded as a non-match by superimposing an "X" over the player's selection (FIG. 56).

Figure 56:
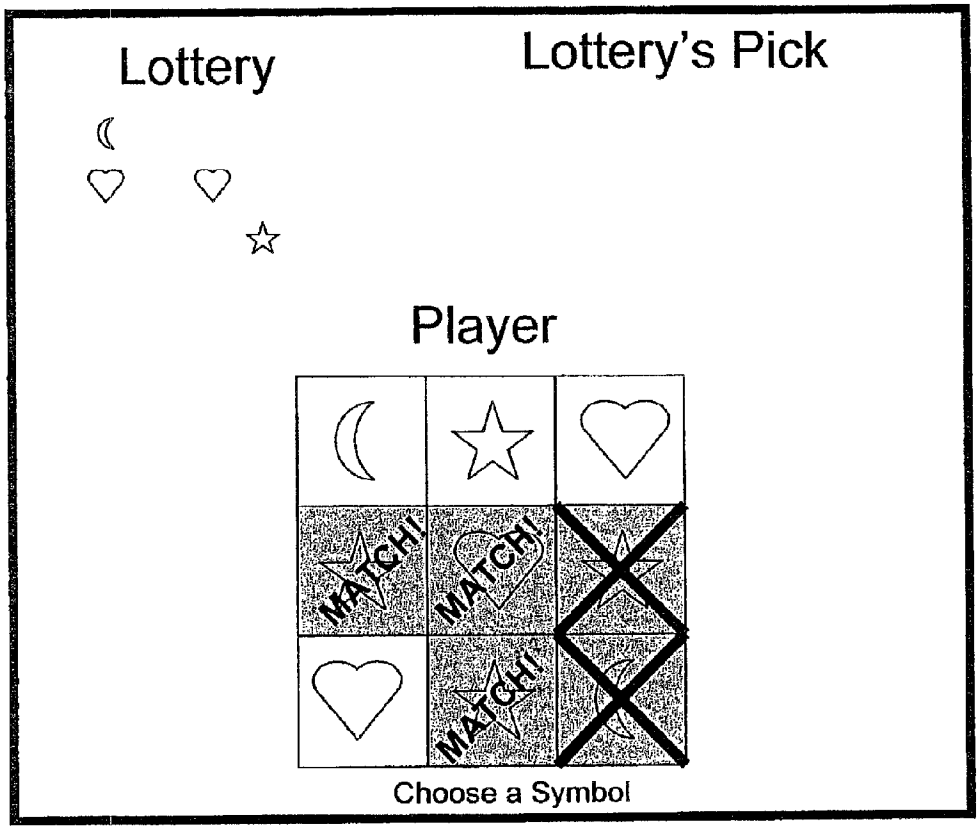
Figure 57:
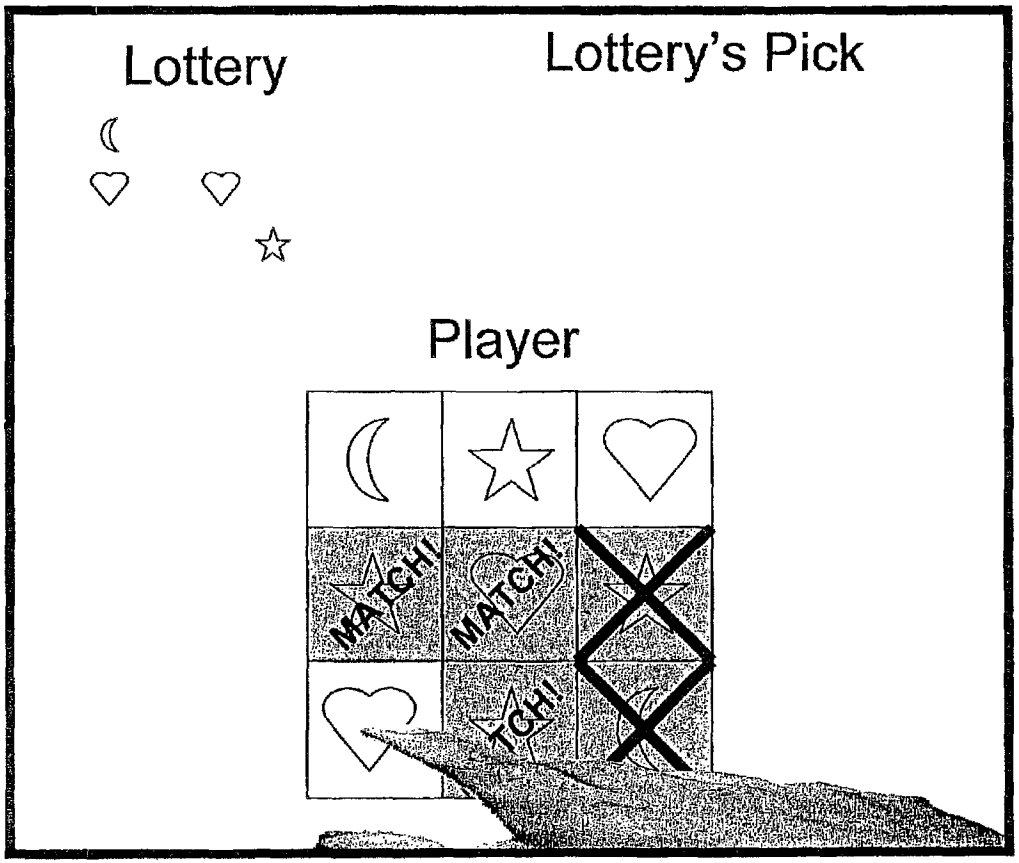
Figure 58:
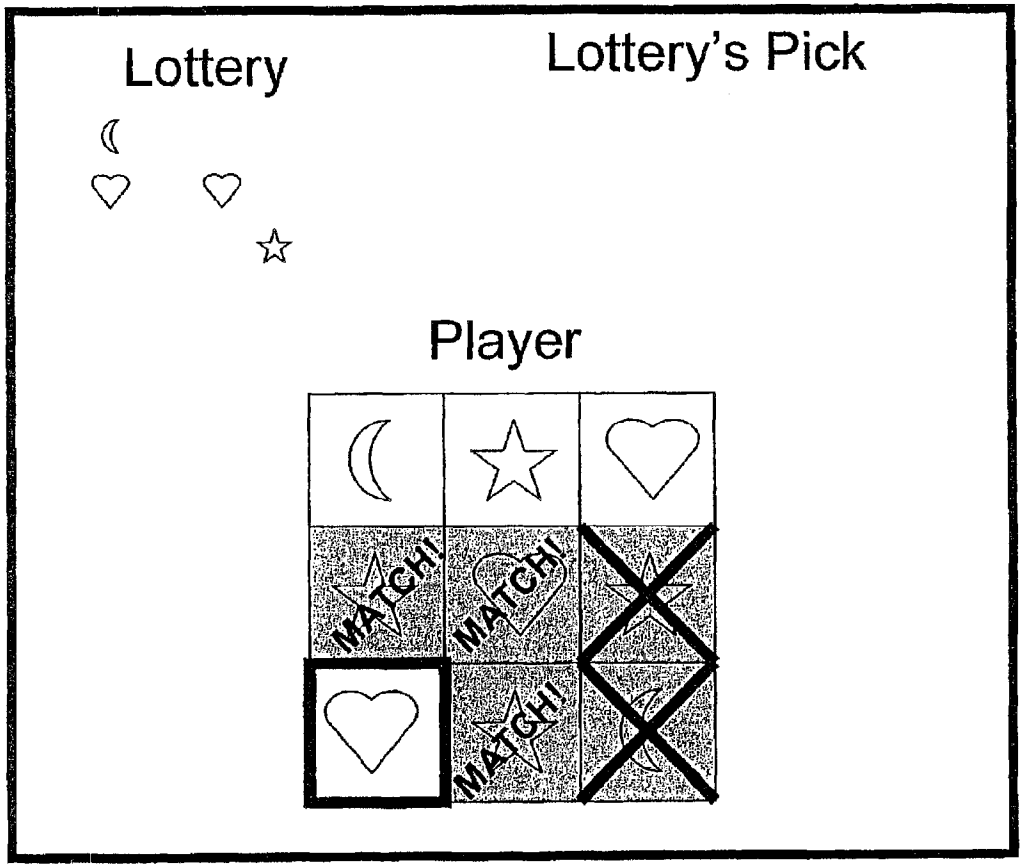
Figure 59:
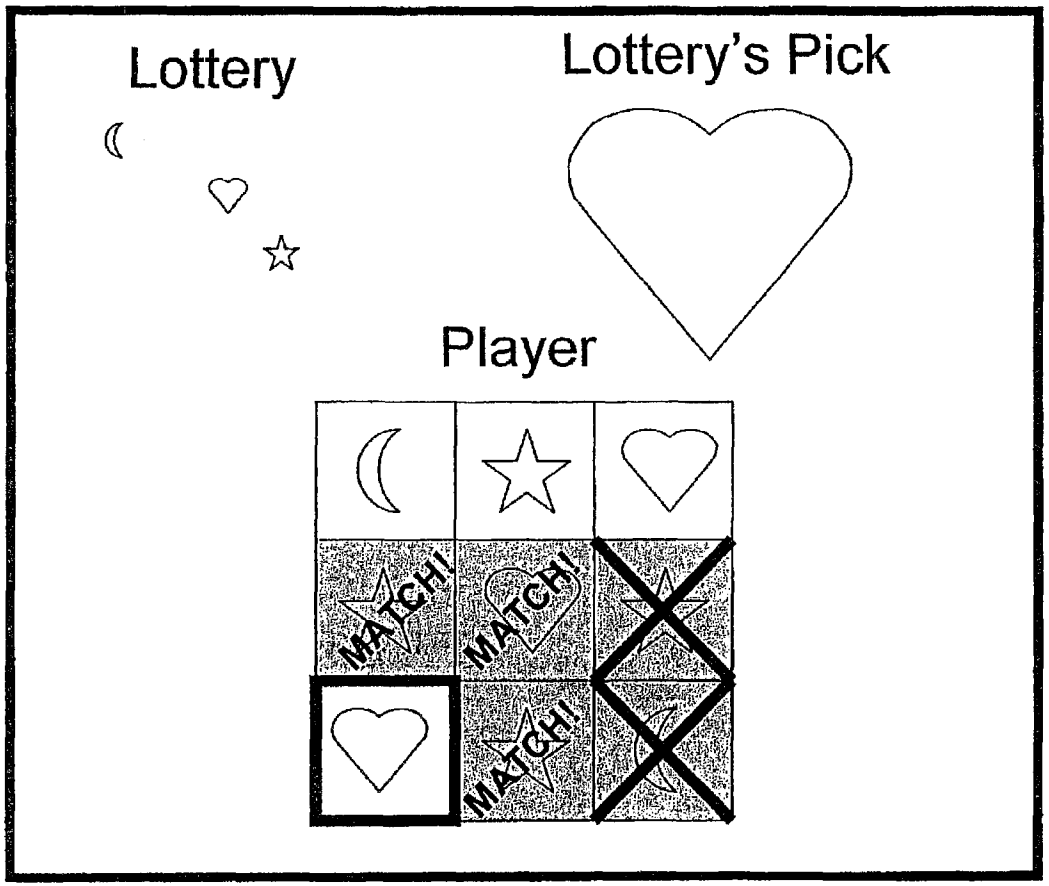

The player is then prompted to select another symbol (FIG. 56). He selects a heart (FIG. 57). In FIG. 58, the heart is indicated as his selection (outlined by a box). In FIG. 59, the gaming organization randomly selects a symbol from its remaining four symbols. The gaming organization has selected a heart (by translating and enlarging it on the display). As both the player and gaming organization selected a heart, the player's selection is recorded as a match by superimposing the word "match" over the selection, as in FIG. 60.

Figure 60:
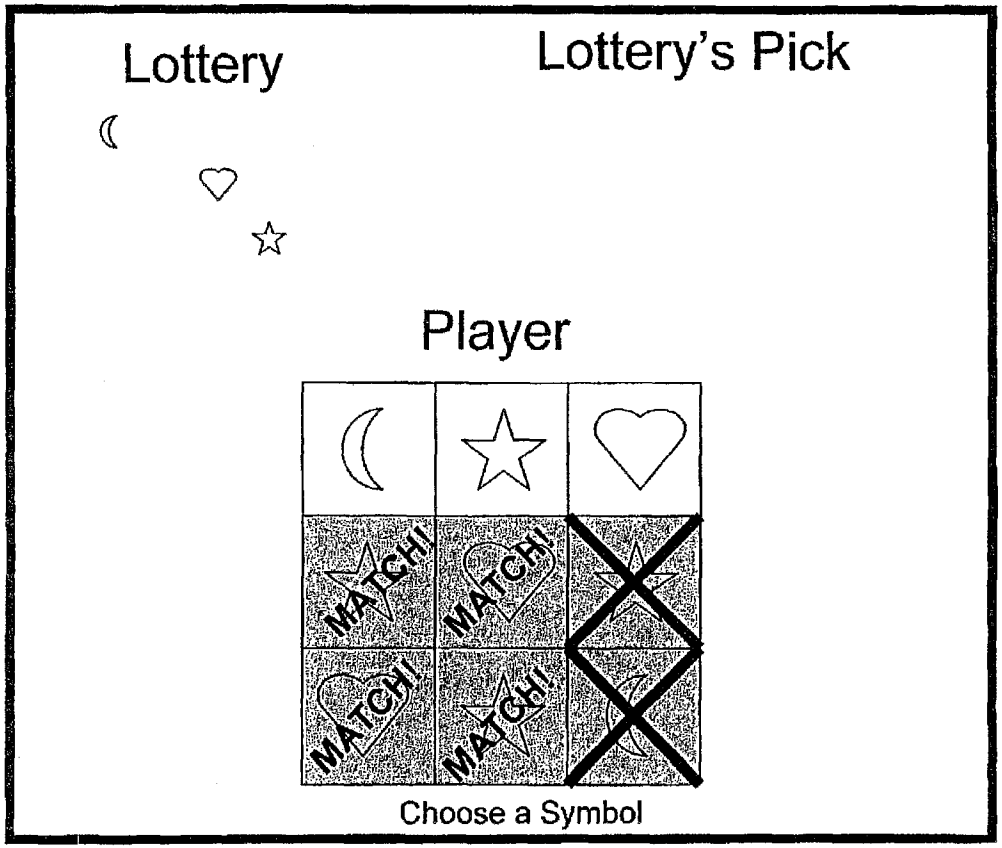
Figure 61:
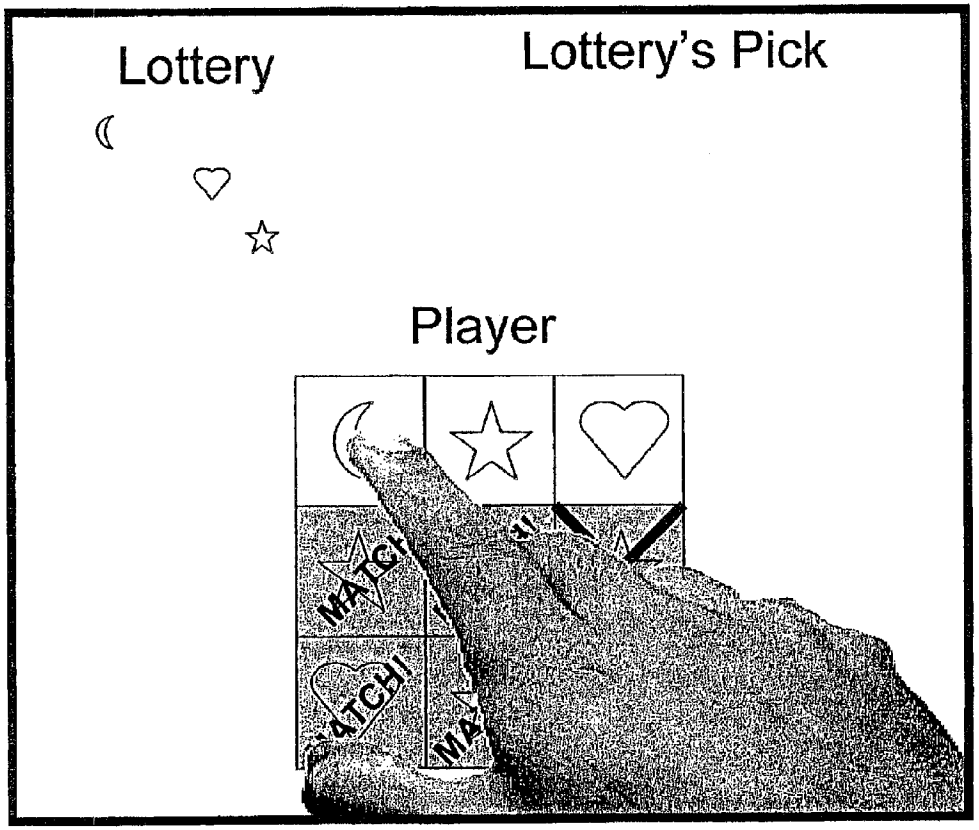
Figure 62:
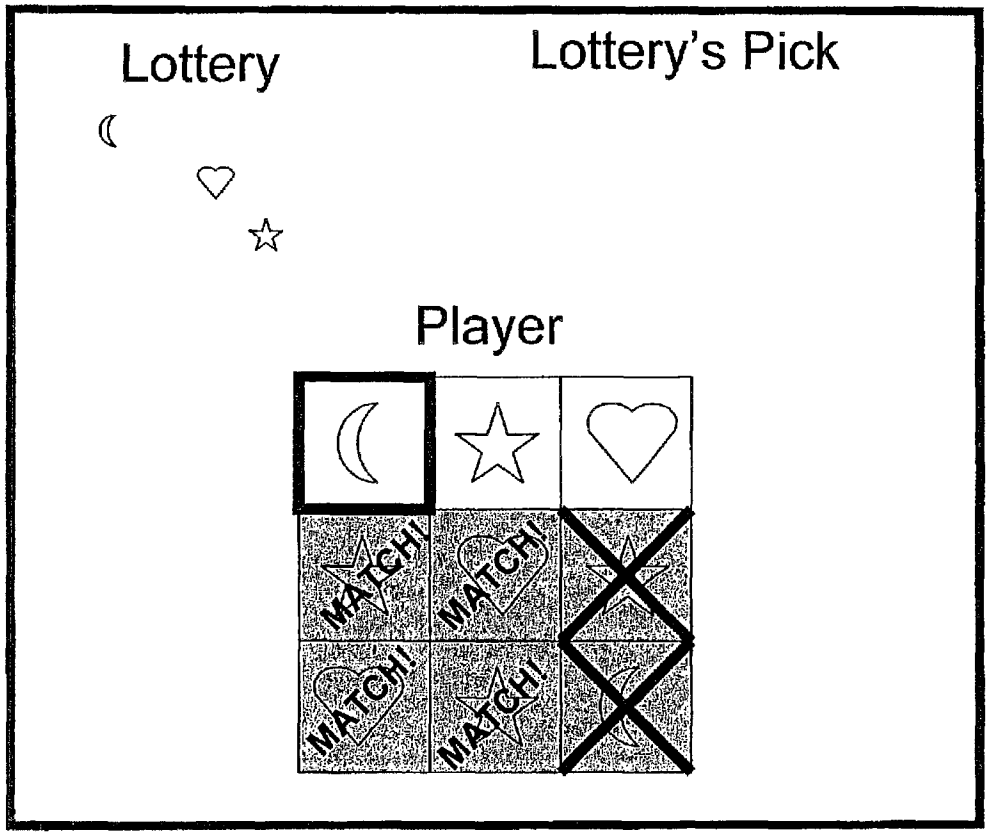
Figure 63:
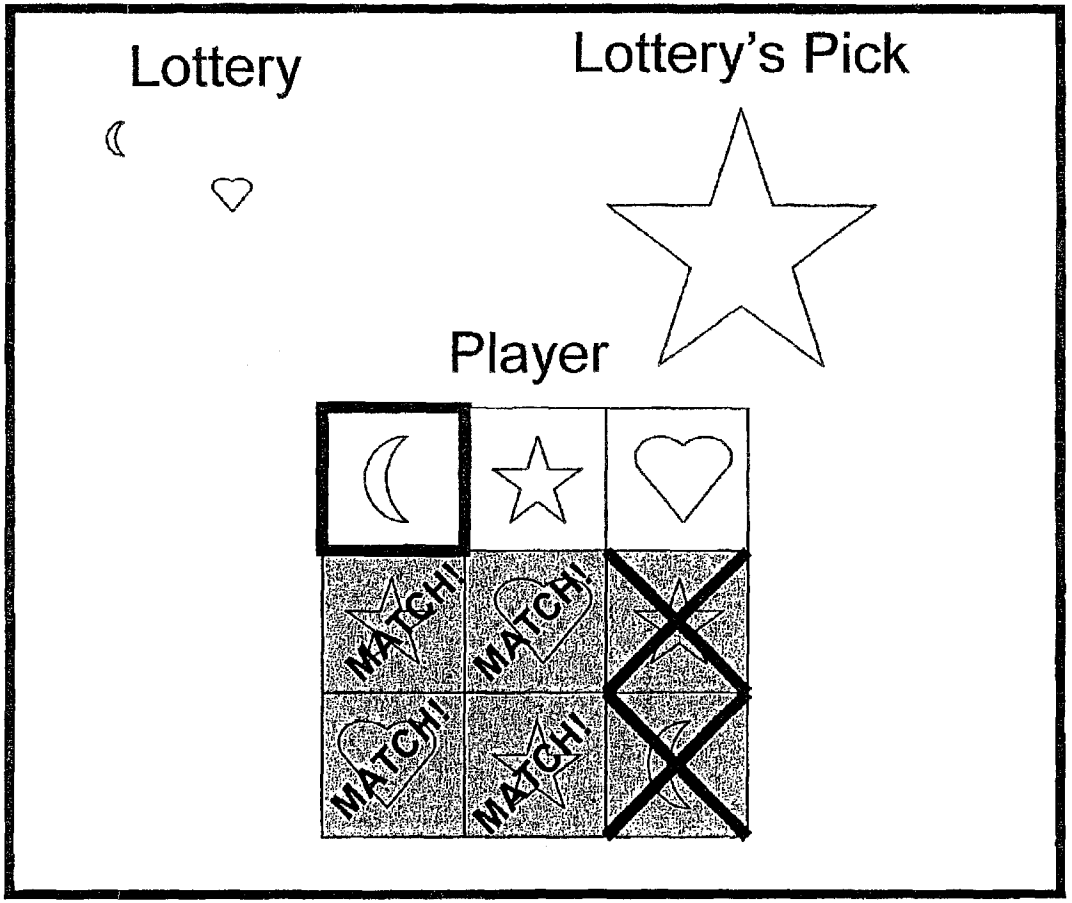
Figure 64:
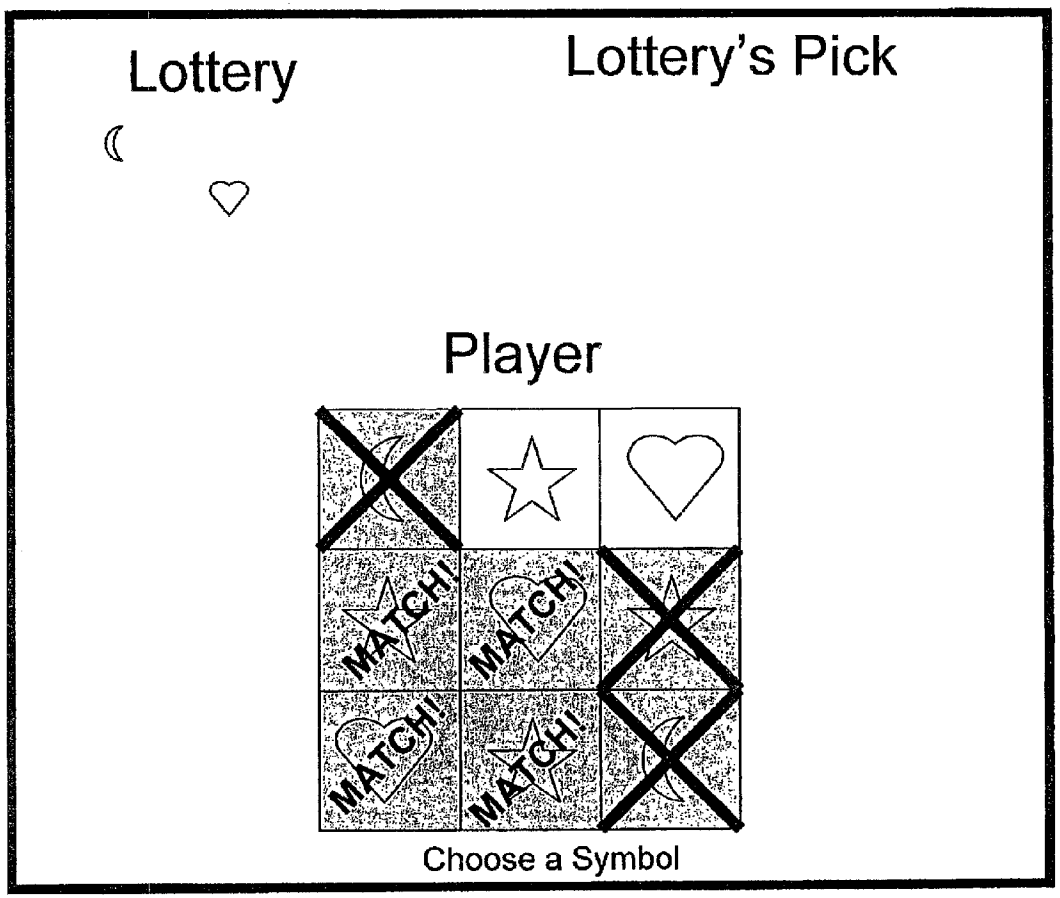

Next, the player is prompted to select another symbol (FIG. 60). He selects a crescent moon (FIG. 61). In FIG. 62, the crescent moon is indicated as his selection (outlined by a box). In FIG. 63, the gaming organization randomly selects a symbol from its remaining three symbols. The gaming organization has selected a star (by translating and enlarging it on the display). As the player's selection (crescent moon) and the gaming organization's selection (star) do not match, the player's selection is recorded as a non-match by superimposing an "X" over the player's selection (FIG. 64).

Figure 65:
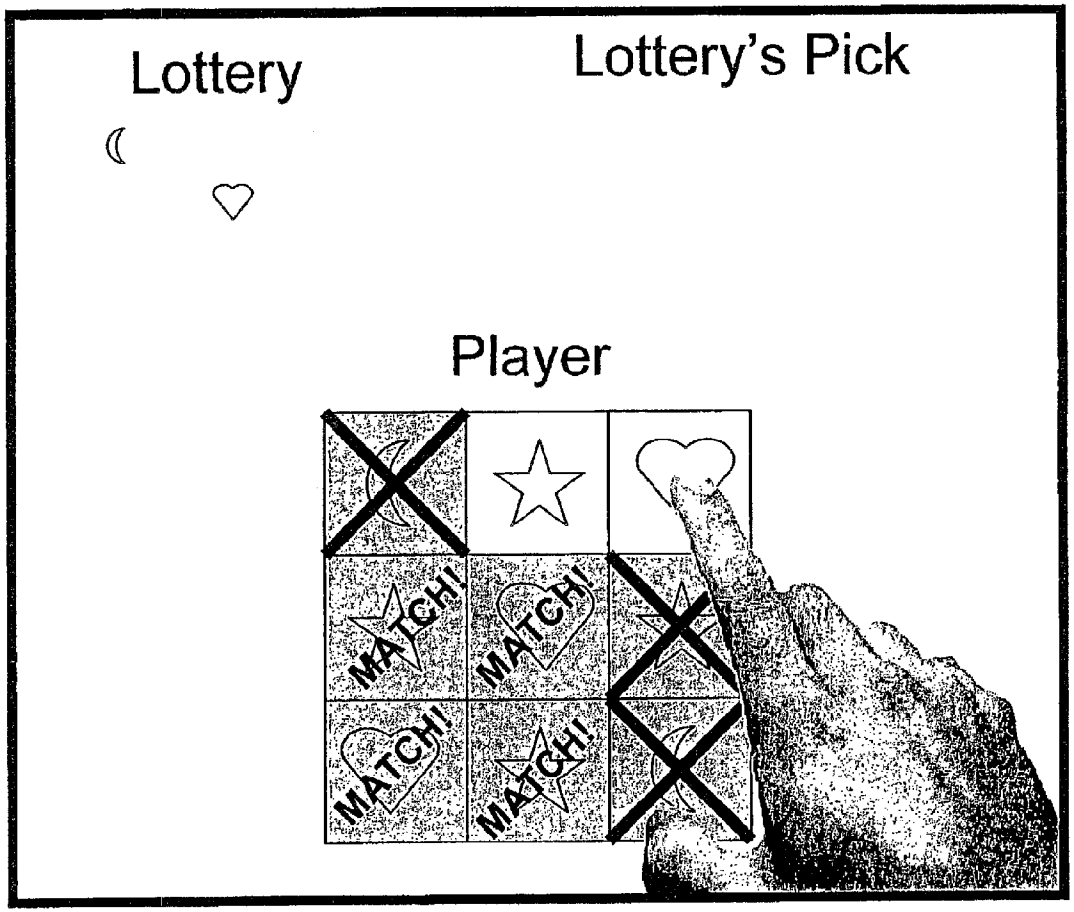
Figure 66:
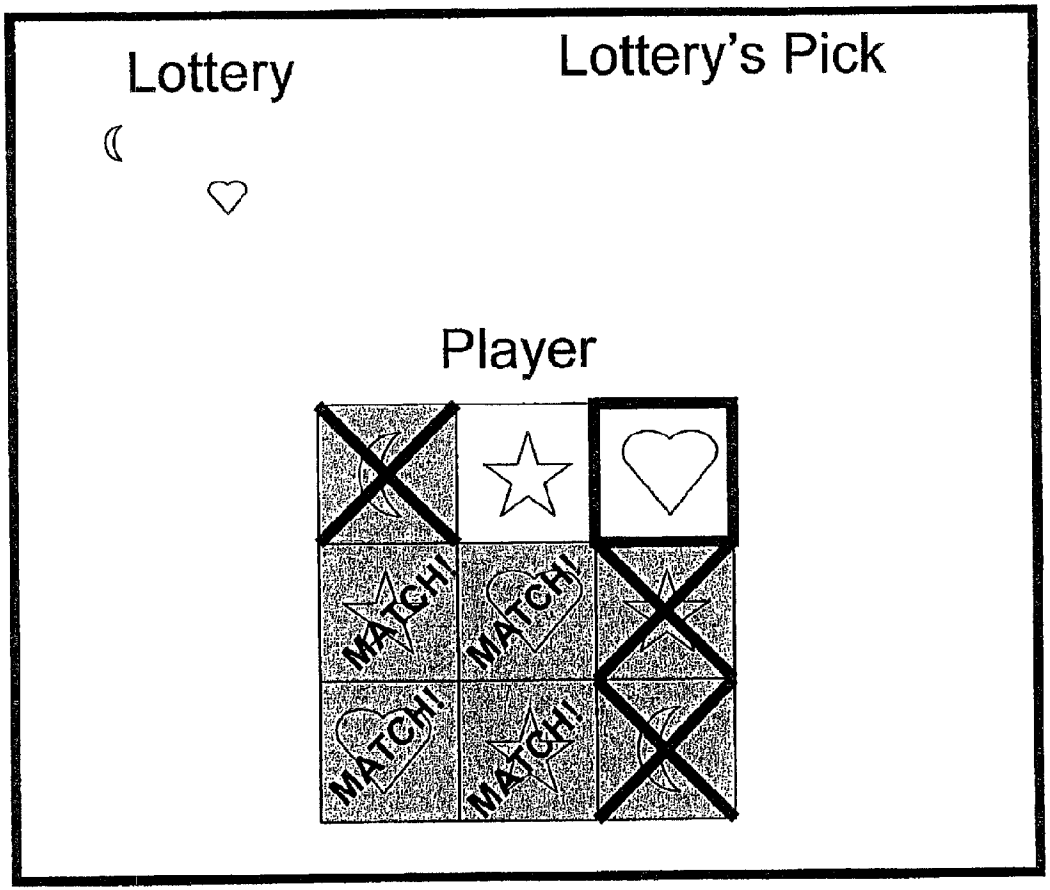
Figure 67:
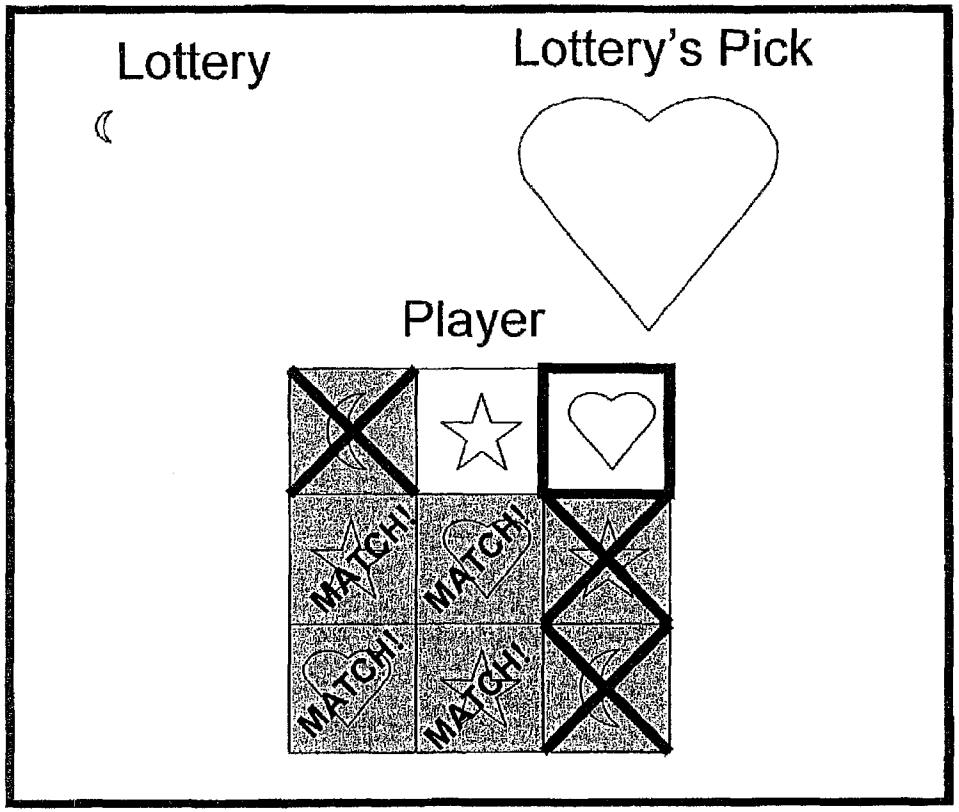
Figure 68:
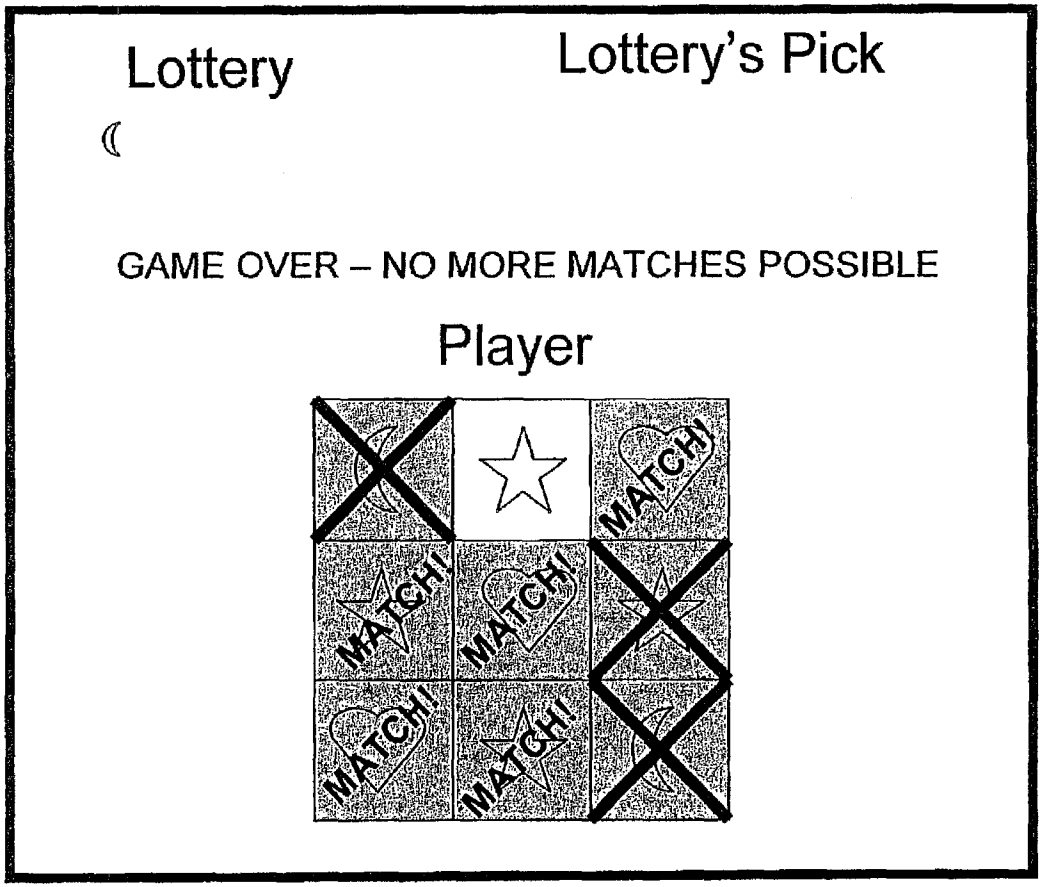

The player is prompted to select another symbol and selects a heart as shown in FIG. 65. In FIG. 66, the heart is indicated as his selection (outlined by a box). In FIG. 67, the gaming organization randomly selects a symbol from its remaining two symbols. The gaming organization has selected a heart (by translating and enlarging it on the display). As both the player and gaming organization selected a heart, the player's selection is recorded as a match by superimposing the word "match" over the selection, as in FIG. 68. At this point, the player has remaining a star and the gaming organization a crescent moon. The game is indicated as over, as no more matches are possible. FIG. 69 discloses a probability and prize table for this second embodiment of the inventive game method. As will be illustrated later, probabilities can be assigned to the outcomes of the game, which allows the allocation of prizes to produce a certain payout. Those skilled in the art of mathematics can confirm that based on the probabilities in FIG. 69, this embodiment returns 70.4% on a $5 price point. Also, it can be verified that there is a 1 in 5.1 chance of winning this game.

As in example 1, in example 2 the player may be able to influence whether or not his selection matches that of the gaming organization at particular turns. For example, at the beginning of the game, both the player and gaming organization have as their sets of symbols four stars, three hearts, and two crescent moons. If the player selects a star as his first selection he has a ⅔ probability of matching the gaming organization s selection on the first turn. If the player selects a heart he has a ⅓ (3 out of 9) chance of matching on the first turn. If he selects a crescent moon, he has a ⅔ chance of matching on the first turn. Therefore, the selection of a star on the first turn is the player's best chance of matching on the first turn. However, that does not mean that the star is the player's best choice in terms of the overall game. In fact, at any stage of the game no player choice has an inherent advantage over another in terms of attaining a certain number of matches over the course of the whole game. A probability can be assigned to the event of attaining a certain number of matches over the course of a game independent of the player's decision-making, which is described as follows below.

Result 1

There are two sets of objects of size N, a player's set A and a gaming organizations set B. There is a binary match function on A×B, i.e. a and b match means M((a,b))=1, and a and b do not match means M(a,b)=O. Let f be a bijection (one-to-one and onto) from A onto B. Starting with the player, the player and gaming organization alternate selecting objects from their respective sets without replacement. The gaming organization's selections are random and are disclosed to the player as they occur. Let $a_i$ and $b_i$ denote the player's and the gaming organization's $i^{th}$ selections, respectively. The probability that $f(a_i)=b_i$ for all i, $0<l\leq N$ is 1/N!.

Proof: For k, $1\leq k\leq N$, we claim that the probability $f(a_i)=b_i$ for all i, $0\leq i\leq k$, is (N−k)!/N!. We use the method of induction:

Case k=1: The player selects $a_1$. There are N objects from which the gaming organization randomly makes its first selection $b_1$, one of which is $f(a_1)$. Therefore, the probability is 1/N=(N—1)!/N! that $f(a_1)=b_1$.

Case k=m: Assume for m−1, that is, the probability that $f(a_i)=b_i$ for all i, $1\leq i\leq m-1$ is (N−m+1)!/N!. Let D be the event that $f(a_i)=b_i$ for all i, $1\leq i\leq m-1$, and E be the event that $f(a_m)=b_m$. The question arises what is p(E/D), the probability of E given D? Given D, it is clear that $f(a_m)$ is not among those objects chosen by the gaming organization, i.e. $f(a_m)$ b; for i, $1\leq l\leq m-1$. (Proof by Contradiction: Assume $f(a_m)=b_k$ for some k<m. Assuming D, $f(a_k)=b_k$, which implies $f(a_m)=f(a_k)$. As f is a bijection, $a_k=a_m$. As the player makes his selections without replacement and k<m, the $a_k$ cannot equal $a_m$, contradiction.) Therefore, $f(a_m)$ is among the N−m+1 objects available to be chosen as the gaming organizations $m^{th}$ object, $b_m$. Therefore, p(E/D)=1/(N−m+1). Thus, the probability that that $f(a_i)=b_i$ for all i, $1<i\leq m$ is $$p(DnE)=p(D)p(E/D)=(N-m+1)1/N!\times 1/(N-m+1)=(N-m)!/N!$$

In conclusion, applying the formula to case k=N, the probability that $f(a_i)=b_i$ for all i, $1\leq i\leq N$ is 1/N!.

As illustrated above, those skilled in the art can compute probabilities for this game as follows. Suppose the player and gaming organization each has N objects from which to select. Let $a_i$ be the player's selections and $b_i$ be the gaming organization's selections. The player's set of objects is A and the gaming organization's set of objects is B. It is desired to compute the probability that k matches occur (whatever defines a match). An equivalent way of stating that there are k matches is that there is a bijection f mapping A onto B such that |{a:a matches f(a)}=k and $f(a_i)=b_i$ for i, $1\leq i\leq N$. Suppose there are exactly M bijections f from A onto B such that |{a:a matches f(a)}|=k. Given any one of these functions f we have proven that the probability f(a;)=b; for i, 1<i N, is 1/N!. Also, for distinct bijections $f_1$ and $f_2$, the events of $f_1$ $(a_i)=b_i$ for i, $1\leq l\leq N$, $f_2(a_i)=b_i$ for i, $1\leq i\leq N$ are mutually exclusive. Therefore, the probability that any one of the M bijections is such that $f(a_i)=b_i$ for i, $1\leq i\leq N$, is M/N!. Therefore, computing the probability of k matches is a matter of counting the number of bijections such that 1 {a:a matches f(a)}|=k and dividing by N!. Counting the number of bijections can be accomplished by theoretical calculations or via computer program.

Having established the above mathematical result, we describe the computations of the probabilities for the described embodiments, In FIG. 35 the probabilities have been worked out for two through ten matches for example 1. For example, the probability of exactly seven matches are computed. Those skilled in the art of Mathematics can verify that, in general, there are two hundred and forty permutations of ten objects that have exactly seven "fixed points," a fixed point meaning that the object retains its original position after being permuted. Therefore, there are two hundred and forty bijections i from the player's set of ten objects, set "A," onto the gaming organizations set of ten objects, set "B," with the following property: $|\{\alpha\epsilon A: a \text{ matches } f(a)\}|=k$. As 10!=3,628,800, by Result 1, the probability of exactly k matches is $240/3{,}628{,}800=6.6137566\times10^{-5}$, the reciprocal of which is 151,200, the value indicated in the prize table. The probabilities for the other number of matches are computed similarly.

The probabilities in Example 2 are computed similarly. For example, in the prize table in FIG. 69, the inverse probability of matching six is indicated as 26.3. This is obtained by first counting the number of bijections f from the player's 9 objects to the gaming organizations 9 objects such that $|\{\alpha\epsilon A: a \text{ matches } f(a)\}|=6$. There are determined to be 13,824 such bijections (e.g. by mathematical calculations or by a computer program). By Result 1, the probability of 6 matches is 13,824/9!=0.038095, the inverse of which is 26.3.

There are numerous ways to expand upon the current invention. For example, a timer can be incorporated with this invention. A player may be given a time limit by which he must make a selection; otherwise, the gaming organization will randomly make one for him. That is, if the player chooses to stop playing, the game will play by itself. Also, this invention can be adapted to virtually any theme or arrangement of the symbols.

Example 3

In this example of the game method, a game based on multiple iterations of the current invention is disclosed. This embodiment comprises six rounds. For the first five rounds both the player and gaming organization each have nine objects (2 of one symbol, 3 of another, and 4 another, as discussed above for example 2). For the sixth round the player and the gaming organization each have ten distinct objects.

There are three prize tables for this embodiment of the game method. In FIG. 70, there is a prize table for each of the first five individual rounds. For each of rounds one through five, prizes are awarded for matching six, seven or nine game indicia. For example, if the player matches seven in round two he gets $10 for that round. Those skilled in the art of mathematics can verify that each round awards 9.5238% on a $5 price point, which information can be derived from the fact that the probabilities for matching six, seven or nine are 0.038095, 0.04127, and 0.015873, respectively. The total return for all 5 individual rounds is 5×9.5238%=47.619%.

In FIG. 71, there is a prize table for cumulative matches. The player's matches from each of the first five rounds are totaled and the player may be eligible for a prize based on this total. For example, if the player attains three matches in round one, seven matches in round two, five matches in round three, six matches in round four, and four matches in round five, he or she is awarded $10 for matching seven in the 2nd round and $5 for matching six in the 4th round, for a subtotal of $15. He has attained 3+7+5+6+4=25 cumulative matches. As shown in the prize table of FIG. 71, he is awarded an additional $20 for 25 cumulative matches for a subtotal of $15+$20=$35.

There is also a 6th "bonus" round, for which a player is eligible if they have winnings from the first five rounds, In the bonus round, each the player and gaming organization are assigned ten distinct objects. The player and gaming organization proceed as discussed above for example 1, in which the player and the gaming organization alternately select objects. The player is awarded a multiplier based on the number of matches. FIG. 72 illustrates the prize table for the bonus round of the game method.

For example, assume a player has won prizes of $10 and $5 in the first five rounds and a prize of $20 based on cumulative matches, for a subtotal of $35. Assume further that the player attains six matches in the bonus round. As shown by the prize table in FIG. 72, he is awarded a multiplier of ten. Therefore, if the player has won $35 in the first five rounds of the game, he is awarded 10$35=$350. There could be a limit on the magnitude of the prize, such as $5,000,000, to protect the gaming organization from excessive liability, as desired.

In order to establish prize tables as in FIGS. 70 through 72 it is necessary to assign probabilities to each of the events to which a prize is assigned. It has been discussed herein, above, how to compute the probabilities for each of the six individual rounds of this embodiment, as illustrated in FIGS. 70 and 72. For each of rounds 1-5, in which there are repeats of symbols, the probabilities are computed like those of example 2. In the bonus round, in which there are ten distinct objects, the probabilities are computed like those of example 1. How to compute the probabilities for the cumulative matches of in FIG. 71 is now described.

To compute probabilities for the cumulative matches we may use the theory of probability generating functions. For a random variable N taking on nonnegative integral values, the probability generating function is defined to be $G(t)=E(t^N)$. Define $N_i$ to be the random variable taking on values 0 through 9 and for which the probability density function $f_i(j)$ is defined to be the probability of j matches for round i. For example, for each i, $f_i(6)$ is 0.038095, the probability of matching 6 for a single round. Note, as the $N_i$ are identically distributed each has the same probability density function, we'll call f(t), and the same probability generating function, we'll call G(t).

From the theory of probability generating functions G(t) can be expressed $f(0)+f(1)t+f(2)t^2+\ldots+f(9)t^9$. This polynomial is illustrated in FIG. 73. For example, note that in FIG. 73 since the coefficient of $t^3$ is 2.69841 E-01, that is the probability that N=3. Also, note there is no $t^8$ term as it is not possible to match exactly 8 in a single round. We also know that since the individual rounds are played independently the $N_i$ are independent random variables.

Taking their sum of these independent, identically distributed random variables $N_1+N_2+N_3+N_4+N_5$ as a random variable itself, we know from the theory of probability generating functions that its probability generating function can be attained by multiplying together the five individual probability generating functions. That is, the probability generating function for $N_1+N_2+N_3+N_4+N_5$ is $[G(t)]^5$. In FIG. 74, we expand this polynomial. From the theory of probability generating functions, the coefficients of the polynomial in FIG. 74 are the cumulative probabilities. For example, the probability that the total number of matches is forty is 8.27509E-12, the coefficient of $t^{40}$. Note that there is no $t^{44}$ term. This is because it is not possible for there to be exactly forty-four matches in the five rounds. Having explained the calculation of the odds, those skilled in the art of mathematics can verify that the embodiment in example 3 pays out 71.9% based on the prize tables in FIGS. 71 through 72 and a $5 price point.

Figure 75:
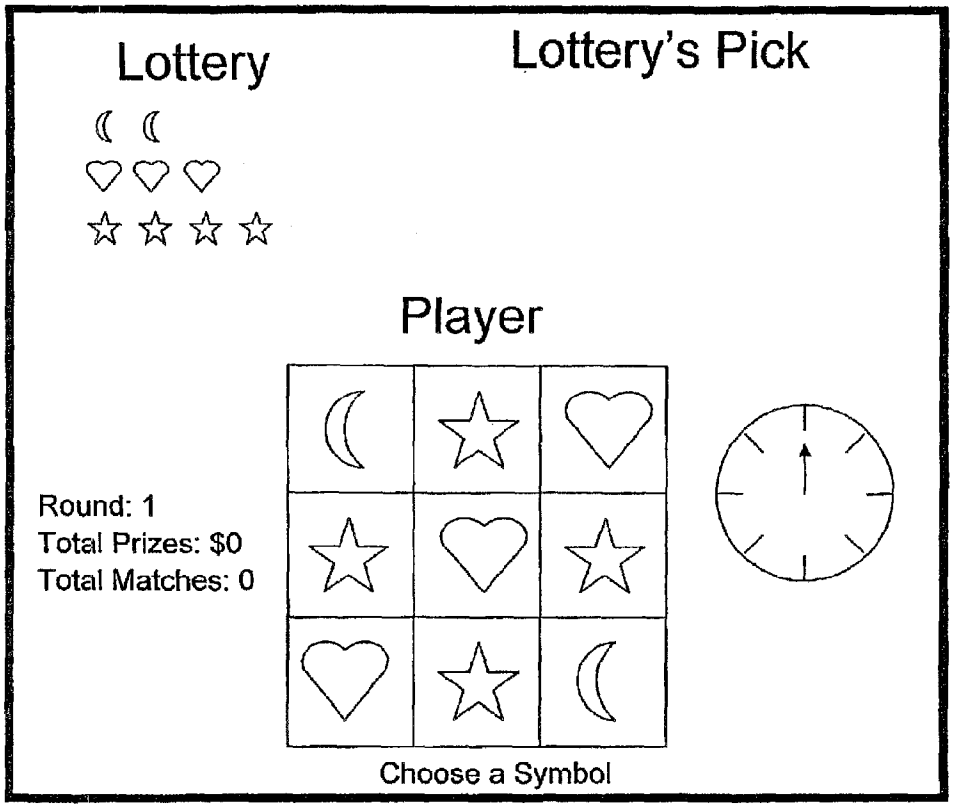
FIGS. 75-82 illustrate a third embodiment of a game method of the invention.

FIGS. 75-82 illustrate the embodiment described in example 3. FIG. 75 illustrates round 1. The player and gaming organization are each assigned nine objects, two of one symbol, three of another symbol and four of yet another symbol. Also, the "Round," "Total Prizes" and "Total Matches" are indicated on the display. As a player wins a prize, it is added to the "Total Prizes" and as a player attains a match it is added to the "Total Matches." There is also a timer. For each turn, after a predetermined time period elapses, if the player has not made his selection a symbol is randomly selected for him. Accordingly, once the game method is started and should the player refrain making their own game indicia selections, the game will play automatically.

Figure 76:
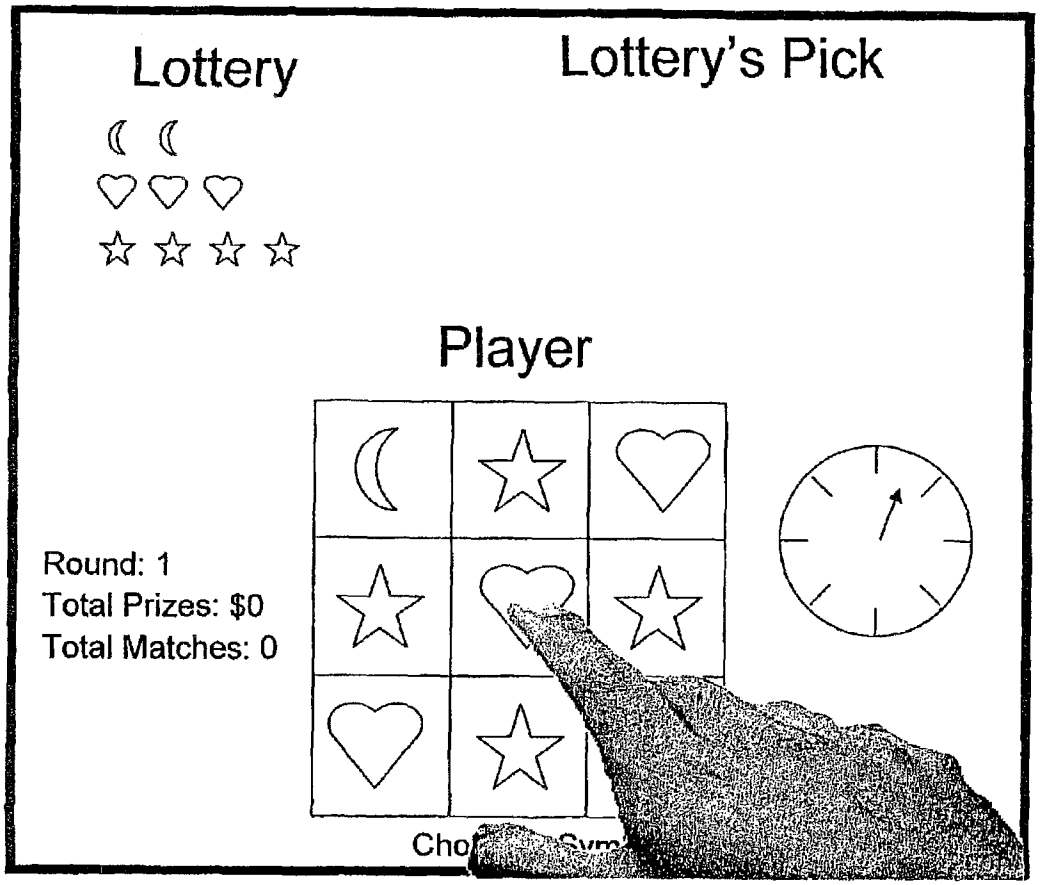

Referring to the drawings, in FIG. 75 the game player is prompted to select a game indicia or symbol, and in FIG. 76 the player has selected a heart.

Figure 77:
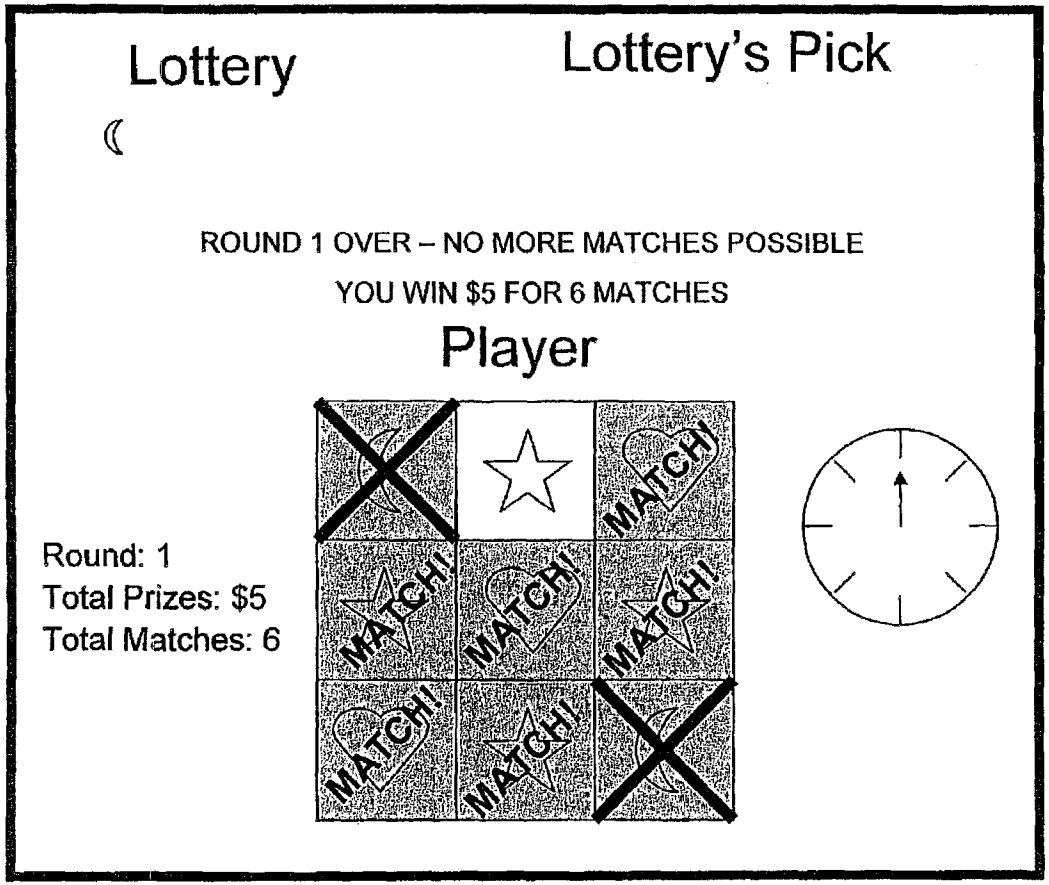

The game continues until there are no more possible matches for round 1, as illustrated in FIG. 77. The player has matched six objects and thus wins $5. His "Total Prizes" increased from $0 to $5. Note that the "Total Matches" is six at this point.

Figure 78:
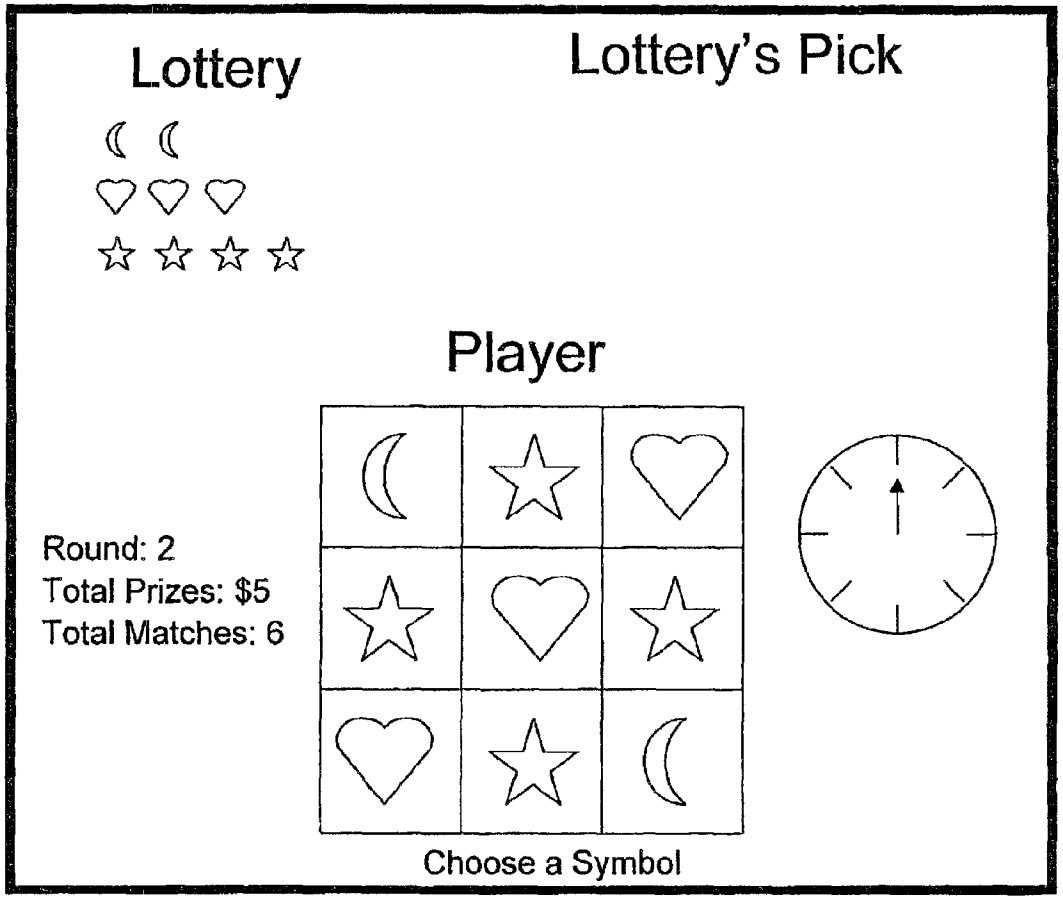
Figure 79:
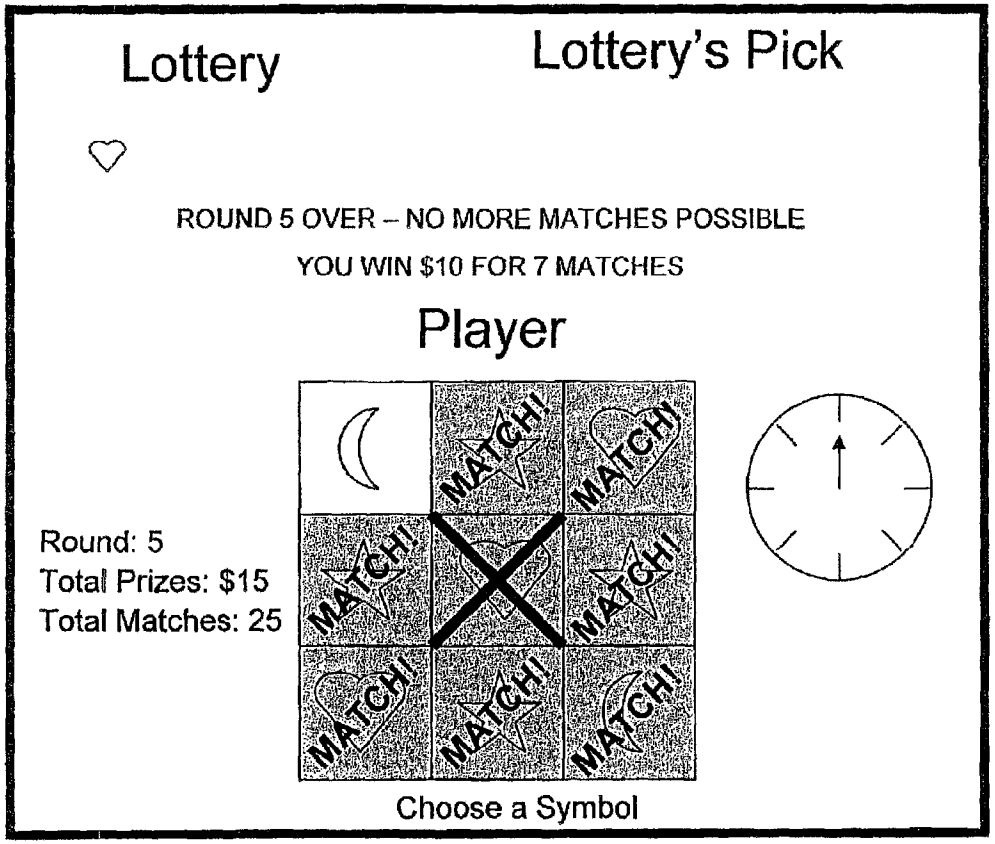
Figure 80:
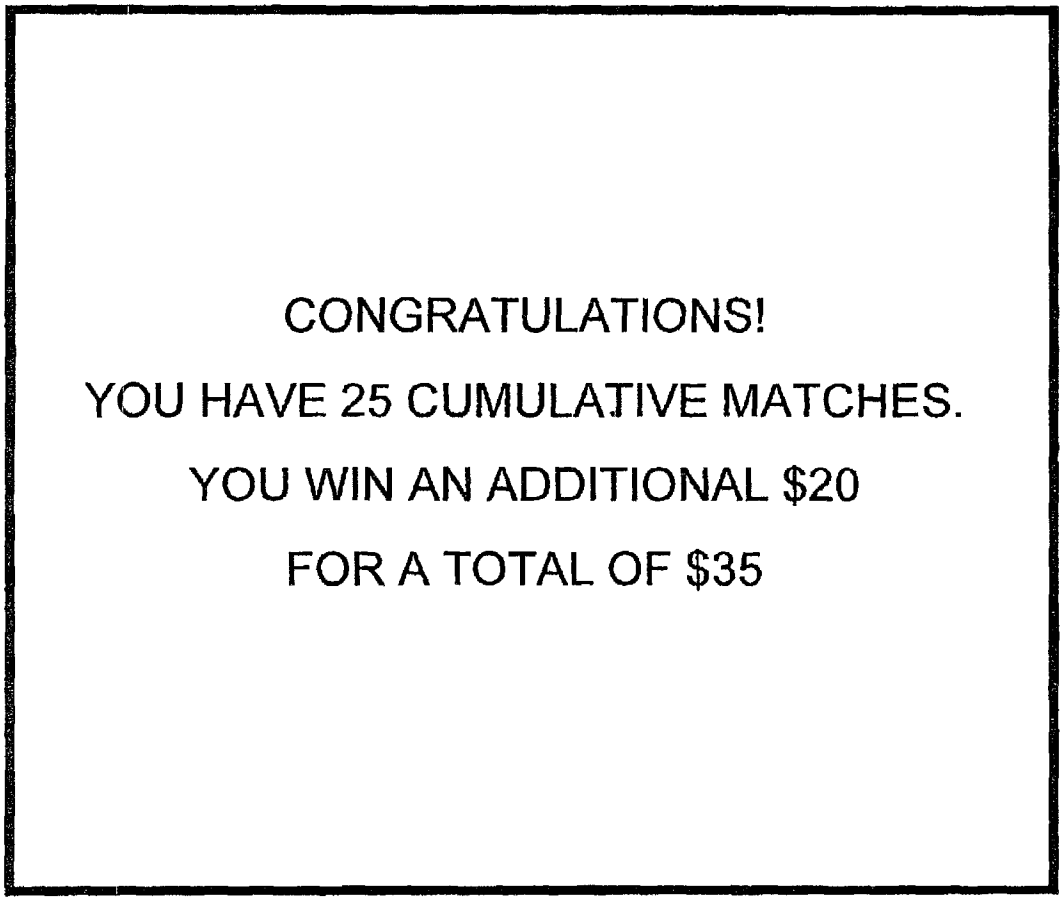
Figure 81:
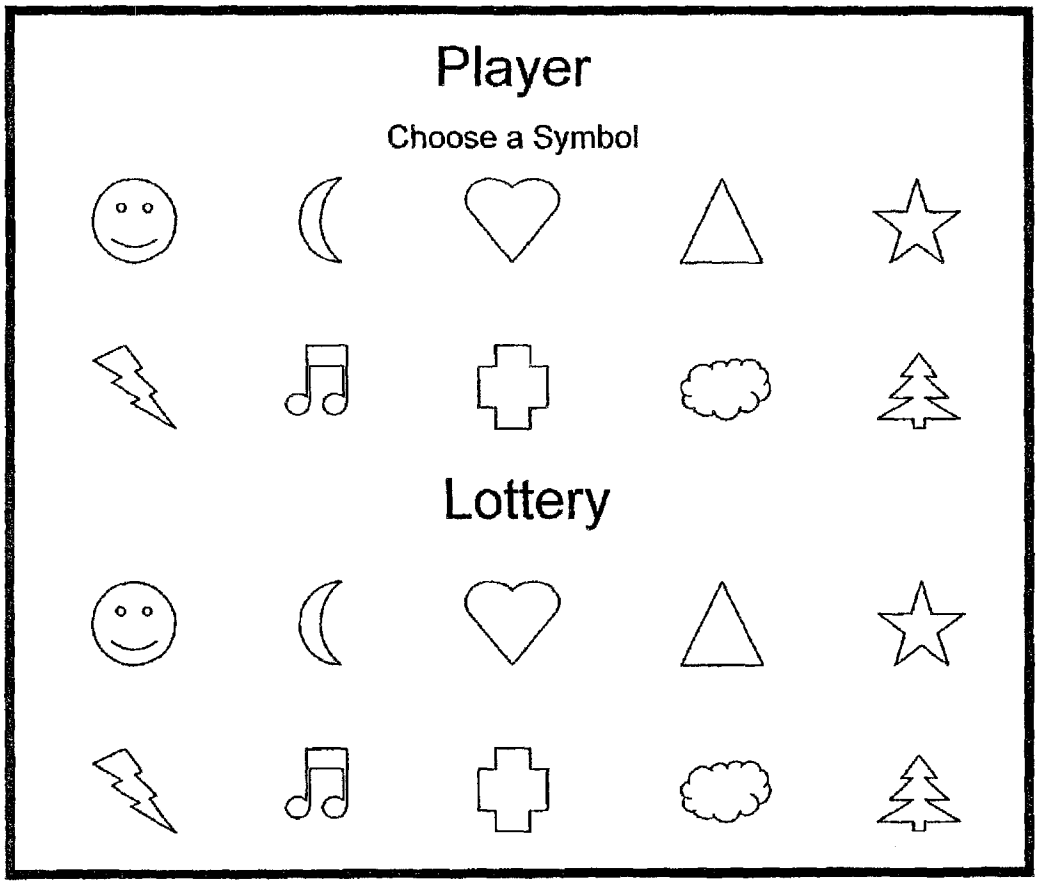
Figure 81A:
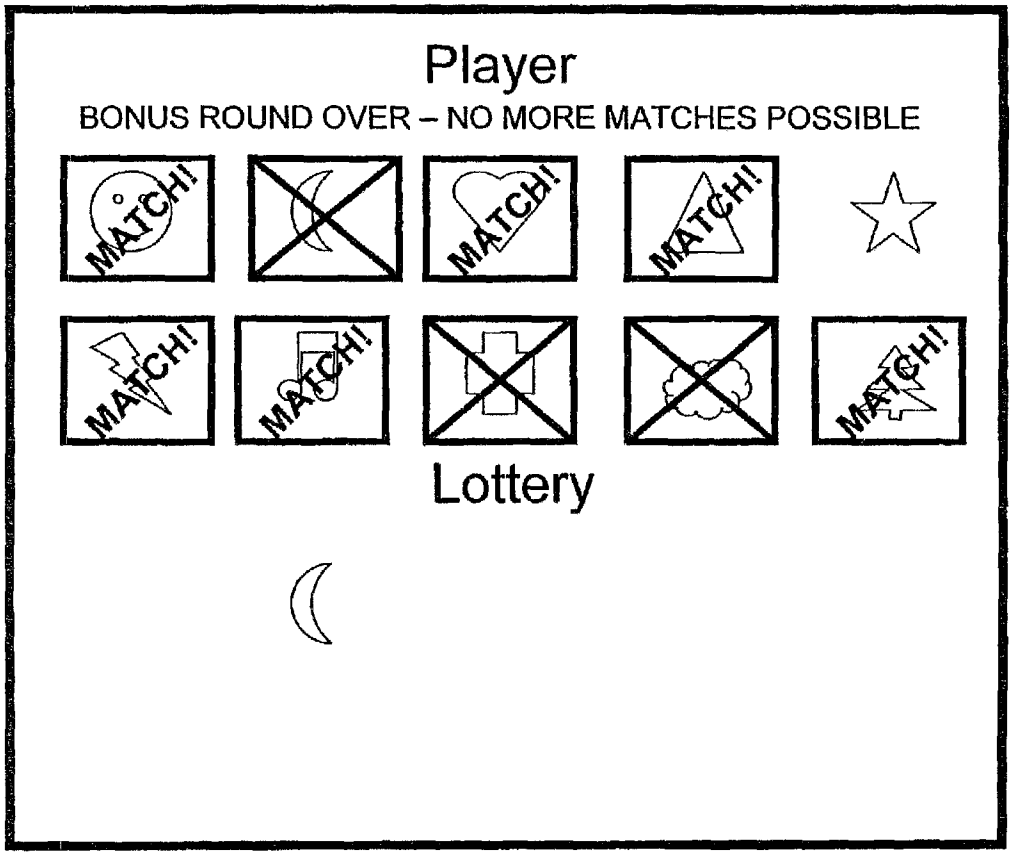
Figure 82:
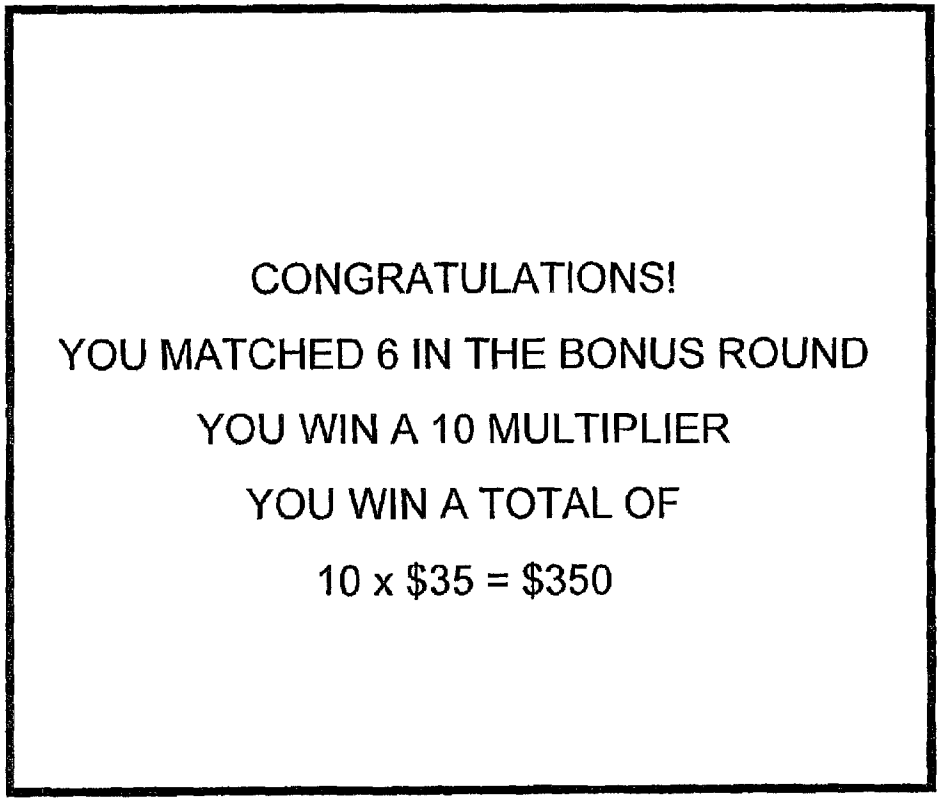

After a certain amount of time, the display is refreshed and round two begins. The player is prompted to select a symbol to play, as shown in FIG. 78. The game continues until the player has completed five consecutive rounds. FIG. 79 illustrates the completion of round five. The player has won $10 for having matched seven in this round. His "Total Prizes" are $15 (having won $10 in the fifth round and $5 in an earlier round). His "Total Matches" are twenty-five, meaning that the sum of the matches from all five rounds is twenty-five. After a certain amount of time, it is communicated to the player if he has won a cumulative prize, as shown in FIG. 80. Since the player here, for the purposes of this example, has twenty-five cumulative matches, he wins an additional $20 (FIG. 71). The $20 is added to the $15 for a total of $35. As the player has won money resulting from game play, he is entered into the bonus round to possibly win a multiplier. In FIG. 81, he is presented with ten distinct objects from which to make selections, and the ten distinct objects from which the gaming organization will make its selections are also displayed. The game player and the gaming organization alternate selecting objects starting with the player. FIG. 81 illustrates the end of the bonus round at the point at which no more matches are possible. The player has attained six matches in the bonus round. According to the prize table in FIG. 72, he is awarded a multiplier having a value of ten. The multiplier is applied to his winnings and thus the player's final winnings are 10×$35=$350. This is communicated to the player as illustrated in FIG. 82.

Figure 83:
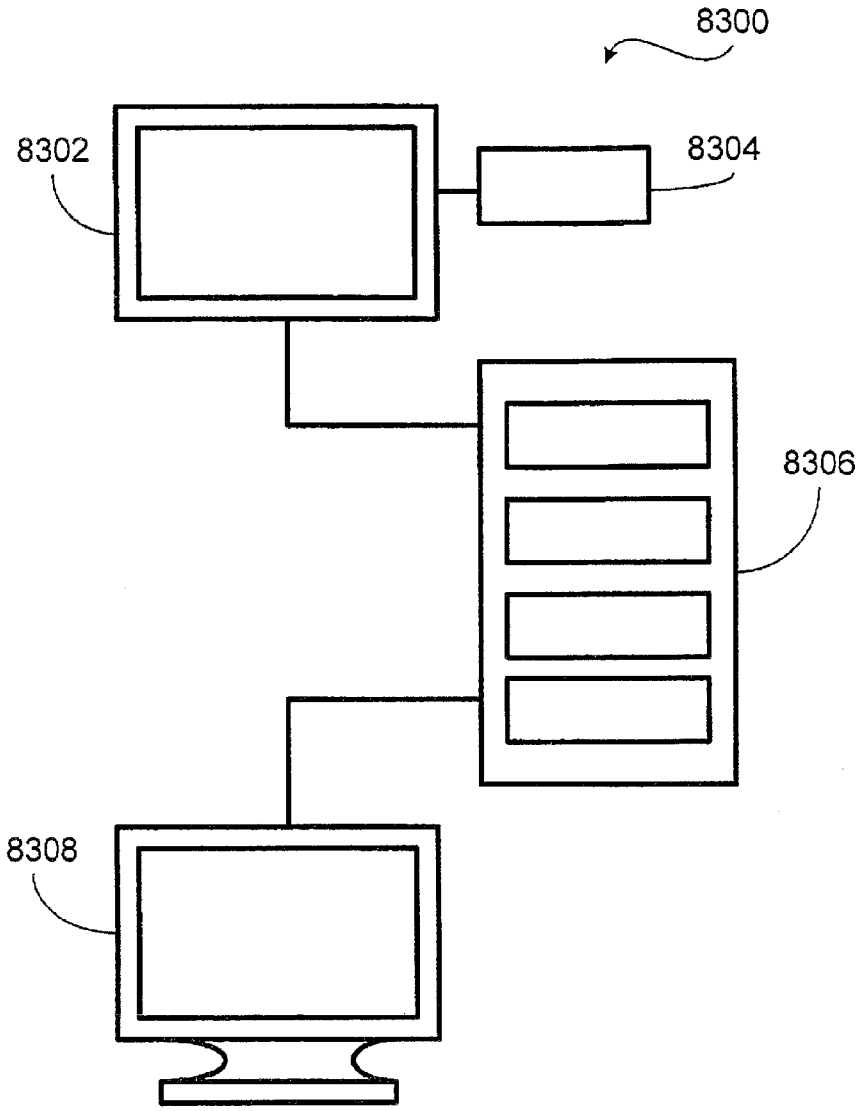
FIG. 83 illustrates an architecture of a system supporting the invention.

FIG. 83 illustrates a system 8300 according to the invention. The game of the invention can be played through a display device 8302. The display device 8302 may be a touch screen device capable of receiving user selection. Alternatively, the display device 8302 may also be equipped with an input device (not shown) such as keyboard or game device through which a player may enter his selection. The display device 8302 may also be equipped with a device 8304 that takes a wager from the player. The wager may be in form of credit card, cash, or other medium of exchange. The display device 8302 is connected to a server 8306. The server includes a controller that is capable of generating game symbols (game indicia) for the lottery authority and determine number of matches between the game symbols and player symbols. The server may also be equipped with a timer that enables the server to generate a player symbol (player indicia) as described above. Alternatively, the game may be played through a remote terminal 8308 connected to the server 8306. The remote terminal can be a computing device located in a casino and can also be a computing device located in a player's home.

Figure 84:
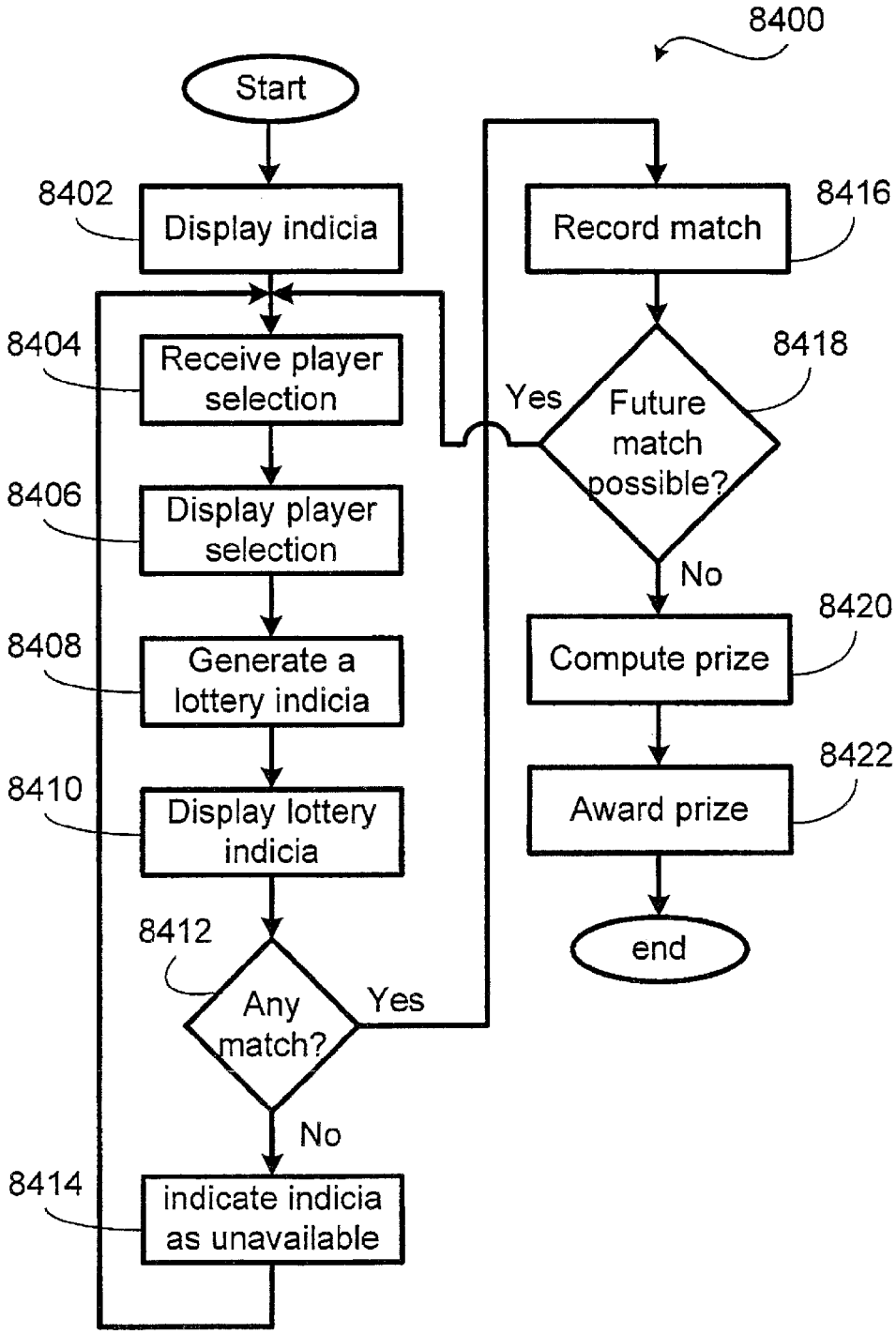
FIG. 84 illustrates a flow chart for a game playing process according to the invention.

FIG. 84 illustrates a game process 8400. When the game starts, the server displays a set of game indicia on a display device, step 8402. The player can make his selection and the player selection is received by the server, step 8404. The player selection is displayed on the display device, step 8406. The server will generate a lottery indicium, step 8408, and displayer the generated lottery indicium on the display device, step 8410. After each turn of the player selection a game indicium and the server generating a lottery indicium, the server determines if there is any match between these game indicia, step 8412. If there is no match, the server marks the player indicium making it unavailable for next selection, removes the lottery indicium from the display, step 8414, and repeats steps 8404-8412. If there is a match, the server records the match, step 8416, and verifies if future matches are possible, step 8418. If the future matches are possible, the game continues and the steps 8404-8412 are repeated. If the future matches are not possible, the server computes a prize for the player based on the number of matches, step 8420, and awards the prize to the player, step 8422.

Although preferred embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. Moreover, although specific terms are employed herein, as well as in the claims, they are used in a generic and descriptive sense only, and not for the purposes of limiting the described invention, nor the claims which follow below.

What is claimed is:

1. A method for conducting an interactive lottery game between players and a lottery gaming organization via a graphical user interface in communication with a game server, said method comprising:

a) displaying to the player on the graphical user interface a first set of player game indicia assigned to the player for play of the lottery game and a separately displayed second set of lottery game indicia assigned to the lottery gaming organization for play of the lottery game;

b) the player selecting one of the player game indicia from the first set of player game indicia via the graphical user interface, with the player's selection designated on the graphical user interface without being revealed to the lottery gaming organization;

c) the lottery gaming organization, via the game server and without being aware of the player's selection from the first set of player game indicia, subsequently after the player selection, randomly selecting one of the remaining unselected lottery game indicia from the second set of lottery game indicia;

d) displaying the randomly selected lottery game indicia from the second set of lottery game indicia to the player on the graphical user interface such that the graphical interface separately displays to the player the player selected game indicia, the randomly selected lottery game indicia, and the remaining unselected player game indicia and lottery game indicia;

e) determining if the player-selected game indicia matches a predetermined criteria as a function of the randomly selected lottery game indicia;

(f) removing the randomly selected lottery game indicia from display on the graphical user interface after step, (e) such that the graphical user interface contains only the remaining unselected lottery game indicia; and (g) repeating steps (b) through (f).

2. The method as in claim 1, wherein step (g) is repeated until no further player game indicia remain in the first set of player game indicia or no further matches are possible between the first set of player game indicia and the second set of lottery game indicia.

3. The method as in claim 2, further comprising awarding a prize to the player as a function of the number of accumulated matches from steps (b) through (g) between the player selected game indicia and the randomly selected lottery game indicia.

4. The method as in claim 3, further comprising implementing a bonus game wherein a multiplier factor is applied to the prize award for successful play of the bonus game.

5. The method as in claim 4, wherein the bonus game is a reiteration of steps (b) through (g), and the value of the multiplier factor is a function of the number of matches in the bonus game.

6. The method as in claim 1, wherein the first set of player game indicia and the second set of lottery game indicia are identical, and the predetermined match criteria is a match of identical game indicia.

7. The method as in claim 1, further comprising indicating to the player on the graphical user interface which of the player selected game indicia matched the randomly selected lottery game indicia.

8. The method as in claim 1, further comprising providing the player with a defined period of time in which to select their player game indicia, and automatically randomly selecting an indicia for the player from the remaining player game indicia in the event that the time period expires.

9. A system for conducting an interactive lottery game wherein players plays against a lottery gaming organization, comprising:

a graphical user interface in communication with a game server;

the server configured to display to the player on the graphical user interface a first set of player game indicia assigned to the player for play of the lottery game and a separately displayed second set of lottery game indicia assigned to the lottery gaming organization for play of the lottery game;

the graphical user interface configured to allow the player to select one of the player game indicia from the first set of player game indicia via the graphical user interface, with the player's selection designated on the graphical user interface without being revealed to the lottery gaming organization;

the server configured to, subsequently after the player selection, randomly select one of the remaining unselected lottery game indicia from the second set of lottery game indicia without being aware of the player's selection from the first set of player game indicia;

the graphical user interface configured to display the randomly selected lottery game indicia to the player on the graphical user interface such that the graphical user interface separately displays to the player the player selected game indicia, the randomly selected lottery game indicia, and the remaining unselected player game indicia and lottery game indicia;

the server configured to determine if the player-selected player select game indicia matches a predetermined criteria as a function of the randomly selected lottery game indicia and designate any such match to the player on the graphical user interface;

the server configured to remove the randomly selected lottery game indicia from display on the graphical user interface such that the graphical user interface contains only the remaining unselected lottery game indicia;

the server and graphical user interface configured to repeat the process wherein the player selects one of the remaining unselected player game indicia, and the lottery gaming organization randomly selects and displays one of the remaining unselected lottery game indicia; and the server configured to indicate on the graphical user interface a prize awarded to the player that is a function of the number of matches between the player selected game indicia and the randomly selected lottery game indicia.

10. The system as in claim 9, wherein the server and graphical user interface are configured to play the lottery game until no further player game indicia remain in the first set of player game indicia or no further matches are possible between the first set of player game indicia and the second set of lottery game indicia.

11. The system as in claim 10, wherein the server is further configured to determine a prize for the player as a function of the number of accumulated matches between the player selected game indicia and the randomly selected lottery game indicia.

12. The system as in claim 10, wherein the server is further configured to indicate on the graphical user interface which of the player selected game indicia matches the randomly selected lottery game indicia.

13. The system as in claim 9, wherein the server is further configured to provide the player with a defined period of time in which to select their game indicia, and to automatically randomly select an indicia for the player from the remaining player assigned game indicia in the event that the time expires without the player making a selection of game indicia.

14. The system as in claim 9, wherein the server and graphical user interface are configured to conduct multiple iterations of the lottery game, and the player is awarded a prize based on the total number of matches from the multiple iterations of the game.

15. The system as in claim 9, wherein the server and graphical user interface are further configured to conduct a bonus game wherein a multiplier factor is applied to the prize award for successful play of the bonus game.

16. The system as in claim 15, wherein the bonus game is a reiteration of the lottery game, and the value of the multiplier factor is a function of the number of matches in the bonus game.

* * * * *